US008507163B2

(12) United States Patent
Tamoto et al.

(10) Patent No.: US 8,507,163 B2
(45) Date of Patent: Aug. 13, 2013

(54) METHOD OF MANUFACTURING IMAGE BEARING MEMBER, IMAGE BEARING MEMBER, AND IMAGE FORMING APPARATUS

(75) Inventors: Nozomu Tamoto, Numazu (JP); Hideo Nakamori, Numazu (JP); Mitsuaki Hirose, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 689 days.

(21) Appl. No.: 12/635,937

(22) Filed: Dec. 11, 2009

(65) Prior Publication Data

US 2010/0150606 A1 Jun. 17, 2010

(30) Foreign Application Priority Data

Dec. 11, 2008 (JP) ..... 2008-315720
Feb. 10, 2009 (JP) ..... 2009-028521

(51) Int. Cl.
*G03G 5/00* (2006.01)

(52) U.S. Cl.
USPC ..... 430/66; 430/58.65; 430/126.1; 430/132; 399/159

(58) Field of Classification Search
USPC ..... 430/66, 126.1, 132; 399/111, 159
See application file for complete search history.

(56) References Cited

U.S. PATENT DOCUMENTS 6,790,572 B2 * 9/2004 Tamoto et al. ..... 430/58.05
6,844,124 B2 1/2005 Ikuno et al.
6,861,188 B2 3/2005 Ikegami et al.
6,899,983 B2 5/2005 Tamoto et al.
6,936,388 B2 8/2005 Suzuki et al.
7,018,755 B2 3/2006 Ikegami et al.
7,160,658 B2 1/2007 Suzuki et al.
7,251,437 B2 7/2007 Tamoto et al.
7,267,916 B2 9/2007 Sugino et al.
7,314,693 B2 1/2008 Ikegami et al.
7,371,490 B2 5/2008 Tamoto et al.
7,371,491 B2 5/2008 Niimi et al.
7,381,511 B2 6/2008 Ikegami et al.
7,507,511 B2 3/2009 Tamoto et al.
7,534,538 B2 5/2009 Niimi et al.
7,560,203 B2 7/2009 Tamoto et al.
2005/0170272 A1 * 8/2005 Suzuki et al. ..... 430/66
2006/0134540 A1 6/2006 Kondo et al.

(Continued)

FOREIGN PATENT DOCUMENTS

JP 56-48637 5/1981
JP 56-45219 10/1981

(Continued)

OTHER PUBLICATIONS

U.S. Appl. No. 12/128,061, filed May 28, 2008.

*Primary Examiner* — Thorl Chea
(74) *Attorney, Agent, or Firm* — Cooper & Dunham LLP

(57) ABSTRACT

A method of manufacturing an image bearing member including forming a charge generation layer overlying an electroconductive substrate, forming a charge transport layer overlying the charge generation layer, the charge transport layer including a charge transport material having a molecular weight of from 600 to 900 and a binder resin, and forming a protection layer overlying the charge transport layer by applying a liquid application containing a polymerizable compound having a charge transport structure, a polymerizable compound having no charge transport structure, a filler, a polycarboxylic acid compound, and cyclopentanone and curing the polymerizable compound having a charge transport structure, and the polymerizable compound having no charge transport structure.

18 Claims, 5 Drawing Sheets

(56) References Cited

U.S. PATENT DOCUMENTS

| | | | | |
|---|---|---|---|---|
| 2007/0196749 | A1 | 8/2007 | Inaba et al. | |
| 2008/0063962 | A1 | 3/2008 | Toshine et al. | |
| 2008/0102391 | A1 | 5/2008 | Yanagawa et al. | |
| 2008/0145778 | A1 | 6/2008 | Ohta et al. | |
| 2008/0292981 | A1* | 11/2008 | Toda et al. | 430/58.65 |
| 2008/0318142 | A1 | 12/2008 | Kawasaki et al. | |
| 2009/0035017 | A1 | 2/2009 | Tada et al. | |
| 2010/0015538 | A1 | 1/2010 | Nakamori | |

FOREIGN PATENT DOCUMENTS

| | | |
|---|---|---|
| JP | 60-27012 | 6/1985 |
| JP | 60-27013 | 6/1985 |
| JP | 60-27014 | 6/1985 |
| JP | 60-27015 | 6/1985 |
| JP | 60-27016 | 6/1985 |
| JP | 60-27017 | 6/1985 |
| JP | 60-27018 | 6/1985 |
| JP | 60-29109 | 7/1985 |
| JP | 61-36023 | 8/1986 |
| JP | 6-45770 | 2/1994 |
| JP | 7-5703 | 1/1995 |
| JP | 7-10912 | 2/1995 |
| JP | 7-69126 | 7/1995 |
| JP | 2821318 | 8/1998 |
| JP | 2000-330313 | 11/2000 |
| JP | 3164426 | 3/2001 |
| JP | 3286711 | 3/2002 |
| JP | 2003-91083 | 3/2003 |
| JP | 2003-98713 | 4/2003 |
| JP | 3734735 | 10/2005 |
| JP | 3802787 | 5/2006 |
| JP | 3818585 | 6/2006 |
| JP | 3878444 | 11/2006 |
| JP | 2006-330086 | 12/2006 |
| JP | 2007-72487 | 3/2007 |
| JP | 3936537 | 3/2007 |
| JP | 3942154 | 4/2007 |
| JP | 4118839 | 5/2008 |
| JP | 4194973 | 10/2008 |
| JP | 4300279 | 5/2009 |

* cited by examiner

METHOD OF MANUFACTURING IMAGE BEARING MEMBER, IMAGE BEARING MEMBER, AND IMAGE FORMING APPARATUS

BACKGROUND OF THE INVENTION

1. Field of the Invention

The present invention relates to a method of manufacturing an image bearing member, the thus obtained image bearing member, and an image forming apparatus, and a process cartridge using the image bearing member.

2. Discussion of the Background

Organic photoconductors, which mainly contain organic material, are widely used as image bearing members in electrophotography field in terms of cost, productivity, free latitude of material selection, impact on global environment, etc. Such organic photoconductors are formed of a photosensitive layer mainly containing photosensitive material and typified into a single layer type in which a single layer assumes both a charge generation function and a charge transport function, and a laminate type having a charge generation layer assuming a charge generation function and charge transport layer assuming a charge transport function.

The mechanism of forming latent electrostatic images on an image bearing member of a function separated laminate type is that when a uniformly charged image bearing member is irradiated with light, the light passes through the charge transport layer and is absorbed in charge generation material in the charge generation layer to generate charges (a pair of charges). One in the pair is infused into the charge transport layer at the interface between the charge generation layer and the charge transport layer, transferred into the charge transport layer by an electric field to the surface of the image bearing member and then neutralize the surface charge provided by charging to form a latent electrostatic image. The organic photoconductors having such a laminate structure is advantageous in terms of the stability of the electrostatic characteristics and durability and thus currently the mainstream of the image bearing members.

With an advance in improvement on the development material or the image forming apparatus itself in addition to the image bearing member, an image forming apparatus using an organic photoconductor has been rapidly improved toward full colorization and high speed performance. The use application of printing has been accordingly diversified and the image forming apparatus in the electrophotography has been used in quick printing in recent years. In the quick printing filed, it is required to maintain the image quality free from image deficiency during repetitive printing of the same image or document. To meet this requirement, art image bearing member needs to simultaneously have excellent mechanical durability, i.e., a strong surface for abrasion and damage, and excellent electrostatic durability, i.e., being free from charge reduction, rise in residual voltage and/or sensitivity deterioration, for repetitive printing over an extended period of time.

For example, unexamined published Japanese patent application No. (hereinafter referred to as JOP) S56-48367 describes (1) a technology in which a curable binder is used in the surface layer; JOP S64-1728 describes (2) a technology in which a curable binder is used in the surface layer; and JOP H04-281461 describes (3) a technology in which a filler is dispersed in the surface layer. Among these technologies, the technology of using a curable binder improves abrasion resistance and damage resistance due to the curing but is not sufficient in the conditions of the quick printing field which is severer than those of the typical printing in office environments. In the technology of curing a surface layer, material contained in the surface layer not involved in the reaction causes curing inhibition, and thus monomers may remain non-reacted in the surface layer, which may lead to a rise of the residual voltage, charge reduction, degradation of anti-chemical property. In addition, promotion of curing reaction to improve the hardness of a surface layer leads to a significant rise of the residual voltage and prevents a good combination of the mechanical strength and electrostatic durability. The technology of using a charge transport polymer improves anti-abrasion property in some degree but is not good enough for use in the quick printing field. In addition, polymerization and refinement of such a charge transport polymer is difficult and thus the charge transport polymer having a high purity is not easy to obtain. Therefore, this technology is not good enough in terms of the electrostatic durability. Furthermore, there are manufacturing problems such that the liquid application has a high viscosity. The technology with regard to filler dispersion improves the abrasion resistance but again is not sufficient in the quick printing field. The mechanical strength is improved by containing a filler but detached filler may damage the surface of the image bearing member, which may lead to occurrence of filming or attachment of foreign objects as the damage develops. In addition, the charge trap site existing on the surface of the filler raises the residual voltage, which easily reduces the image density. As described above, these typical technologies improve the abrasion resistance of an image bearing member but cause electrostatic deterioration, which results in the occurrence of image deficiency, etc. Thus, these technologies are not sufficient in application use in the quick printing field.

Also, Japanese patent application No. (hereinafter referred to as JP) 3734735 describes a technology in which a surface layer is formed by spray coating a liquid application prepared by using a resin, filler and a solvent which dissolves a resin for use in the surface of a photosensitive layer. JOP H07-5703 describes a technology to improve chargeability, dark decay, and the electrophotographic property during repetitive use.

Furthermore, there is described a method in which these technologies are combined by a curable resin in the surface layer and containing a filler therein. For example, JP 2821318 describes a method in which a protection layer is formed by using a liquid application in which electroconductive metal oxide particulates are dispersed in a specific curable acryl based monomer. Also, for example, JOP 2000-330313 describes a technology in which particulates and a binder resin in which a charge transport material containing a hydroxyl group or carboxyl group is cross linked with a block polymerized isocyanate are contained in a surface layer. Furthermore, there is described a method (e.g., in JOP 2005-99688) in which filler particulates are dispersed in a cross-linked resin layer formed by curing a radical polymerizable monomer having three or more functional groups without a charge transport structure, and a radical polymerizable compound having a charge transport structure. In addition, there is described a method (e.g., in JOP 2006-330086) in which a thermosetting binder resin, a charge transport material having a cross-linkable functional group, and electroconductive particulates are contained. Containing a filler in a cured resin is an efficient way to prevent detachment of the filler and improve the anti-abrasion property. When electroconductive particulates are used as the filler, such particulates are added to control the resistance of the surface layer, but have a great effect on improvement on the abrasion resistance. However, when a material not involved in the curing reaction of the cured resin is mixed, such a material inhibits curing reaction, in which case such effects are not obtained.

Therefore, a method in which a filler is contained in a cured resin is anticipated to have a great effect but is extremely difficult to realize.

For example, there is a problem with the dispersion property of a filler. To improve the dispersion property of a filler, JP 3802787 describes a method of using a moisture dispersion agent of the unsaturated poly carboxylic acid type having an acid value of from 30 to 400 mgKOH/g. This is extremely an effective way in the present invention. However, In JP 3802787, a thermoplastic resin is used as the binder resin while a cured resin is used in the present invention, meaning that there is a great technical difference between the two.

When a cured resin is used, the cured resin is cured after a filler is contained therein and thus, the filler itself induces curing inhibition. Such known technologies are not good enough because the effect of the cured resin is not obtained when curing reaction is inhibited.

In addition, for example, JOP 2007-72487 describes a technology in which a filler is dispersed in a solvent without a binder resin and thereafter the solution is mixed with a solution of the binder resin to prepare a liquid application for forming the surface layer. This method is an extremely good way to improve the dispersion property of a filler and the dispersion stability and is used in the present invention. However, a single use of this method is insufficient. As described above, the protection layer in which a filler is dispersed in a cured resin is an extremely efficient way to improve the abrasion resistance of an image bearing member but there are a number of problems to be solved to obtain such effects. Therefore, the method of solving these problems has been aspired to improve the durability of an image bearing member.

As described above, the image bearing member having a protection layer in which a filler is dispersed in a cured resin has significantly improved abrasion resistance and damage resistance. Thus, the status of the surface of the image bearing member is unchanged during repetitive printing over an extended period of time. Therefore, this technology is durable for the use application in the quick printing field.

However, when a protection layer formed of a filler and a cured resin is formed on a photosensitive layer (or charge transport layer), the curing reaction of a curable resin may be inhibited due to the existence of the filler. This does not cause a problem when the dispersion property of a filler is high. However, when a filler having a bad dispersion property is used and thus agglomerates, the curing reaction is significantly inhibited and thus the filler is not sufficiently held in the cured resin. In addition, when the filler agglomerates and is not sufficiently dispersed, the number of fillers with thinly covered by the resin increases and thus the filler tends to be detached therefrom. Thereby, the abrasion resistance of the image bearing member significantly deteriorates. Furthermore, when the resin is not sufficiently cured by the curing inhibition, the damage resistance of the image bearing member deteriorates. In this case, when the filer is easy to be detached from the resin due to the decreased retaining power of the filler, the detached filler further damages the surface of the image bearing member, which accelerates deterioration of abrasion resistance and damage resistance.

In addition, agglomerated fillers have an impact on the layer quality of the protection layer. That is, a roughened surface and protruded coating deficient portions are formed. These create problems of image deficiencies in a spot manner, bad cleaning performance, etc. Furthermore, since the filler quickly settles down in a liquid application when the dispersion property of the filler is bad, the content of the filler depends on the application time and thus the uniformity of the filler contained in the protection layer decreases. As a result, locally abraded portions and electrostatic deterioration occur and images having image deficiency in a spot manner and/or uneven image density are produced. Therefore, it is extremely preferable to improve the dispersion property of a filler to form a protection layer in which the filler is dispersed in a cured resin.

Furthermore, curing inhibition is not just caused by agglomeration of the filler. When a charge transport material contained in the photosensitive layer is dissolved in a solvent contained in a liquid application of the protection layer during formation of the protection layer on the photosensitive layer, the charge transport material elutes into the protection layer and the eluted charge transport material may causes curing inhibition. A small amount of the eluted charge transport material has only a slight and limited impact with regard to the curing inhibition and improves the charge infusion property at the interface between the charge transport layer and the protection layer, which may lead to a decrease in the voltage at irradiated portions and improvement on the sensitivity in some cases. In addition, the elution of the charge transport material to the protection layer improves the attachability of the protection layer and the photosensitive layer in some cases.

However, when an extremely large amount of the charge transport material elutes into the protection layer, curing is significantly inhibited, which results in significant deterioration of abrasion resistance and damage resistance. Furthermore, when a charge transport material having a small ionization potential is contained in a photosensitive layer, no problem is created if the elution amount of the charge transport material to the protection layer is small. However, an elution amount that is excessively large tends to cause image blur and reduction in resolution in an oxidizing gas atmosphere, which may lead to significant degradation in the image quality.

In addition, when a great amount of the charge transport material elutes into the protection layer, the charge transport material itself inhibits the curing reaction and in addition absorbs the ultraviolet when the protection layer is cured by irradiation of ultraviolet, which inhibits the curing reaction inside the protection layer. Increasing the amount of irradiation of ultraviolet, and/or using a polymerization initiator, etc. more than necessary to promote the curing reaction cause a significant rise of the residual voltage and significant deterioration of the photosensitivity in most cases. This leads to side effects such as wrinkle or cracking in the protection layer or peeling-off thereof because the attachment force to the photosensitivity decreases. Thus these are not suitable solutions. Therefore, adequately limiting the elution mount of the charge transport material is preferable.

As described above, in terms of formation of a protection layer in which a filler is dispersed in a cured resin, it is extremely preferable to improve the dispersion property of the filler and adequately limit the curing inhibition caused by the filler and the charge transport material in the photosensitive layer eluted into the protection layer. However, it is extremely difficult to have a good combination of these. This is because a preferable solvent for dispersion of the filler does not necessarily match a solvent that adequately limits the elution amount of the charge transport material in the photosensitive layer In addition, when a liquid application for the protection layer contains a large amount of a solvent in which the charge transport material is highly soluble, the elution amount of the charge transport material to the protection layer significantly increases. When a liquid application for the protection layer contains a large amount of a solvent in which the charge transport material is insoluble, the charge transport material hardly elutes into the protection layer, which may cause peeling off of the protection layer and precipitation of the charge transport material. On the other hand, the solubility of the charge transport material contained in the photosensitive layer to a solvent depends on the kind of the charge transport material. Therefore, the combination of the solvent contained in the liquid application for the protection layer and the charge transport material contained in the photosensitive layer is selected in terms that the filler is preferably dispersed and the elution amount of the charge transport material in the photosensitive layer is adequately maintained.

SUMMARY OF THE INVENTION

Because of these reasons, the present inventors recognize that a need exists for a method of manufacturing an image bearing member that increases the filler dispersion property in the liquid application for the protection layer, limits the settling down of the filler, reduces curing inhibition of the protection layer, and maintains a suitable elution amount of the charge transport material to the protection layer, an image bearing member that has excellent mechanical strength and electrostatic durability while free from image deficiency even during repetitive printing over an extended period of time and stably outputting quality images, and an image forming apparatus and process cartridge that use the image bearing member.

Accordingly, an object of the present invention is to provide a method of manufacturing an image bearing member that increases the filler dispersion property in the liquid application for the protection layer, limits the settling down of the filler, reduces curing inhibition of the protection layer, and maintains a suitable elution amount of the charge transport material to the protection layer, an image bearing member that has excellent mechanical strength and electrostatic durability while free from image deficiency even during repetitive printing over an extended period of time and stably outputting quality images, and an image forming apparatus and process cartridge that use the image bearing member.

Briefly this object and other objects of the present invention as hereinafter described will become more readily apparent and can be attained, either individually or in combination thereof, by a method of manufacturing an image bearing member including forming a charge generation layer overlying an electroconductive substrate, forming a charge transport layer overlying the charge generation layer, the charge transport layer including a charge transport material having a molecular weight of from 600 to 900 and a binder resin, and forming a protection layer overlying the charge transport layer by applying a liquid application containing a polymerizable compound having a charge transport structure, a polymerizable compound having no charge transport structure, a filler, a polycarboxylic acid compound, and cyclopentanone and curing the polymerizable compound having a charge transport structure, and the polymerizable compound having no charge transport structure.

It is preferable that the method of manufacturing an image bearing member mentioned above further includes preparing the liquid application by dispersing the filler and dissolving the polycarboxylic acid in an organic solvent comprising the cyclopentanone.

It is still further preferable that, in the method of manufacturing an image bearing member mentioned above, the polycarboxylic acid compound has an acid value of from 150 to 400 mgKOH/g.

It is still further preferable that, in the method of manufacturing an image bearing member mentioned above, the following relationship I is satisfied:

$$6 \leqq (A \times B/C) \leqq 40 \qquad \text{Relationship I}$$

where A represents a content of the polycarboxylic acid compound, B represents an acid value thereof, and C represents a content of the filler.

It is still further preferable that, in the method of manufacturing an image bearing member mentioned above, the charge transport material is a distyryl compound represented by the following chemical formula 1:

Chemical formula 1

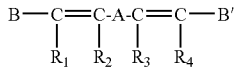

(1)

where $R_1$ to $R_4$ independently represent hydrogen atom, an alkyl group having 1 to 4 carbon atoms, an alkoxy group having 1 to 4 carbon atoms, or a substituted or non-substituted phenyl group, which may have an alkyl group having 1 to 4 carbon atoms, an alkoxy group having 1 to 4 carbon atoms as a substitution group, A represents a substituted or non-substituted arylene group, or a group represented by the following Chemical formula 1a:

Chemical formula 1a

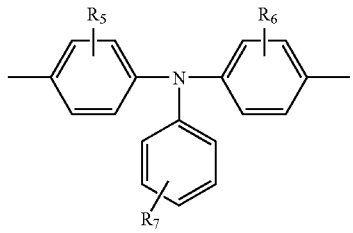

(1a)

where $R_5$, $R_6$, and $R_7$ independently represent hydrogen atom, an alkyl group having 1 to 4 carbon atoms, an alkoxy group having 1 to 4 carbon atoms, or substituted or non-substituted phenyl group, which may have an alkyl group having 1 to 4 carbon atoms, and an alkoxy group having 1 to 4 carbon atoms as a substitution group, B and B' independently represent a substituted or non-substituted aryl group, or a group represented by the following chemical formula 1b, Chemical formula 1b

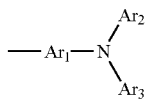

(1b)

where $Ar_1$ represents arylene group, which may have an alkyl group having 1 to 4 carbon atoms, and an alkoxy group having 1 to 4 carbon atoms as a substitution group, and $Ar_2$ and $Ar_3$ independently represent aryl group, which may have alkyl group having 1 to 4 carbon atoms, an alkoxy group having 1 to 4 carbon atoms as a substitution group.

It is still further preferable that, in the method of manufacturing an image bearing member mentioned above, the charge transport material is a distyryl compound represented by Chemical formula 2:

Chemical formula 2

(2)

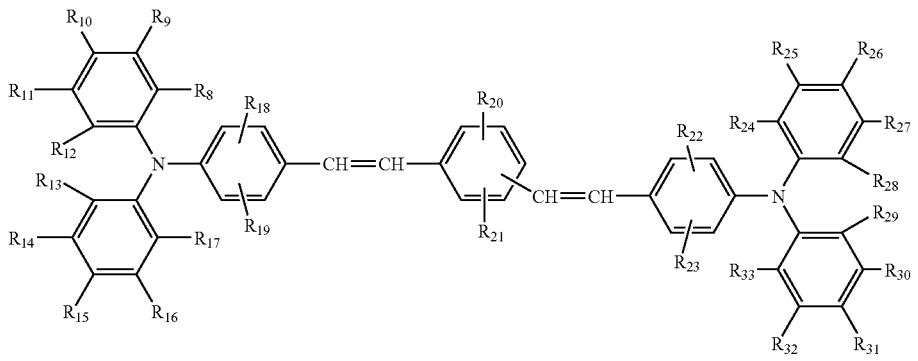

where $R_{11}$ to $R_{33}$ independently represent, hydrogen atom, an alkyl group having 1 to 4 carbon atoms, an alkoxy group having 1 to 4 carbon atoms, or a substituted or non-substituted phenyl group.

It is still further preferable that, in the method of manufacturing an image bearing member mentioned above, the charge transport material is a distyryl compound represented by Chemical formula 3:

Chemical formula 3

(3)

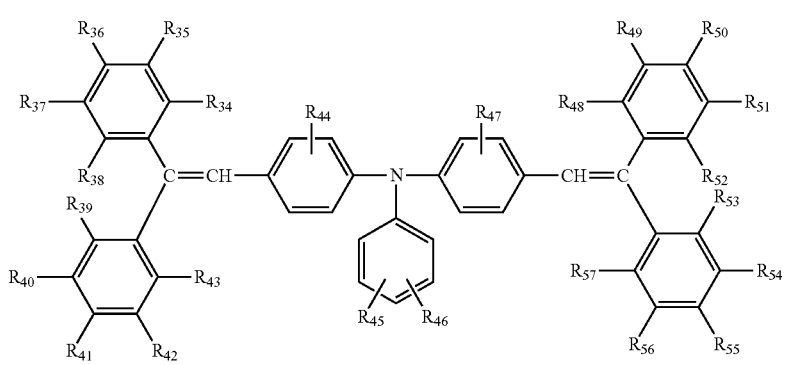

where $R_{34}$ to $R_{57}$ independently represent hydrogen atom, an alkyl group having 1 to 4 carbon atoms, an alkoxy group having 1 to 4 carbon atoms, or a substituted or non-substituted phenyl group.

It is still further preferable that, in the method of manufacturing an image bearing member mentioned above, the charge transport structure of the polymerizable compound having a charge transport structure is a triaryl amine structure.

It is still further preferable that, in the method of manufacturing an image bearing member mentioned above, the functional group of at least one of the polymerizable compound having a charge transport structure and the polymerizable compound having no charge transport structure is at least one of an acryloyloxy group and a methacryloyoxy group.

It is still further preferable that, in the method of manufacturing an image bearing member mentioned above, the ratio of a molecular weight to a number of a functional group of the polymerizable compound having no charge transport structure is 250 or less.

It is still further preferable that, in the method of manufacturing an image bearing member mentioned above, the number of functional groups in the polymerizable compound having no charge transport structure is at least 3 and the number of functional groups in the polymerizable compound having a charge transport structure is 1.

It is still further preferable that, in the method of manufacturing an image bearing member mentioned above, the filler is a metal oxide.

It is still further preferable that, in the method of manufacturing an image bearing member mentioned above, the filler has an average primary particle diameter of from 0.05 to 0.9 μm.

As another aspect of the present invention, an image bearing member is provided which includes an electroconductive substrate, a charge generation layer overlying the electroconductive substrate, a charge transport layer overlying the charge generation layer, and a protection layer overlying the charge transport layer, wherein the image bearing member is manufactured by the method of manufacturing an image bearing member mentioned above.

As another aspect of the present invention, an image forming apparatus is provided which includes the image bearing member mentioned above, a charging device that charges the image bearing member, an irradiation device that irradiates the image bearing member to form a latent electrostatic image thereon, a development device that develops the latent electrostatic image with toner to form a toner image, a transfer device that transfers the toner image to a recording medium to from a transferred image, a fixing device that fixes the transferred image on the recording medium, and a cleaning device that cleans the surface of the image bearing member.

It is preferred that the image forming apparatus further includes a lubricant material application mechanism that applies a lubricant material to the surface of the image bearing member.

As another aspect of the present invention, a process cartridge is provided which includes the image bearing member mentioned above, and at least one device selected from the group consisting of a charging device that charges the image bearing member, an irradiation device that irradiates the image bearing member to form a latent electrostatic image thereon, a development device that develops the latent electrostatic image with toner to form a toner image, a transfer device that transfers the toner image to a recording medium to form a transferred image, a cleaning device that cleans a surface of the image bearing member, and a discharging device, wherein the process cartridge is detachably attachable to an image forming apparatus.

These and other objects, features and advantages of the present invention will become apparent upon consideration of the following description of the preferred embodiments of the present invention (taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
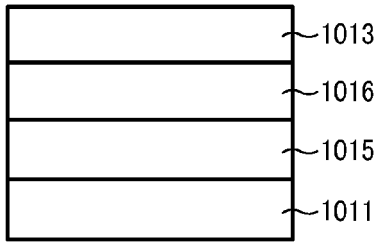
FIG. 1 is a schematic diagram illustrating an example of the layer structure of the image bearing member of the present invention.

In the present invention, the liquid application for forming a protection layer on the surface of an image bearing member contains a filler, a polycarboxylic acid compound, a polymerizable compound having a charge transport material, a polymerizable compound having no charge transport material, and cyclopentanone, and a charge transport material contained in the charge transport layer has a molecular weight of from 600 to 900, thereby improving the dispersion property of the filler, limiting the impact on curing reaction, and maintaining an adequate elution amount of the charge transfer material in the photosensitive layer to the protection layer. In addition to cyclopentanone in the liquid application, the dispersion property of the filler is further improved by a dispersion process of dispersing the filler, and the polycarboxylic acid in an organic solvent containing cyclopentanone.

That is, the addition of the polycarboxylic acid and cyclopentanone is considered to contribute to improvement on the dispersion of the filler. The filler and the organic material have poor affinity, which is considered to be one of the causes of degradation of the dispersion property of the filler. The polycarboxylic acid compound added during dispersion has a carboxylic group which has a good affinity with the filler and other hydrophobic groups which maintain good affinity with the solvent or organic material. Therefore, the surface of the filler tends to be wet by the solvent, which contributes to the improvement of the dispersion property. However, the improvement by the addition of the polycarboxylic acid depends on the kind of the solvent. In the present invention, the dispersion of the filler is significantly improved by addition of a polycarboxylic acid compound during dispersion and using a solvent containing cyclopentanone. In addition, cyclopentanone is suitable to improve the dispersion property of the filler, and maintain the good dispersion property thereof obtained by the addition of the polycarboxylic acid compound over an extended period of time. As a result, the settling down of the filler in the liquid application for the protection layer is limited and the good filler dispersion status is regained by light stirring even the filler has settled down. Therefor, the working life of the liquid application is significantly elongated. According to these, the filler is easily and evenly contained in the protection layer without agglomeration, which reduces the impact of uneven abrasion or inhibition on the curing inhibition. In addition, the dispersion property of the liquid dispersion is recovered by stirring again when the liquid dispersion is used after stationary preservation thereof.

In addition, a liquid application is circulated in manufacturing of an image bearing member in most cases so that the liquid application is under heavy load, which leads to a significant deterioration of the dispersion property of the filler. In the present invention, the working life of the liquid application is elongated by satisfying the following relationship even when the liquid application is circulated.

$$6 \leqq (A \times B/C) \leqq 40$$

where A represents the content of the polycarboxylic acid compound, B represents the acid value thereof, and C represents the content of the filler.

When the binder resin of the protection layer is a thermoplastic resin and the addition amount of the polycarboxylic acid is increased, side effects such as image blur due to $NO_x$ gas or ozone occurs. Thus, an anti-oxidizer is added or the content of the polycarboxylic acid is limited to prevent such side effects (refer to JP3802787). However, in the present invention in which a curable resin is used as the binder resin of the protection layer, no image blur caused by $NO_x$ and ozone gas occurs. Therefore, the amount of the polycarboxylic acid compound can be increased to stabilize the liquid application and elongate the working life thereof.

Furthermore, since cyclopentanone is contained in the liquid application of the protection layer and the charge transport material contained in the charge transport layer has a molecular weight of from 600 to 900, the elution amount of the charge transport material to the protection layer when the protection layer is coated on the photosensitive layer can be maintained at an adequate level. The adequate level represents that the charge infusion property at the interface between the protection layer and the photosensitive layer is improved and the attachability of the protection layer is improved with no adverse impact on curing inhibition or image blur. In addition to the boiling points of cyclopentanone (130.6° C.) and cyclohexanone (155.65° C.) being different from each other, these two are significantly different in the filler dispersion property, etc. when manufacturing an image bearing member. Furthermore, cyclopentanone hardly affects the layer quality, the internal curability of the protection layer, or the electrostatic characteristics even when a slight amount of cyclopentanone remains in the protection layer. Furthermore, a minute amount of cyclopentanone contained in the protection layer improves the attachability between the charge transport layer, thereby solving the problem of peeling-off of the protection layer always involved when the protection layer using a curable resin is formed as the surface of an image bearing member. As described above, the present invention simultaneously solves the problems of side effects stemming from the protection layer formed of a curable resin containing a filler and thus provides an image bearing member having an excellent mechanical strength and electrostatic durability. Since a protection layer that has an excellent dispersion property and stability of a filler and is extremely less affected by the problems of curing inhibition, peeling-off, etc. is formed, the abrasion resistance and the damage resistance of the surface is improved and detachment of the filler is limited, thereby improving the durability of an image bearing member. In addition, an image bearing member having an extremely fine concavo-convex surface formed by the filler suitably dispersed is manufactured. Resultantly, the occurrence of image deficiency ascribable to filming and bad cleaning performance is limited and this is stably maintained over repetitive use.

The present invention will be described below in detail with reference to several embodiments and accompanying drawings.

Next, the image bearing member and the method of manufacturing the image bearing member are described with reference to the drawings.

Layer Structure of Image Bearing Member

Figure 2:
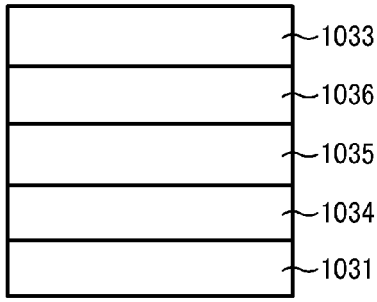
FIG. 2 is a schematic diagram illustrating another example of the layer structure of the image bearing member of the present invention.

The layer structure of the image bearing member of the present invention is formed of multiple layers of at least a charge generation layer, a charge transport layer and a protection layer. Specific examples of the layer structures are as follows. FIG. 1 illustrates an image bearing member having a laminate structure in which a charge generation layer 1015, a charge transport layer 1016, and a protection layer 1013 are accumulated in an electroconductive substrate 1011 in this order. In addition, as illustrated in FIG. 2, an undercoating layer 1034 can be provided between a charge generation layer 1035 and an electroconductive substrate 1031. A reference numeral 1033 and 1036 represent a protection layer and a charge transport layer, respectively. In addition, the undercoating layer may have a two layer structure. These layer structures are for the illustration purpose only and the present invention is not limited thereto.

Electroconductive Substrate

The electroconductive substrate can be formed by using material having a volume resistance of not greater than $10^{10}$ Ω·cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable. In addition, an endless nickel belt and an endless stainless belt described in JOP S52-36016 can be used as the electroconductive substrate.

Furthermore, the electroconductive substrate can be formed by dispersing electroconductive powder in a binder resin on the above-mentioned electroconductive substrate to form an electroconductive layer (formed by coating, etc.). Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resins which are used together with the electroconductive powder include, but are not limited to, thermoplastic resins, thermosetting resins, and optical curable resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin.

Such an electroconductive layer can be formed by dispersing such electroconductive powder and the binder resin in a solvent, for example, tetrahydrofuran (THF), dichloromethane (MDC), methyl ethyl ketone (MEK), and toluene and applying the resultant to an electroconductive substrate. In addition, an electroconductive substrate in which an electroconductive layer is formed on a cylindrical substrate by using a heat contraction tube can be used as the electroconductive substrate of the present invention. The heat contraction tube is formed of material containing electroconductive powder. Specific examples the material include, but are not limited to, polyvinyl chloride, polypropylene, polyester, polystyrene, polyvinylidene chloride, polyethylene, chloride rubber, and polytetrafluoroethylene based fluorine resin.

Among these, a cylindrical substrate formed of aluminum which can be easily subject to anodization treatment. is suitably used. The aluminum represents solid aluminum and alloy thereof. To be specific, aluminum of JIS 1,000 to 1,999, 3,000 to 3,999, and 6,000 to 6,999 or alloy thereof are most suitable. Anodized layer (film) is obtained by anodization treatment of metal, or alloy thereof in an electrolyte solution. Among these, a film referred to as alumite obtained by anodization of aluminum or alloy thereof hardly causes a rise in a residual voltage, and is effective to prevent background fouling occurring when reverse development is used.

The anodization treatment is conducted in an acid bathing using such as chromic acid, sulfuric acid, oxalic acid, phosphoric acid, acidum boricum, and sulfamic acid. Among these, sulfuric acid bathing is most suitable. A specific example thereof is conducted in the following conditions:

Density of sulfuric acid: 10 to 20%
Temperature of bathing: 5 to 25
Current density: 1 to 4 A/dm$^2$
Electrolyzation voltage: 5 to 30 V
Treatment time: about 5 to about 60 minutes The thus prepared anodization film is porous and has high insulation property so that the surface is extremely in unstable condition. Therefore, the anodization film changes over time and the physical values thereof are liable to change. To avoid this, the anodization film is preferably subject to sealing treatment. The sealing treatment includes a method of dipping the anodization film in an aqueous solution containing nickel fluoride and nickel acetate, a method of dipping the anodization film in boiled water, a method of using steam under pressure, etc. Among these, the method of dipping the anodization film in an aqueous solution containing nickel acetate is most preferable. Subsequent to the sealing treatment, the anodization film is subject to washing treatment. This is to remove metal salts extra attached by the sealing treatment. Metal salts that excessively remains on the surface of the electroconductive substrate (anodization film) have an adverse impact on the quality of film (layer) formed on the anodization film and in addition, cause the background fouling since a low resistance component generally remains. This washing treatment may be conducted only once but generally conducted at multiple steps. The washing liquid obtained after the final washing treatment is preferably as clean (deionized) as possible. In addition, the washing processes in the multi-steps preferably include a process of physical rubbing washing with a contact member. The thickness of the thus formed anodization film is preferably from about 5 to about 15 μm. A film that is excessively thin tends to have insufficient barrier effect as the anodization film and by contrast, a film that is excessively thick tends to have an excessively high time constant as the electrode, which may cause occurrence of residual voltage and deterioration of the response of the image bearing member.

Charge Generation Layer

The charge generation layer is a layer mainly formed of a charge generation material. Any known charge generation material can be used for the charge generation layer. Specific examples thereof include, but are not limited to, azo pigments such as monoazo pigments, disazo pigments, asymmetry disazo pigments, trisazo pigments, azo pigments having a carbazole skeleton (refer to JOP S53-95033), azo pigments having a distyryl benzene skeleton (refer to JOP S53-133445), azo pigments having a triphenylamine skeleton (refer to JOP S53-132347), azo pigments having a diphenylamine skeleton, azo pigments having a dibenzothiophene skeleton (refer to JOP S54-21728), azo pigments having a fluorenone skeleton (refer to JOP S54-22834), azo pigments having an oxadiazole skeleton (refer to JOP S54-12742), azo pigments having a bis-stilbene skeleton (refer to JOP S54-17733), azo pigments having a distilyloxadiazole skeleton (refer to JOP S54-2129), azo pigments having a distylylcarbazole skeleton (refer to JOP S5-14967); azulenium salt pigments; squaric acid methine pigments; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bisbenzimidazole pigments, and phthalocyanine based pigments such as metal phthalocyanine represented by the following chemical formula 4, and metal free phthalocyanine.

Chemical formula 4

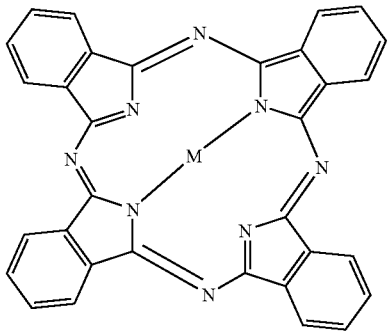

M (center metal) of the chemical formula 4 represents a metal element or non-metal (hydrogen atom). Specific example of M (center metal) include, but are not limited to, H, Li, Be, Na, Mg, Al, Si, K, Ca, Sc. Ti, V. Cr, Mn, Fe, Co, Ni, Cu, Zn, ga, Ge, Y, Zr, Nb, Mo, Tc, Ru, Rh, Pd, Ag, Cd, In, Sn, Sb, Ba, Hf, ta, W, Re, Os, Ir, Pt, Au, Hg, TI, La, Ce, Pr, Nd, Pm, Sm, Eu, Gd, Tb, Dy, Ho, Er, Tm, Yb, Lu, Th, Pa, U, Np, and Am or two or elements of oxides thereof, fluorides thereof, hydroxides thereof, and bromide thereof.

The charge generation material having a phthalocyanine skeleton in the present invention has at least a basic skeleton structure of the general chemical formula (11) and includes a dimer or higher structure, and even a polymer structure. In addition, the charge generation material also includes the basic skeleton with various kinds of substitution groups. Among these phthalocyanines, titanyl phthalocyanine including TiO as the center metal, metal-free phthalocyanine, chrologallium phthalocyanine, hydroxygallium phthalocyanine are particularly preferable in terms of the characteristics of an image bearing member. In addition, these phthalocyanines are known to have various kinds of crystal types, For example, titanylphthalocyanine has α, β, γ, m, Y, etc., and copper phthalocyanine has α, β, γ, etc. The characteristics of the phthalocyanines having the same center metal vary depending on the crystal type. The characteristics of the image bearing member using the phthalocyanine pigments having various kinds of crystal types are reported to change accordingly (refer to Denshi Shashin Gakkaishi. Vol. 29, issue 4 published in 1990). For this reason, the selection of the phthalocyanine crystal type is extremely important in terms of the characteristics of an image bearing member.

Among these phthalocyanine pigments, the titanyl phtalocyanine crystal having an X-ray (Cu-Kα: wavelength of 1.542 Å) diffraction spectrum such that the main peak is observed at a Bragg (2θ) angle of 27.2±0.2° has particularly high sensitivity and is suitably used in the present invention in terms of high speed image formation. Furthermore, among these, the phthalocyanine crystal having an X-ray (Cu-Kα: wavelength of 1.542 Å) diffraction spectrum such that the main peak is observed at a Bragg (2θ) angle of 27.2±0.2°, the minimum peak on the lowest angle is observed at 7.3° with no peaks between 7.3° and 9.4° and no peak at 26.3° is efficiently used as the charge generation material for use in the present invention because it has a great charge generation ratio and excellent electrostatic characteristics and hardly causes background fouling, etc.

These charge generation materials may be used alone or in combination.

The charge generation material mentioned above contained in the image bearing member of the present invention is more suitable when the particle size of the charge generation material is reduced in some cases. Particularly with regard to the phthalocyanine pigments, the average particle size is preferably 0.25 μm or less and more preferably 0.2 μm or less. The method of manufacturing the charge generation material is described below. The particle size of the charge generation material contained in the charge generation layer is controlled by a method of dispersing the charge generation material followed by removing coarse particles having a particle size larger than 0.25 μm. The average particle size represents the volume average particle diameter and is obtained by an ultra-centrifugal particle size distribution analyzer (CAPA-700, manufactured by Horiba, Ltd.) Median diameter, which corresponds to 50% of the cumulative distribution, is calculated as the volume average particle diameter. However, this method involves a problem that a minute quantity of coarse particles are not detected in some cases. Thus, to be more exact, it is preferable to obtain the size by directly observing the charge generation material powder, or liquid dispersion with an electron microscope.

Next, the method of removing coarse particles after dispersion of the charge generation material is described. That is, in the method, a liquid dispersion in which particles are caused to be as fine as possible is filtered with a suitable filter. The liquid dispersion is manufactured by a typical method in which a charge generation material and an optional binder resin are dispersed in a suitable solvent using a ball mill, an attritor, a sand mill, a bead mill, or ultrasonic. The binder resin is selected based on the electrostatic characteristics of an image bearing member and the solvent is selected based on the wettability to a pigment and the dispersion property thereof.

This method is effective in that the coarse particles remaining in a minute quantity which is not detected by naked eyes (or particle size measurement) is removed and consequently the obtained particle size distribution is sharp. To be specific, the liquid dispersion prepared as described above is filtered by a filter having an effective pore diameter of 5 μm or less, and preferably 3 μm or less. According to this method, a liquid dispersion containing only a charge generation material having a small particle size (0.25 μm or less and preferably 0.2 μm or less) is prepared, thereby improving the electrostatic characteristics such as sensitivity and chargeability of an image bearing member and sustaining the effect.

When the particle size of the liquid dispersion to be filtered is too large, or the particle size distribution thereof is too wide, the loss by the filtration tends to be great, which leads to clogging, thereby making filtration impossible. Therefore, the liquid dispersion is preferably dispersed before filtration until the average particle size of 0.3 μm or less with a standard deviation of 0.2 μm or less is obtained. When the average particle size is too large, the loss by the filtration tends to be great. When the standard deviation is too large, the filtration time tends to be extremely long.

The charge generation material mentioned above has an extremely strong intermolecular hydrogen binding force, which is characteristic to a charge generation material having a high sensitivity. Therefore, the particles of the dispersed pigment particles have an extremely strong mutual action therebetween. As a result, the charge generation material particles dispersed by a dispersion device are likely to re-agglomerate by dilution, etc. However, as described above, such agglomerated substance can be removed after the dispersion with a filter having a specific size or less. At this point, since the liquid dispersion is in thixotropic, particles having a size smaller than the effective pore diameter of a filter are also removed. Alternatively, the liquid having a structure viscosity is filtered to have a state close to Newtonian. Thus, the effect of the present invention is improved by removing coarse particles of the charge generation material as described above.

In addition, among the azo pigments, the azo pigments represented by the chemical formula 5 are preferably used. Particularly, asymmetry disazo pigment which has $Cp_1$ different from $Cp_2$ has an excellent carrier generation efficiency, which is effective in terms of high speed performance, and is preferably used as the charge generation material for use in the present invention.

Chemical formula 5

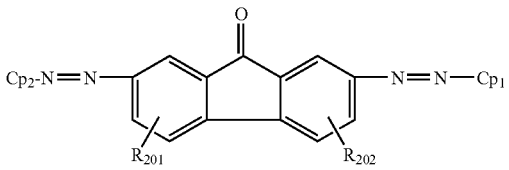

In Chemical formula 5, $Cp_1$ and $Cp_2$ represent coupler remaining groups. $R_{201}$ and $R_{202}$ independently represent hydrogen atom, a halogen atom, an alkyl group, an alkoxy group, and cyano group. $Cp_1$ and $Cp_2$ are represented by the following Chemical formula 10a and the asymmetry disazo pigment can be obtained by making the structure thereof different from each other.

Chemical formula 5a

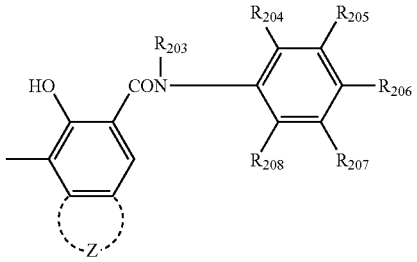

In Chemical formula 5a, $R_{203}$ represents hydrogen atom, an alkyl group such as methyl group and ethyl group, and an aryl group such as phenyl group. $R_{204}$, $R_{205}$, $R_{206}$, $R_{207}$, and $R_{208}$ independently represent. Hydrogen atom, nitro group, cyano group, a halogen atom such as fluorine, chlorine, bromine and iodine, halogenized alkyl group such as trifluoromethyl group, an alkyl group such as methyl group and ethyl group, an alkoxy group such as methoxy group, and ethoxy group, dialkyl amino group, and hydroxyl group. Z represents an atom group required to form a substituted or non-substituted aromatic hydrocarbon group, or a substituted or non-substituted heterocyclic aromatic hydrocarbon group. These charge generation materials can be used alone or in combination.

Specific examples of the binder resin optionally used in the charge generation layer include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, polyacrylamides, polyvinyl benzale, polyester, phenoxy resin, copolymer of vinylchloride and vinyl acetate, polyvinyl acetate, polyphenylene oxide, polyvinylpyridine, cellulose based resin, casein, polyvinyl alcohol, and polyvinyl pyrolidone. Among these, polyvinyl butyral is preferably used. These binder resins can be used alone or as a mixture of two or more.

Specific examples of the solvents include, but are not limited to, known organic solvents such as isopropanol, acetone, methylethylketone, cyclohexanone, tetrahydrofuran, dioxane, ethylcellosolve, ethyl acetate, methylacetate, dichloromethane, dichloroethane, monochlorobenzene, cyclohexane, toluene, xylene, and ligroin. Among these, ketone based solvents, ester based solvents, and ether based solvents are preferably used. These can be used alone or as a mixture of two or more.

Liquid application of the charge generation layer is prepared by dispersing a charge generation material with an optional binder resin in a solvent with a known dispersion method such as a ball mill, an attritor, a sand mill, a bead mill, or ultrasonic, The optional binder resin can be added before or after dispersion of the charge generation material. The liquid application of the charge generation layer is mainly formed of a charge generation material, a solvent, and a binder resin and may also contain additives such as a sensitizer, a dispersion agent, a surface active agent, and silicone oil. A charge transport material, which is described later, can be added to the charge generation layer. The addition amount of the binder resin is from 0 to 500 parts by weight and preferably from 10 to 300 parts by weight based on 100 parts by weight of the charge generation material.

The charge generation layer is formed by applying the liquid application mentioned above to an electroconductive substrate, an undercoating layer, etc. followed by drying. Known methods such as a dip coating method, a spray coating method, a bead coating method, a nozzle coating method, a spinner coating method, and a ring coating method can be used as the application method. The charge generation layer has a thickness of from about 0.01 to bout 5 μm and more preferably from 0.1 to 2 μm. The liquid application is heated and dried in an oven, etc. after application. The drying temperature of the charge generation layer is preferably from 50 to 160° C., and more preferably from 80 to 140° C.

Charge Transport Layer

The charge transport layer is mainly formed of a charge generation material and a binder resin. The charge transport material is typified into a positive hole transport material and an electron transport material. The charge transport material bears a function of transporting charges. When a protection layer is formed on the charge transport layer, the charge transport material contained in the charge transport layer may elute into the protection layer, and cause curing inhibition of the protection layer depending on the amount of elution. In the present invention, a charge transport material having a molecular weight of from 600 to 900 is used, thereby keeping a suitable amount of elution thereof to the protection layer. Thus, excessive curing inhibition is prevented, the charge infusion property to the protection layer is improved and the attachment force of the protection layer is improved at the same time.

As the charge transport materials, specific examples of the electron transport materials include, but are not limited to, electron acceptance material having a molecular weight of from 600 to 900, such as 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and naphthalene tetracarbonic acid diimide, and aromatic rings having cyano group or nitro group.

Specific examples of the positive hole transport materials include, but are not limited to, poly(N-vinylvarbazole) and derivatives thereof, poly(γ-carbzoyl ethylglutamate) and derivatives thereof, pyrenne-formaldehyde condensation products and derivatives thereof, polyvinylpyrene, polyvinyl phnanthrene, polysilane, oxazole derivatives, oxadiazole derivatives, imidazole derivatives, monoaryl amine derivatives, diaryl amine derivatives, triaryl amine derivatives, stilbene derivatives, α-phenyl stilbene derivatives, aminobiphenyl derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, disstilbene derivatives, enamine derivatives and charge transport materials having a molecular weight of from 600 to 900.

These charge transport materials may be used alone or in combination.

In addition, since the elution property of the charge transport material to the protection layer depends on the structure thereof, particular charge transport materials are preferable.

In the present invention, among these charge transport materials, compounds having a distyryl structure is preferable and the distyryl compound represented by the chemical formula 1 is particularly preferable.

Chemical formula 1

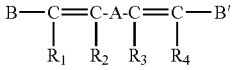

$R_1$ to $R_4$ independently represent hydrogen atom, an alkyl group having 1 to 4 carbon atoms, an alkoxy group having 1 to 4 carbon atoms, or a substituted or non-substituted phenyl group. The phenyl group can take an alkyl group having 1 to 4 carbon atoms, and an alkoxy group having 1 to 4 carbon atoms as a substitution group.

"A" represents a substituted or a non-substituted arylene group, or a group represented by Chemical formula 1a.

"B" and "B'" independently represent a substituted or a non-substituted arylene group, or a group represented by Chemical formula 1b.

Chemical formula 1a (1a)

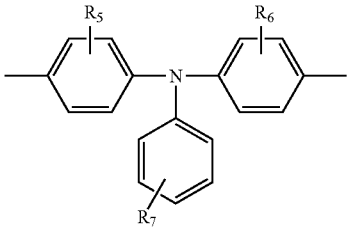

$R_5$, $R_6$, and $R_7$ independently represent hydrogen atom, an alkyl group having 1 to 4 carbon atoms, an alkoxy group having 1 to 4 carbon atoms, or a substituted or non-substituted phenyl group. The phenyl group can take an alkyl group having 1 to 4 carbon atoms, and an alkoxy group having 1 to 4 carbon atoms as a substitution group.

Chemical formula 1b (1b)

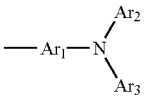

In the Chemical formula 1b, $Ar_1$ represents an arylene group, which may take an alkyl group having 1 to 4 carbon atoms, and an alkoxy group having 1 to 4 carbon atoms as a substitution group. In addition, $Ar_2$ and $Ar_3$ independently represent an aryl group, which may take an alkyl group having 1 to 4 carbon atoms, and an alkoxy group having 1 to 4 carbon atoms as a substitution group.

Among these compounds, the distyryl compound represented by the following Chemical formula 2 is particularly preferable in the present invention.

Chemical formula 2

(2)

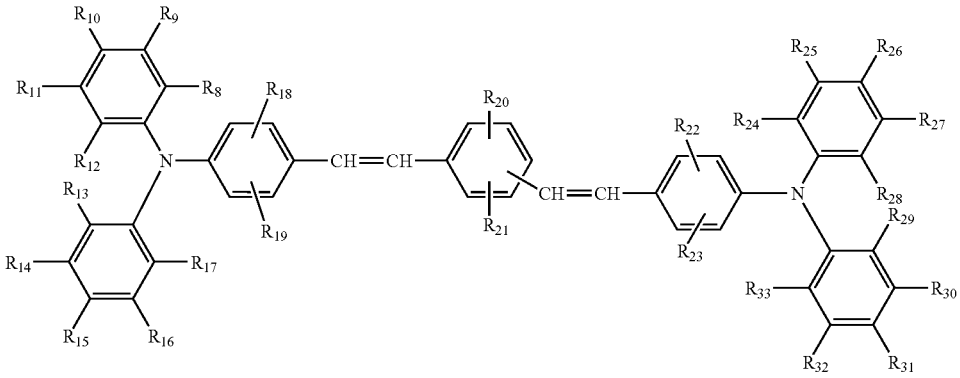

In the Chemical formula 2, $R_8$ to $R_{33}$ independently represent hydrogen atom, an alkyl group having 1 to 4 carbon atoms, an alkoxy group having 1 to 4 carbon atoms, or a substituted or non-substituted phenyl group.

In addition, the charge transport material illustrated by the following chemical formula 3 is preferable in the present invention.

Chemical formula 3

(3)

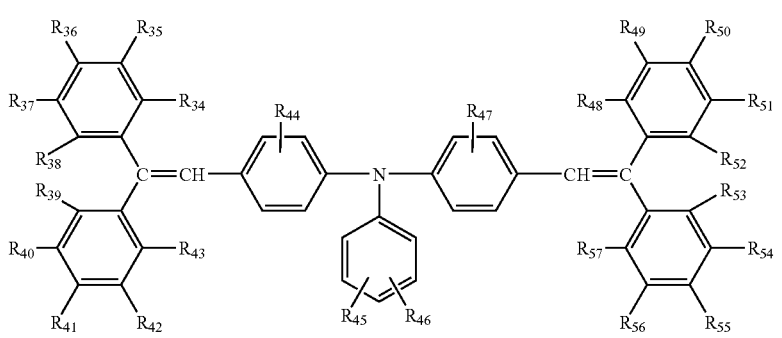

In the chemical formula 3, $R_{34}$ to $R_{57}$ independently represent hydrogen atom, an alkyl group having 1 to 4 carbon atoms, an alkoxy group having 1 to 4 carbon atoms, or a substituted or non-substituted phenyl group.

These charge transport materials have a molecular structure having a relatively large molecular weight of as much as 600 or higher, and is characterized in that pi-conjugated systems spread in the entire molecule. Therefore, the mobility and charge transport property are excellent and an excessive elusion of the charge transport material is prevented. Thus, these charge transport materials are preferable materials in the present invention.

Specific examples of these compounds used as the charge transport materials in the present invention include, but are not limited to, the following chemical structures.

CTM1
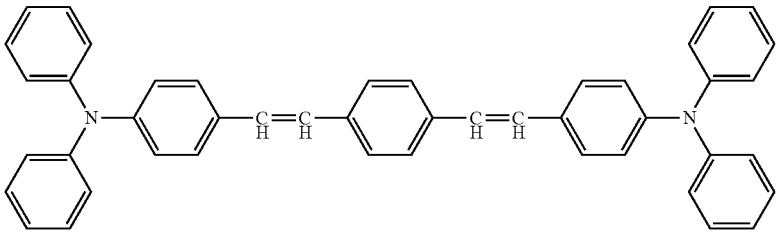
CTM2
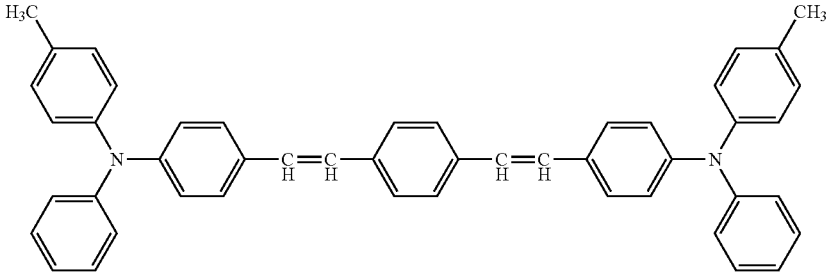
CTM3
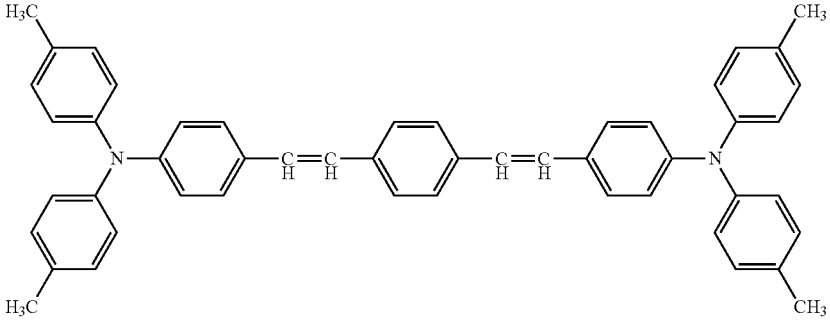
CTM4
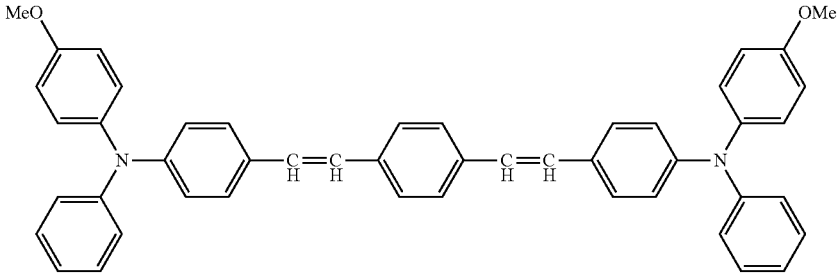
CTM5
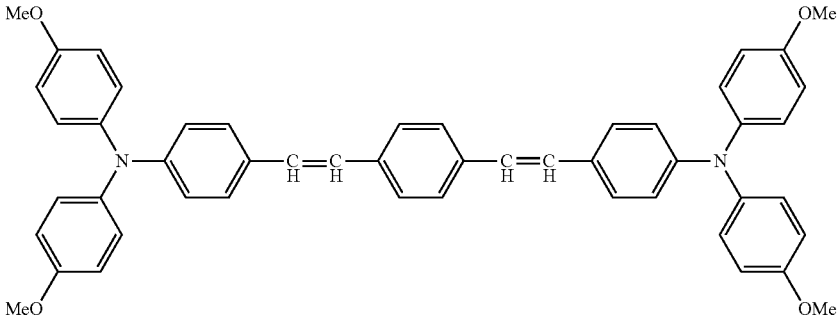

-continued
CTM4
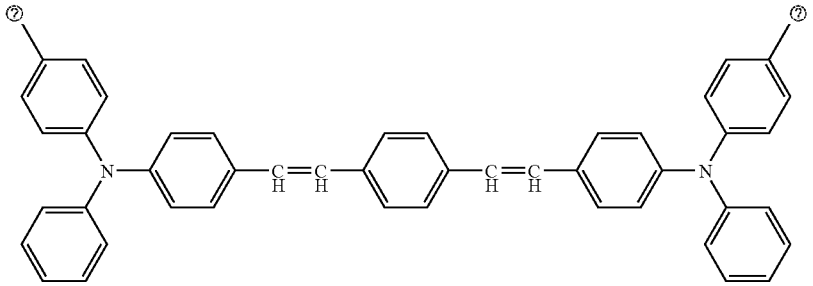
CTM6
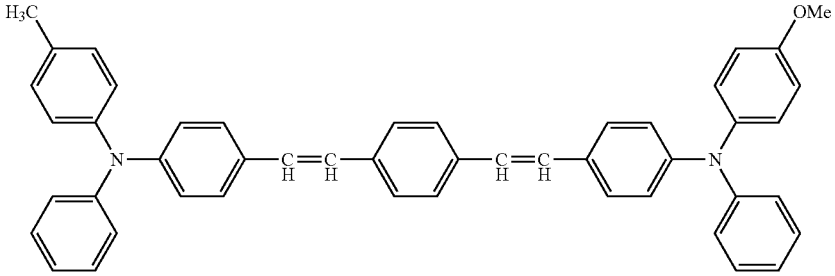
CTM7
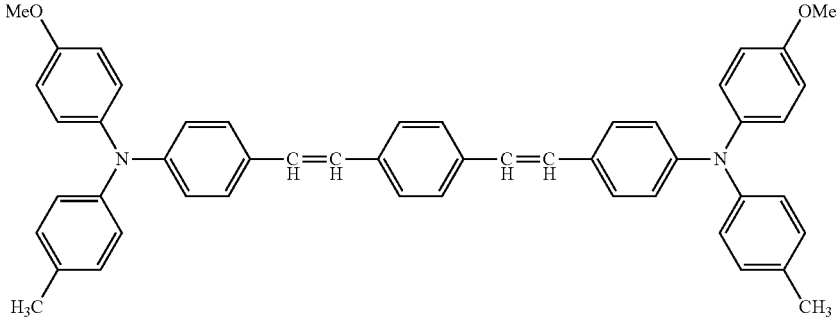
CTM8
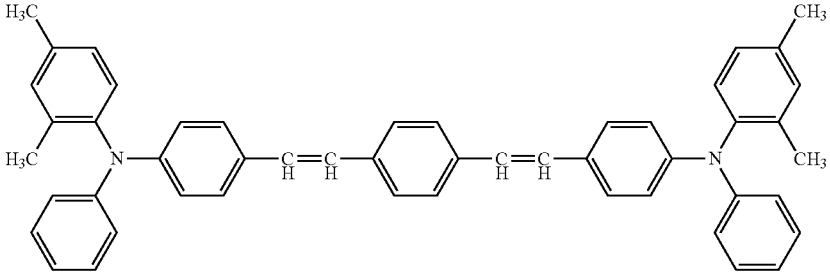
CTM9
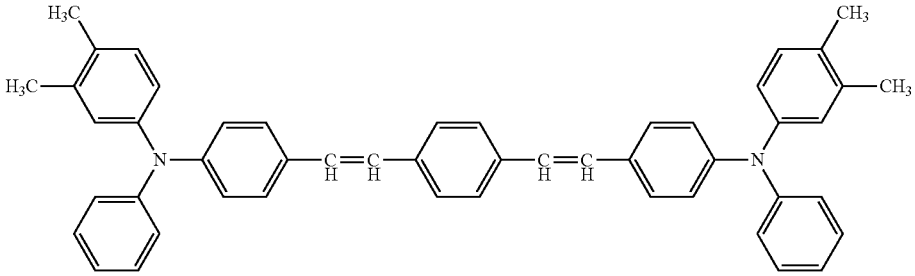

-continued
CTM8
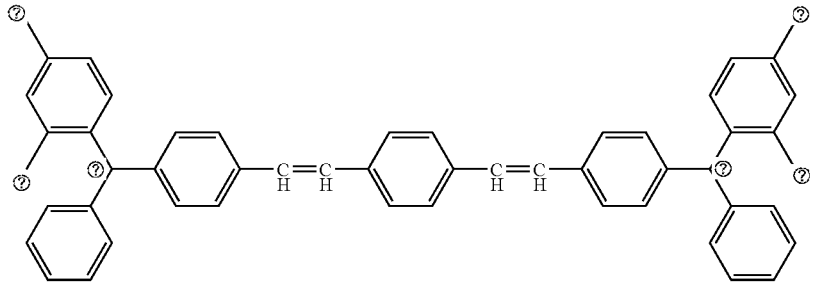
CTM10
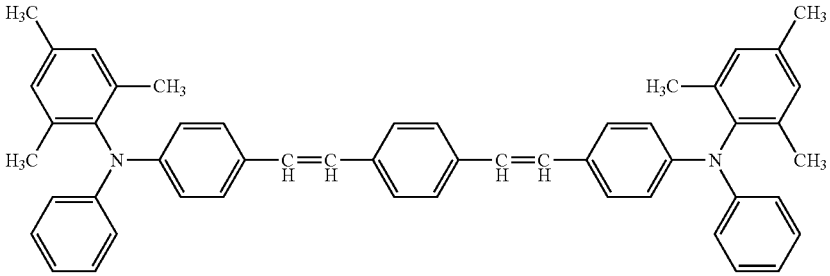
CTM11
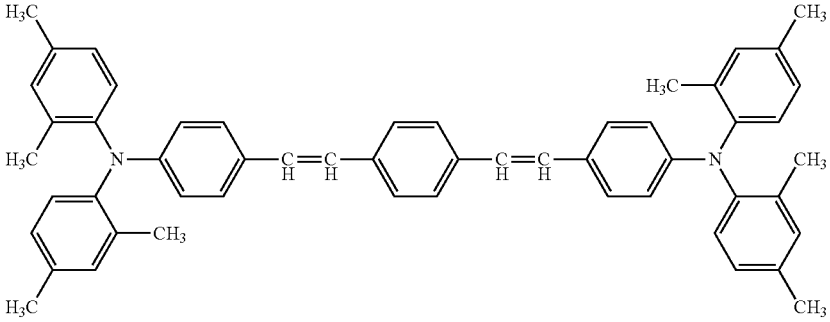
CTM12
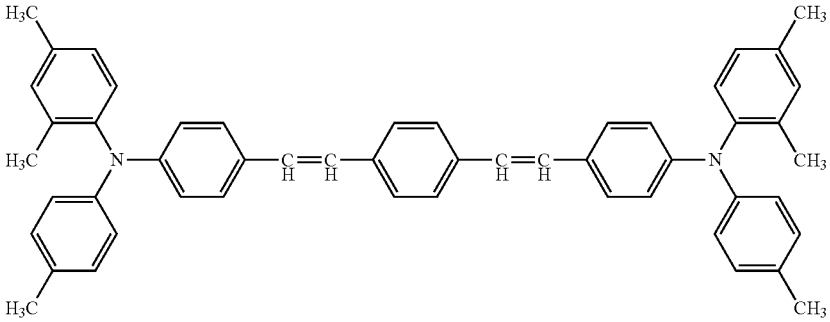
CTM13
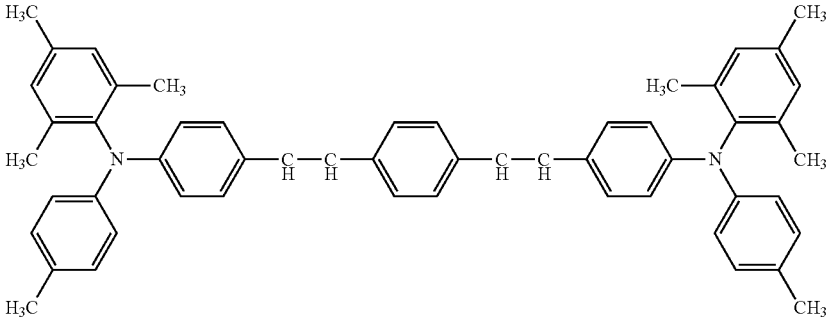

-continued
CTM14
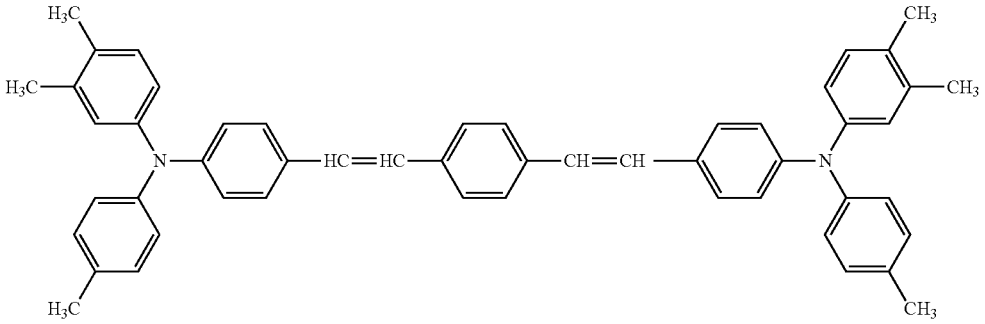
CTM15
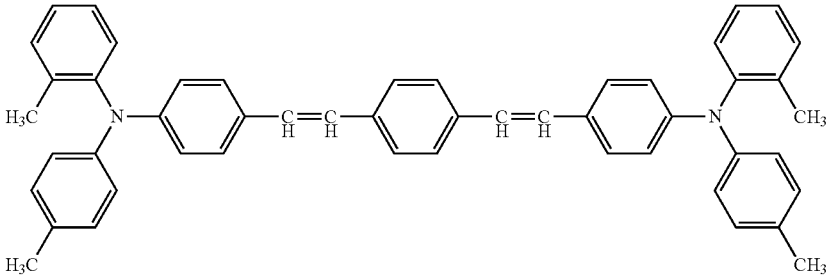
CTM16
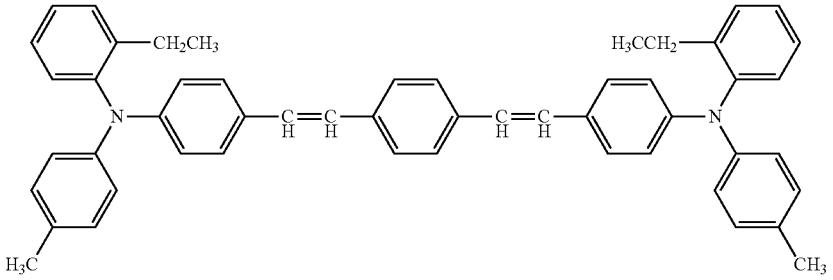
CTM17
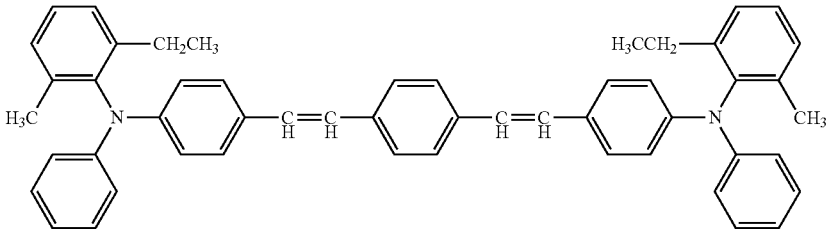
CTM18
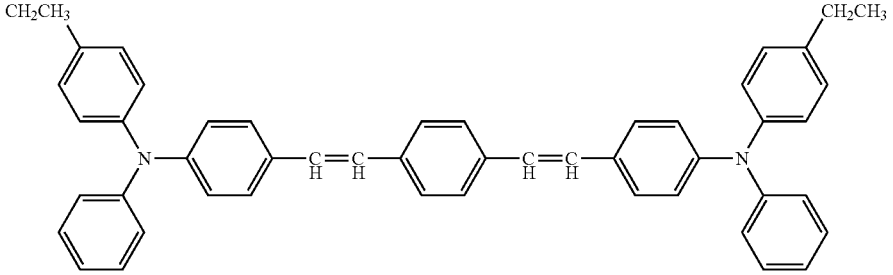

-continued
CTM19
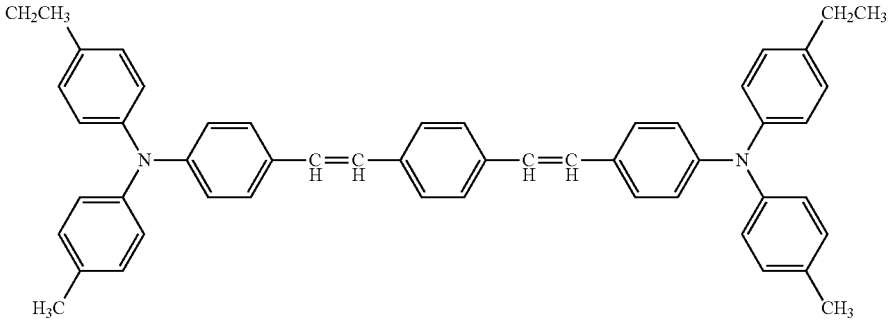
CTM20
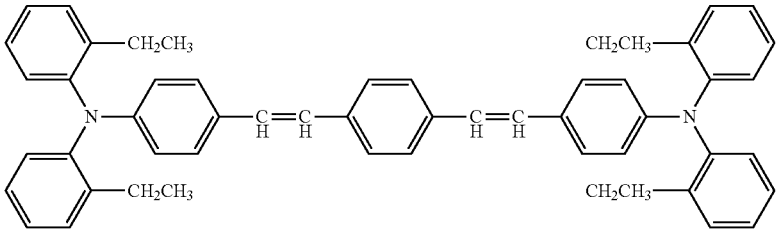
CTM21
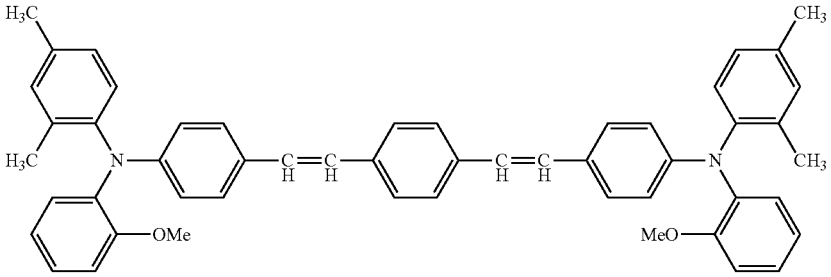
CTM22
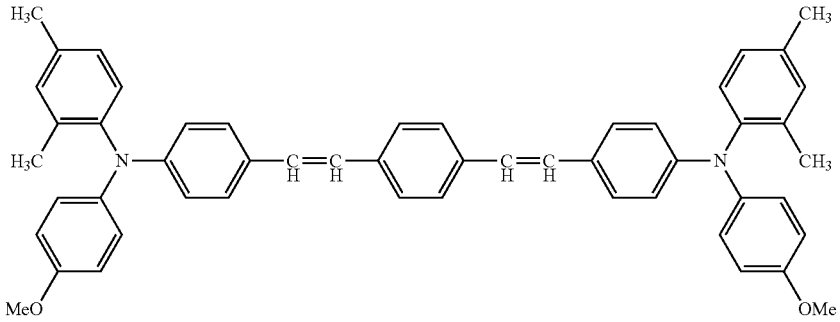
CTM23
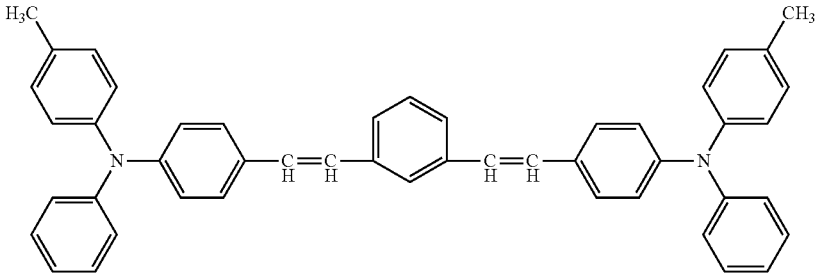

-continued
CTM24
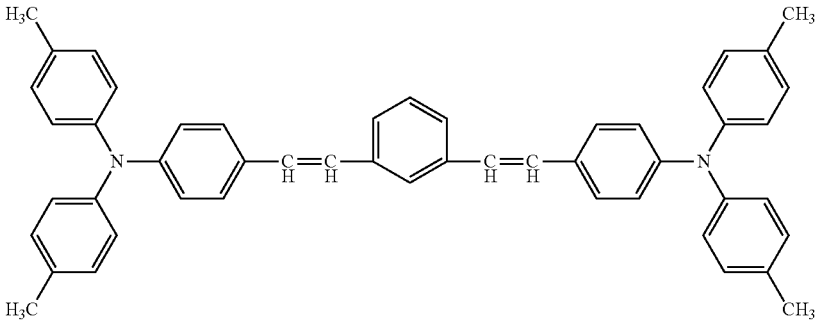
CTM25
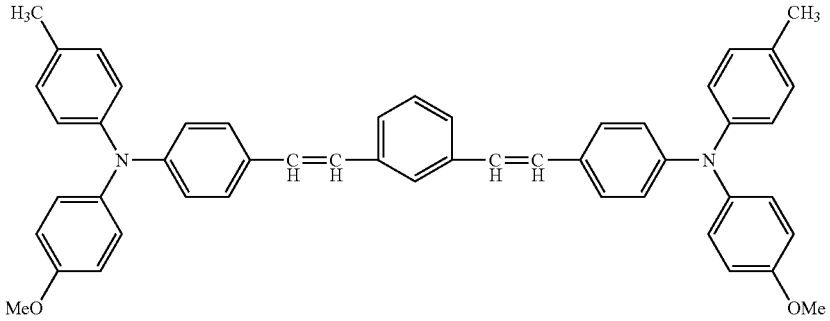
CTM26
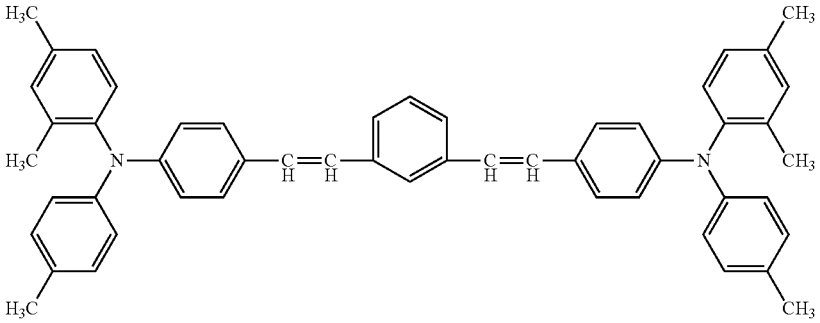
CTM27
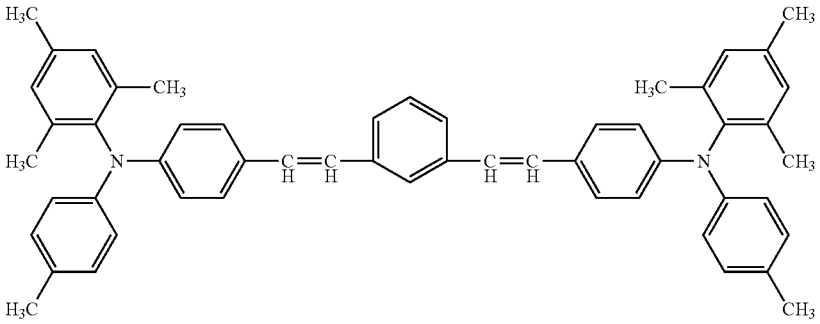
CTM28
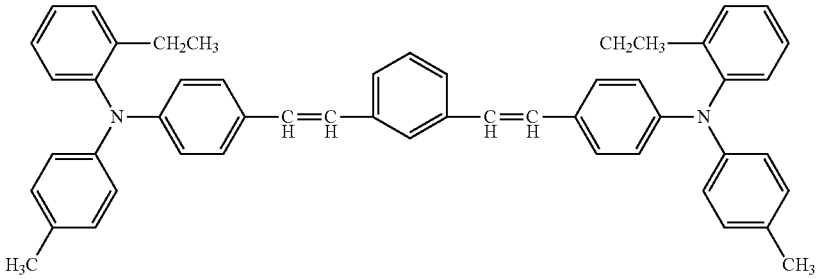

-continued
CTM29
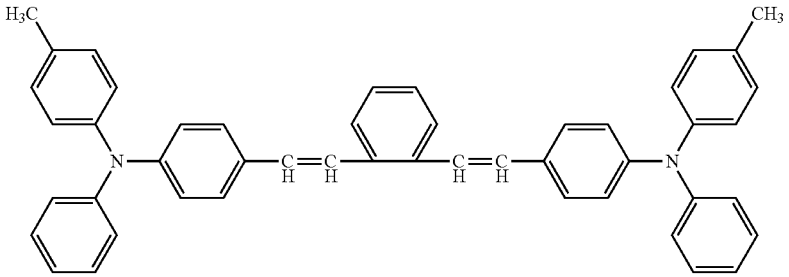
CTM30
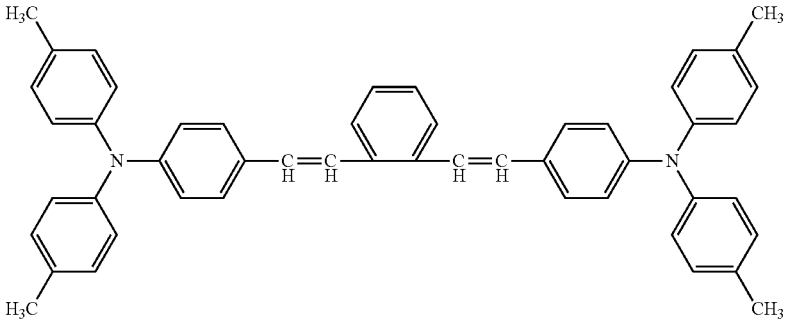
CTM31
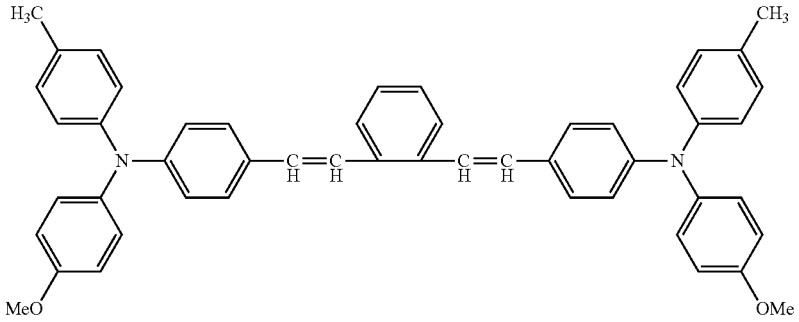
CTM32
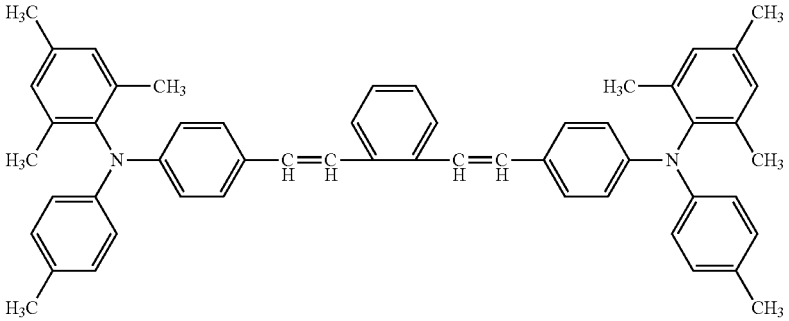
CTM33
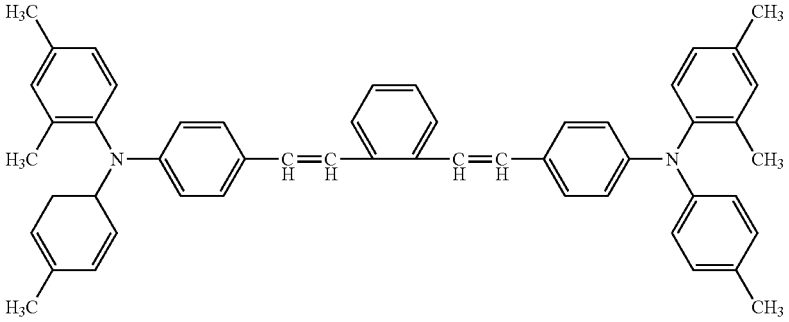

-continued
CTM34
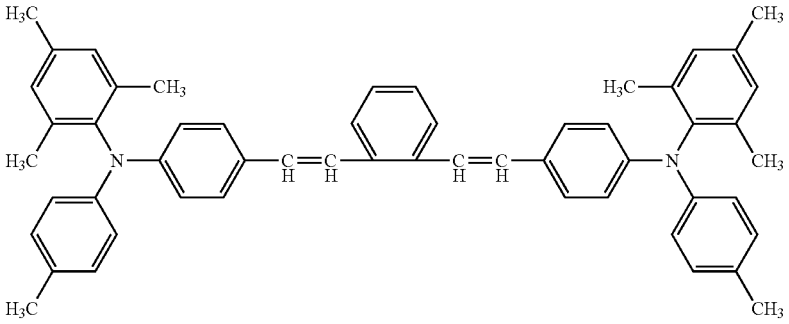
CTM35
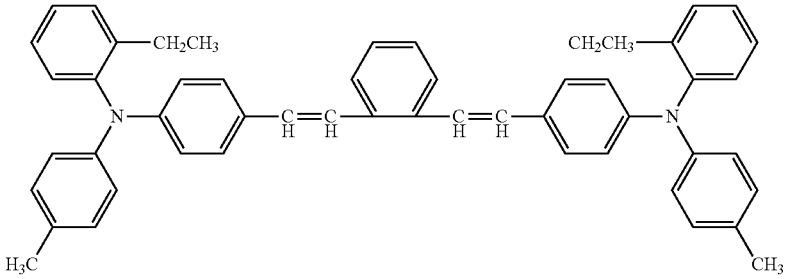
CTM36
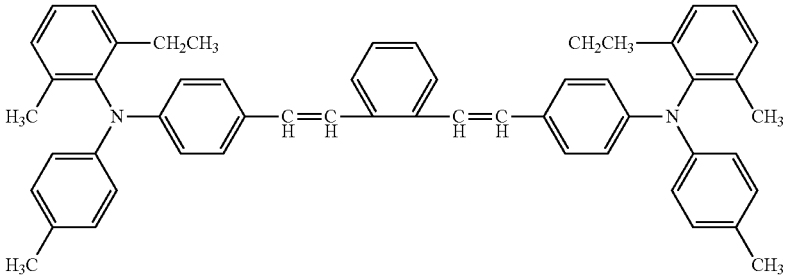
CTM37
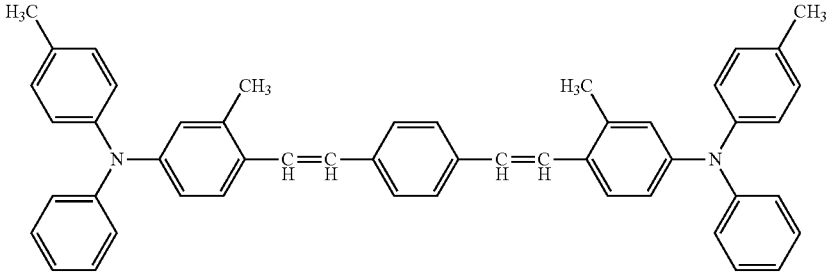
CTM38
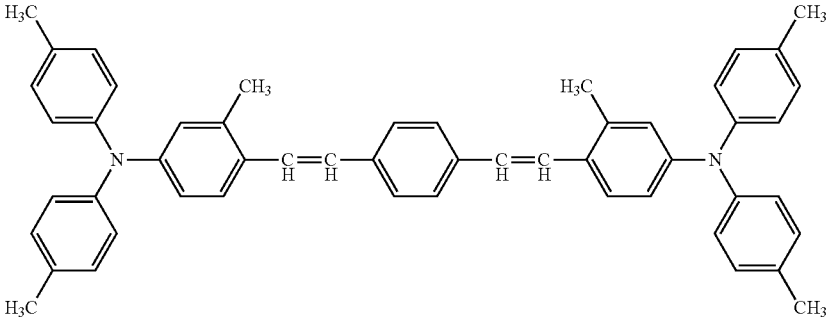

-continued
CTM39
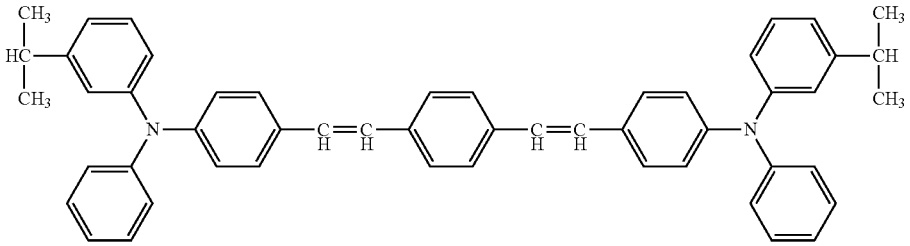
CTM40
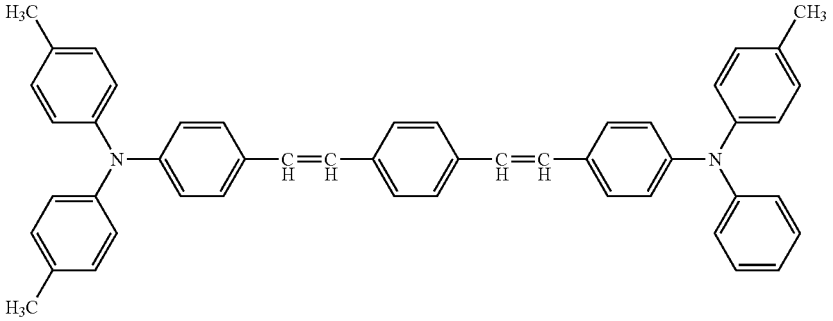
CTM41
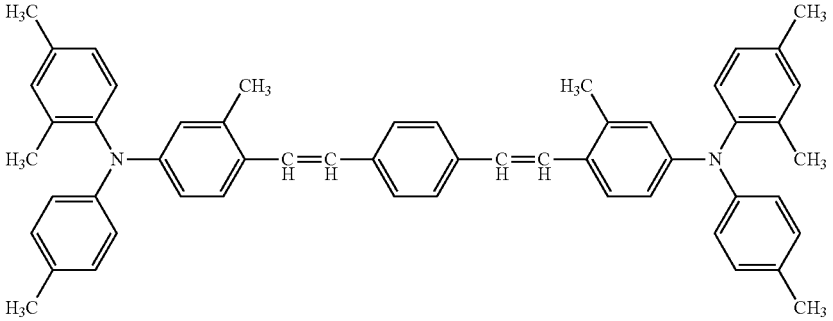
CTM40
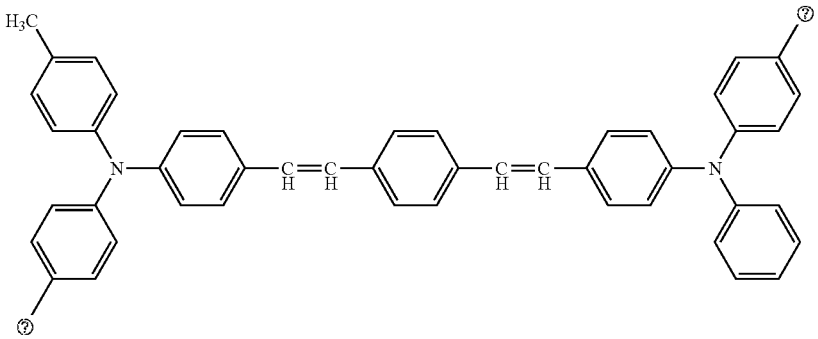
CTM42
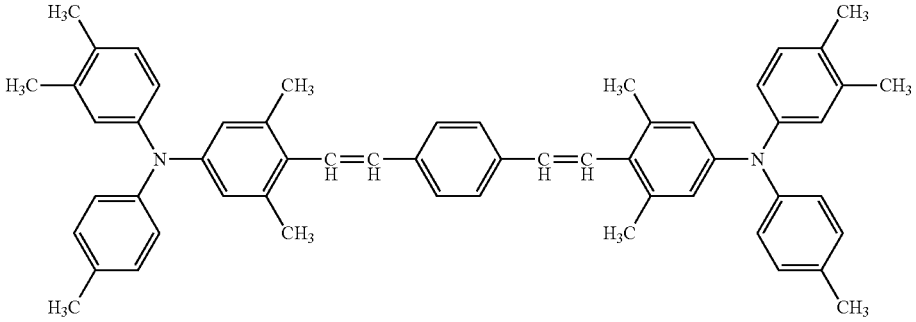

-continued
CTM43
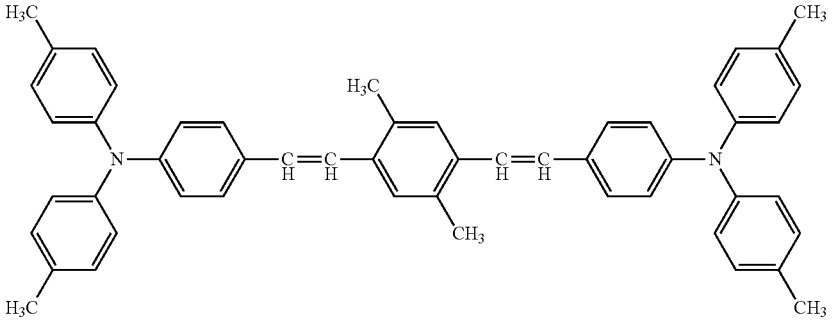
CTM44
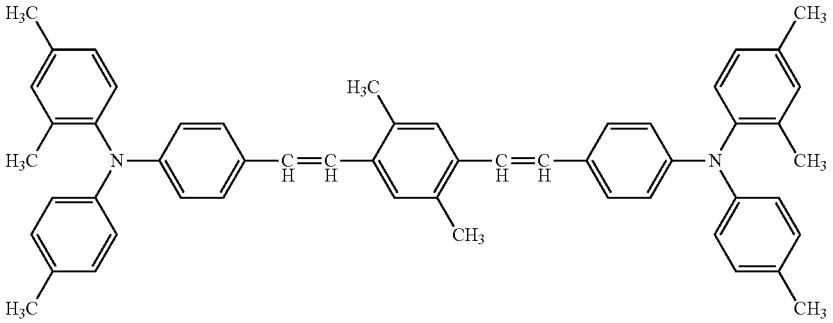
CTM45
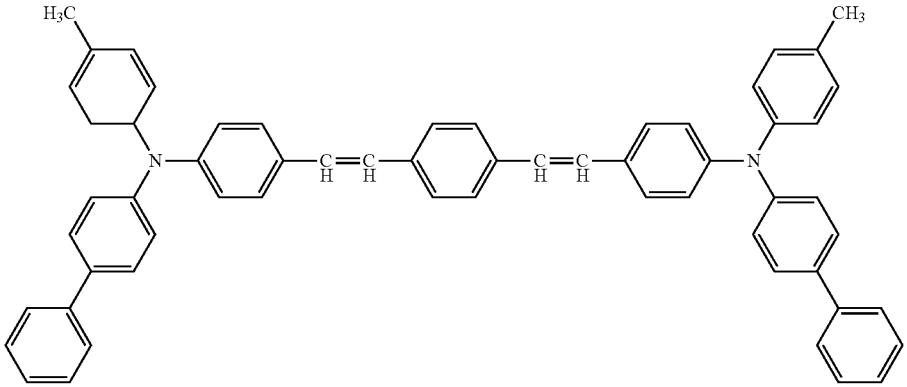
CTM44
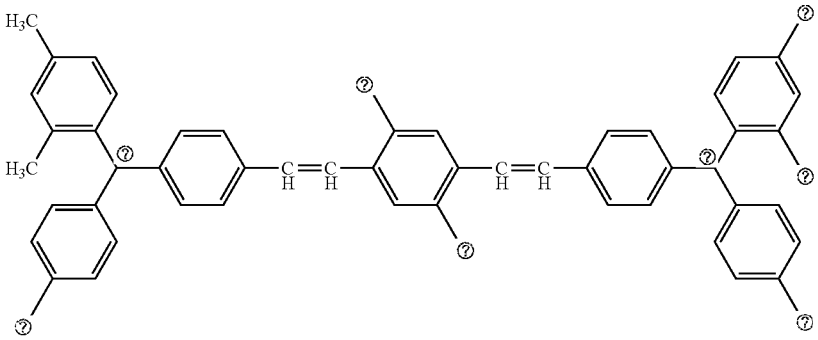

-continued
CTM46
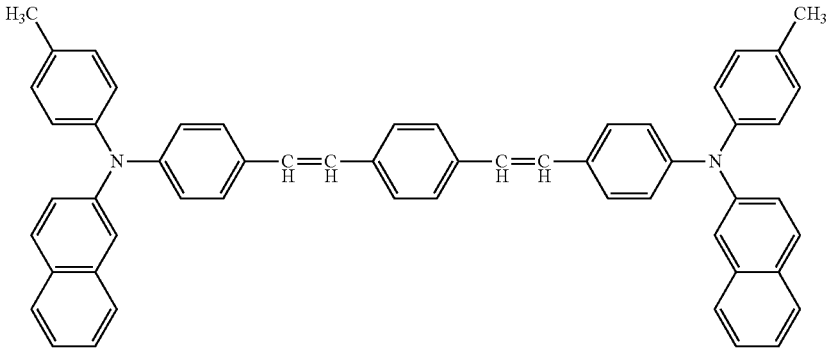
CTM47
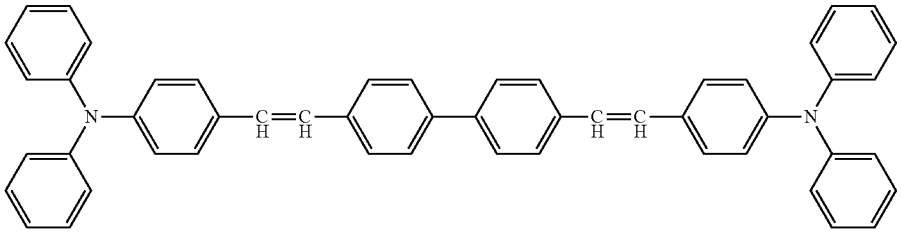
CTM48
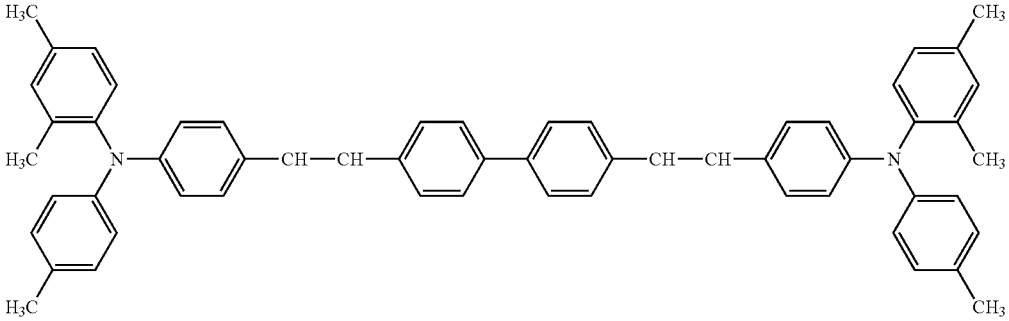
CTM49
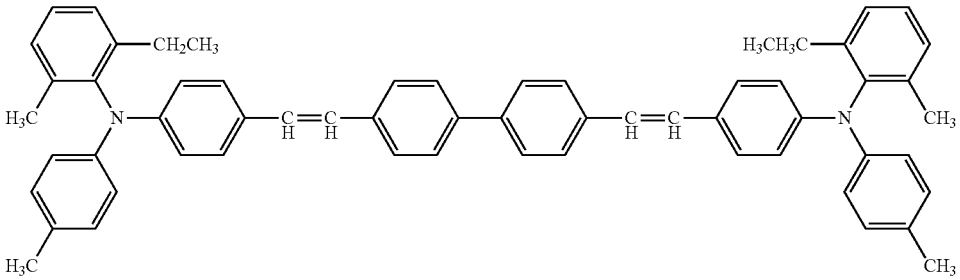
CTM50
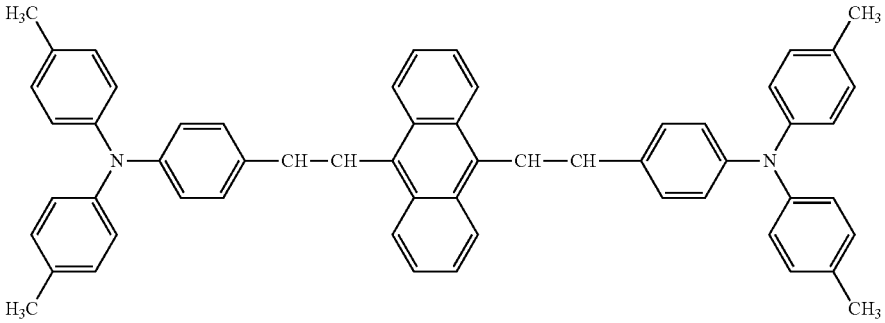

-continued
CTM51
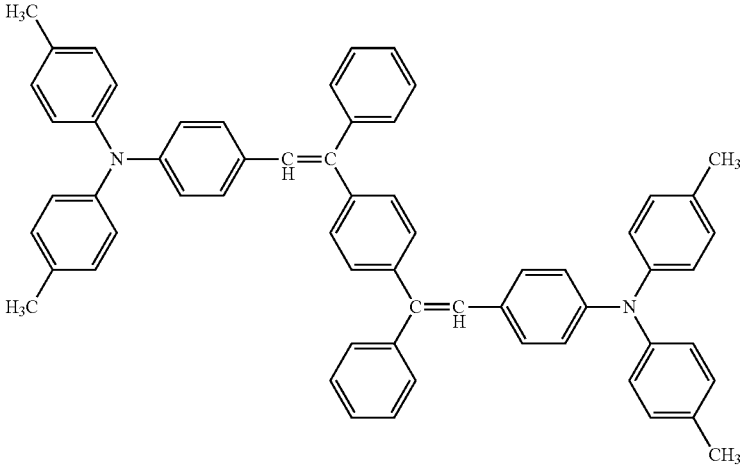
CTM52
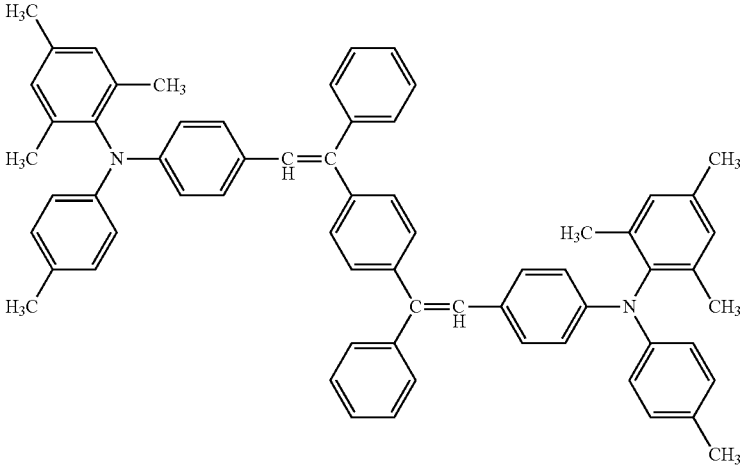
CTM53
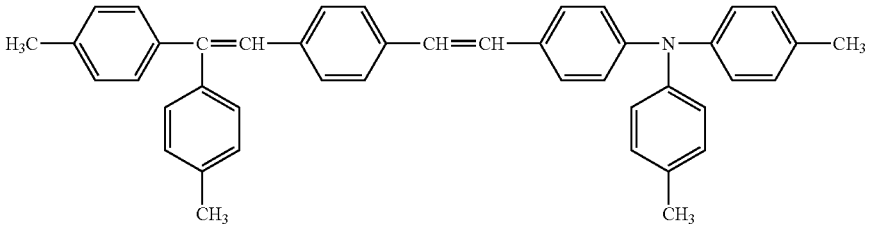
CTM54
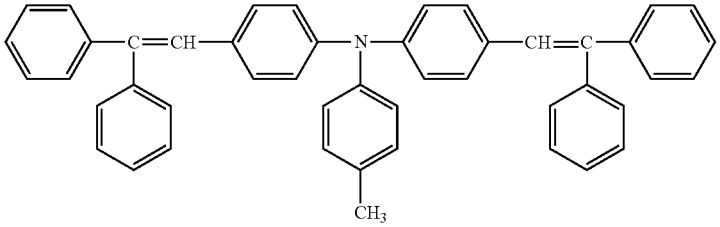
CTM55
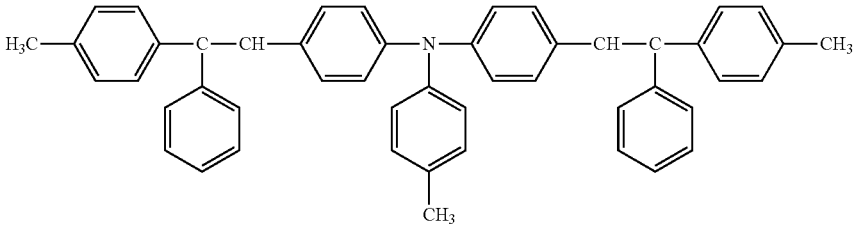

-continued
CTM56
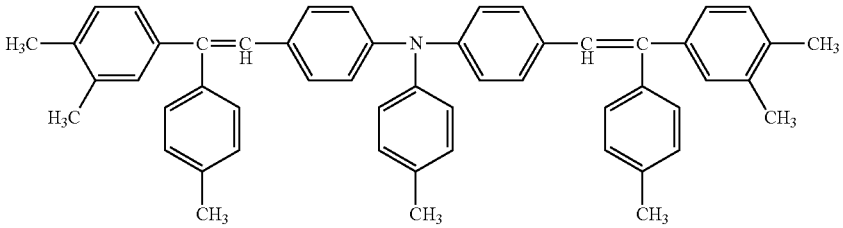
CTM57
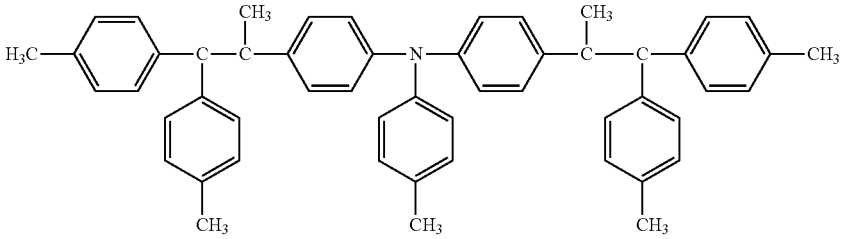
CTM58
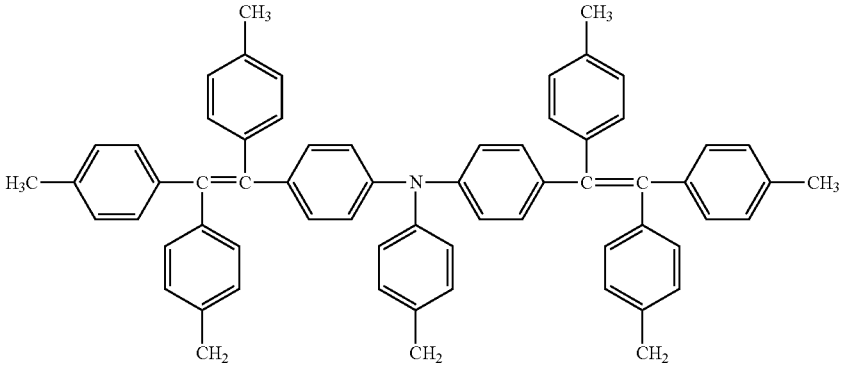
CTM59
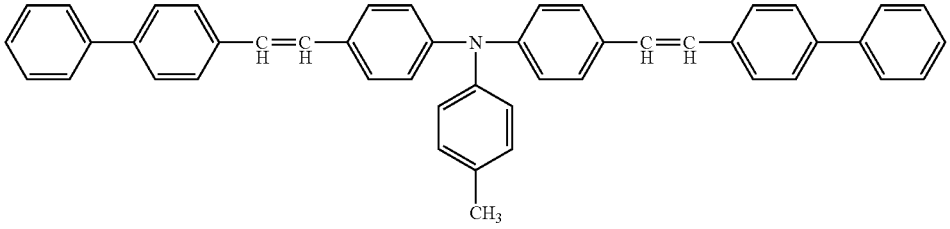
CTM60
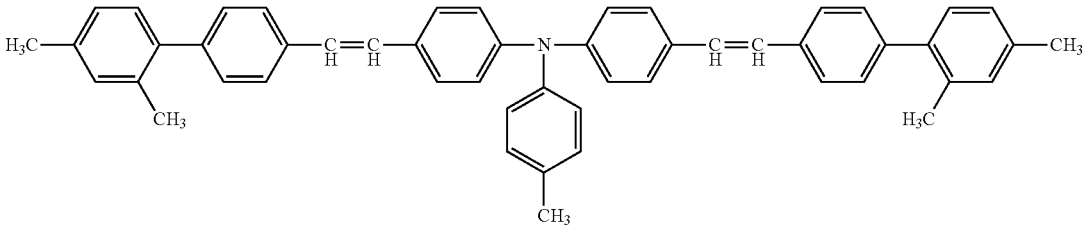
CTM61
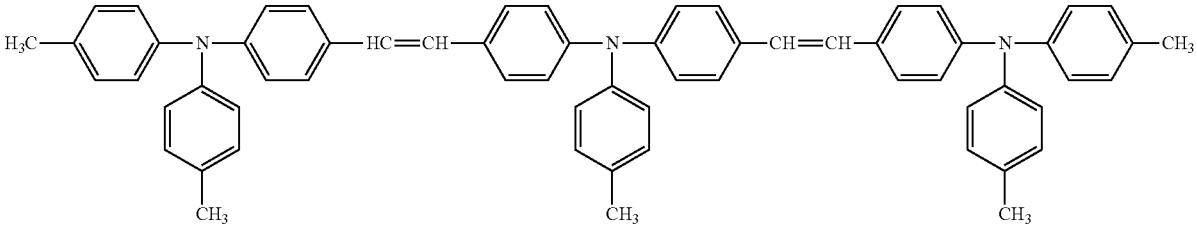

In the present invention, the charge transport materials having a molecular weight of 600 or higher have a large molecule size and in addition, the solubility in a solvent deteriorates. As a result, even when a protection layer is formed on the charge transport layer, extra elution of the charge transport material to the protection layer is limited. Therefore, the effect of the present invention is obtained.

The solubility of the charge transport material is not necessarily determined solely by the molecular weight but changes depending on the molecule structure of the charge transport material. As the molecule size increases, the molecule is considered to be easily trapped in the binder resin. Therefore, a charge transport material having a molecular weight of 600 or higher is preferable to sustain a suitable amount of elution of the charge transport material to the protection layer. However, the charge transport material is preferable to be completely dissolved in a solvent contained in the liquid application for the charge transport layer. The solubility of a charge transport that has a molecular weight of 900 or higher to cyclopentanone tends to decrease and the elution amount to the protection layer s extremely small even if dissolved. Thus, the charge infusion property at the interface between the protection layer and the photosensitive layer deteriorates, which is not suitable for the present invention.

In the present invention, the ionization potential of the charge transport layer is preferably as least 0.1 eV smaller than that of the protection layer. When the ionization potential of the charge transport layer is small, the infusion barrier for the charge from the charge generation layer decreases, which significantly reduces the residual voltage of the image bearing member. Therefore, the electrostatic durability is significantly improved. A protection layer that has an ionization potential smaller than that of the charge transport layer of the protection layer is also good to reduce the residual voltage but may cause deterioration of the image quality such as image blur, or reduction of image resolution because the surface of the image bearing member is susceptible to an oxidization gas.

Therefore, a protection layer containing a filler and a resin formed by curing a polymerizable compound having a charge transport structure and a polymerizable compound having no charge transport structure is formed on the charge transport layer and the ionization potential of the charge transport layer is set to be at least 0.1 eV smaller than that of the potential layer to have a good combination of reduction on the residual voltage and prevention on image blur.

In the present invention, although the protection layer has a larger ionization potential than the charge transport layer, the elution amount of the charge transport material to the protection layer is sustained. Therefore, the impact on the residual voltage, etc. is small. In addition, that the protection layer is sufficiently thinner than the charge transport layer is one of the reasons. In addition, the protection layer formed by curing a polymerizable compound having a charge transport structure and a polymerizable compound having no charge transport structure can reduce the occurrence of image blur that is caused by the oxidization gas in comparison with a protection layer in which a charge transport material is dispersed in a thermoplastic resin.

However, if the charge transport material in the charge transport layer excessively elutes into the protection layer during formation thereof, the effect mentioned above is not obtained. When a charge transport material having a small ionization potential is contained in the protection layer situated as the surface of the image bearing member, image blur or reduction on the resolution is severer due to the presence of oxidization gas. In addition, when the charge transport material excessively elutes into the protection layer, the curing inhibition occurs since the charge transport material in the charge transport layer has no cross-linking functional group. Furthermore, when the protection layer is cured by ultraviolet, etc., the charge transport material that has excessively eluted to the protection layer absorbs ultraviolet, thereby preventing the curing reaction in the protection layer. This also leads to decomposition and transformation of the charge transport material, which results in further curing inhibition and deterioration of the electrostatic characteristics. In the present invention, excessive elution of the charge transport material to the protection layer can be prevented and the elution amount is limited to a suitable level. Therefore, image blur or reduction in the resolution can be avoided although the charge transport layer containing a charge transport material having a small ionization potential is used. Resultantly, it is possible to have a good combination for reducing the residual voltage, and preventing image blur and reduction of the resolution.

The ionization potential represents an amount of energy required to take out one electron from the ground state of a material. The ionization potential of the charge transport layer and the ionization potential of the protection layer are obtained by directly measuring the charge transport layer and the protection layer as they are. The ionization potential is measured by irradiating a sample material with ultraviolet dispersed by a monochrome meter in an atmosphere while changing the energy of the ultraviolet to obtain the energy by which the material starts to emit a photoelectron by photoelectronic effect. Surface analysis instrument (AC-1, AC-2, AC-3, etc., manufactured by Riken Keiki Co., Ltd.) can be used for measurement.

Specific examples of the binder resins for the charge transport layer include, but are not limited to, thermoplastic resins, or thermosetting resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Among these, polycarbonate and polyarylate are preferably used.

The content of the charge transport material is from 20 to 300 parts by weight and preferably from 40 to 150 parts by weight based on 100 parts by weight of the binder resin. In addition, the charge transport material and the binder resin are independently used alone or in combination.

Specific examples of the solvent for use in the liquid application for the charge transport layer include, but are not limited to, tetrahydrofuran, dioxane, dioxolan, toluene, cyclohexanone, cyclopentanone, methylethylketone, xylnene, acetone, diethylether, and methylethylketone. Among these, tetrahydrofuran, toluene, xylene and cyclopentanone are preferably used. These can be used alone or as a mixture of two or more.

In addition, an additive such as a plasticizer, a leveling agent, anti-oxidizer, and a lubricant can be optionally added to the liquid application of the charge transport layer. These can be used alone or in combination. Particularly, the charge transport material represented by the chemical formula (1), (2) or (3) may crack due to attachment of sebum cutaneum, an internal stress, etc. Cracking can be prevented by addition of a plasticizer and an anti-oxidization agent (anti-oxidizer).

Specific examples of the plasticizers include, but are not limited to, dibutylphthalate and dioctyl phthalate. The addition amount is preferably from 0 to 30% by weight and more preferably from 0 to 10% by weight based on the binder resin.

Specific examples of the anti-oxidizers include, but are not limited to, known materials such as phenol based compounds, paraphenylene diamines, hydroquinones, organic sulfur compounds and hindered amines. These are suitable to stabilize the electrostatic characteristics over repetitive use. Among the charge transport materials represented by the chemical formula 1, 2, or 3, a material having a particularly small ionization potential tends to be unstable in an oxidization gas atmosphere. However, these can be suitably used in an oxidization gas atmosphere by adding these anti-oxidizes, which leads to prevention of occurrence of image blur. The addition amount of the anti-oxidizer is preferably from 0 to 20% by weight and more preferably from 0.1 to 10% by weight based on the charge transport material. An excessive addition amount of such an anti-oxidizer tends to cause a sharp rise of the residual voltage. By contrast, when the addition amount is too small, charge reduction may occur in a highly dense oxidization gas atmosphere.

Specific examples of the leveling agent include, but are not limited to, silicone oils, for example, dimethyl silicone oil and methyl phenyl silicone oil, and polymers or oligomers having perfluoroalkyl groups in its side chain. The addition amount of the leveling agent is preferably from 0 to 1% by weight and more preferably from 0.01 to 0.05% by weight based on the binder resin. Therefore, coating deficiency of the charge transport layer can be prevented and a smooth film is formed.

Known methods such as a dip coating method, a spray coating method, a bead coating method, a nozzle coating method, a spinner coating method, and a ring coating method can be used as the method of applying the charge transport layer. Among these, the dip coating method is preferable. Subsequent to application and drying check by finger touching, the applied layer is heated and dried in an oven, etc. The drying temperature of the charge transport layer varies depending on the kind of the solvent contained in the liquid application of the charge transport layer and is preferably from 80 to 150° C. and more preferably from 100 to 140° C. The thus obtained charge transport layer has a thickness of from 10 to 50 μm and preferably from 15 to 35 μm.

Protection Layer

The protection layer is described next. The protection layer in the present invention contains a filler and a resin formed by curing a polymerizable compound having a charge transport structure and a polymerizable compound having no charge transport structure.

The filler is described next. Filler material is typified into an organic filler and an inorganic filler. Specific examples of the organic fillers include, but are not limited to, powders of fluorine-containing resins such as polytetrafluoroethylene, silicone resin powders, and amorphous carbon powders. Specific examples of the inorganic fillers include, but are not limited to, powders of metals such as copper, tin, aluminum and indium, metal oxides such as silica, tin oxide, zinc oxide, titanium oxide, alumina, zirconia, indium oxide, antimony oxide, bismuth oxide, calcium oxide, tin oxide doped with antimony, indium oxide doped with tin, fluorinated metals such as fluorinated tin, fluorinated calcium, and fluorinated aluminum, potassium titanate and arsenic nitride. Among these fillers, inorganic materials, particularly metal oxides, are preferable in terms of the filler hardness and light scatter to improve abrasion resistance, or image quality. Furthermore, usage of metal oxides is advantageous in terms of the quality of an applied film. Since the quality of an applied film has a great impact on the image quality and abrasion resistance, forming an applied film of good quality is preferable to improve the durability and the image quality.

Furthermore, a filler that has a high insulation property is suitable to hardly cause image blur. When an electroconductive filler is contained in the uppermost surface of an image bearing member, the resistance at the surface decreases, thereby moving the charges horizontally, which easily causes image blur. In particular, a filler that has a specific resistance of $10^7$ Ω·cm is preferable in terms of resolution. Specific examples of such fillers include, but are not limited to, alumina, zirconia, titanium oxide and silica. Among these, amorphous alumina is highly light transmissive, and stable against heat, while having a hexagonal close-packed structure excellent for abrasion resistance and thus preferable to prevent the occurrence of image blur, and improve abrasion resistance, the quality of applied film, and light transmissiveness. Specific examples of the filler having electroconductivity include, but are not limited to, tin oxide, indium oxide, antimony oxide, tin oxide doped with antimony, and indium oxide doped with tin. However, these are not preferable in the present invention because these tend to cause image blur. However, since fillers made of the same material do not have necessarily the same respective specific resistance, the criteria is not the material of the filler but the specific resistance thereof. In addition, these fillers can be used alone or in combination, thereby controlling the surface resistance. The specific resistance of the filler can be measured by, for example, using a resistance measuring instrument for powder. Specific processes are as follows: place metal oxide powder in a cell and pinch it with the electrodes; adjust the amount of the metal oxide by load such that the metal oxide has a thickness of about 2 mm; apply a voltage between the electrodes; and measure the current to obtain the specific resistance of the metal oxide powder.

Furthermore, these fillers can be subject to surface treatment using at least one kind of surface active agent. Such surface treatment may improve the dispersion property of the filler.

The average primary particle diameter of the filler is preferably from 0.05 to 0.9 μm and more preferably from 0.1 to 0.6 μm in terms of optical transmittance and abrasion resistance. When the average primary particle diameter of the filler is too small, the filler tends to agglomerate or the abrasion resistance easily deteriorates. When the average primary particle diameter of the filler is too large, the filler tends to easily settle down or cause image quality deterioration or production of abnormal images.

In addition, the addition amount of the filler is preferably from 0.1 to 50% by weight and more preferably from 3 to 30% by weight based on all the solid portion contained in the layer containing the filler. When the addition amount of the filler is too small, obtained abrasion resistance is not satisfactory. An addition amount of the filler that is too large tends to raise the residual voltage, cause image blur, reduce the resolution, and degrade the image quality.

These fillers improve abrasion resistance but may raise the residual voltage. This stems from the fact that the filler surface contains the trap sites of charges and is particularly significant for a hydrophilic metal oxide having a high resistance. To reduce the rise of the residual voltage, addition of the polycarboxylic acid compound is suitable. Among the polycarboxylic acid compounds, polycarbonates having a high acid value of from 150 to 400 mgKOH/g are particularly preferable to reduce the rise of the residual voltage. When the acid value is too low, the rise of the residual voltage tends to be not sufficiently reduced. By contrast, an acid value that is too high may have an impact on the curing reaction of the binder resin depending on the addition amount. The acid value is defined by a number of mg of potassium hydroxide required to neutralize carboxyl group contained in 1 g of a resin. The polycarboxylic acid compound is absorbed to the surface of a filler, particularly a hydrophilic metal oxide, and expected to fill the trap site that causes a rise of the residual voltage. Therefore, the residual voltage can be reduced even when a hydrophilic filler, which significantly affects the residual voltage, is contained, which may lead to a synergy effect of improving the dispersion property of the filler. Among these polycarboxylic acid compounds, a moisture dispersion agent (BYK-P104, manufactured by BYK Chemie) is particularly suitable. These technologies are described in JP 3802787.

The addition amount of the polycarboxylic acid compound s preferably satisfies the following relationship I:

$$6 \leqq (A \times B/C) \leqq 40$$

where "A" represents the content of the polycarboxylic acid compound, "B" represents the acid value of the polycarboxylic acid compound, and "C" represents the content of the filler.

When (A×B/C) is below 6, the dispersion stability tends to decrease particularly when the liquid application is circulated for use, which may shorten the working life of the liquid application. By contrast, when (A×B/C) is above 40, the filler tends to agglomerate, which reduces the dispersion property. In addition, an increase in the addition amount of the filler may have an adverse impact on the curing reaction.

The binder resin contained in the protection layer for use in the present invention is formed by curing at least a polymerizable compound having a charge transport structure and a polymerizable compound having no charge transport structure. The protection layer improves abrasion resistance and transport charges at the same time. Such a protection layer can be formed by curing a polymerizable compound having a charge transport structure and a polymerizable compound having no charge transport structure. When the production reaction of polymers are largely classified into chain reaction polymerization and successive polymerization, polymerization represents the former and includes unsaturated polymerization, ring opening polymerization, etc. in which the reaction form mainly proceeds via an intermediate such as an ion or radical. Polymerizable compound represents a compound having a functional group by which the reaction form described above can proceed. In addition, curing typically represents a reaction forming a three dimensional network structure formed by binding monomers or oligomers having the functional group mentioned above upon application of heat, light such as optical light or ultraviolet, or energy such as electron beam or radiation such as gamma ray through, for example, covalent binding.

The curable resin includes thermoplastic resins polymerized by heat, optical curable resins polymerized by light such as ultraviolet and optical light, electron beam curable resins polymerized by electron beam, etc. Optionally, curing agents, catalysts and polymerization initiators are added in combination.

Reactive compounds such as monomers or oligomers that include a functional group that causes polymerization reaction are used to cure the curable resin specified above. Any functional groups that cause polymerization reaction can be used and generally unsaturated polymerizable functional groups and ring opening polymerizable functional groups are well known. Specific examples of the unsaturated polymerizable functional groups include, but are not limited to, carbon carbon double bond, carbon triple bond, carbon nitrogen double bond, and carbon nitrogen triple bond. The unsaturated groups therein conduct polymerization reaction via radicals and ions. The ring opening polymerizable functional groups conduct reaction in which polymerization reaction starts and repeats at the same time when the unstable ring structure formed of a carbon ring, an oxo ring, and nitrogen hetero ring that have distortion opens to produce chained polymers mostly via ions as active species.

Specific examples thereof include, but are not limited to, groups having carbon carbon double bond such as acryloyl group, methacryloyl group, and vinyl group, functional groups causing ring opening polymerization such as silanol group and a cyclic ether group. Two or more kinds of molecules may be included in the polymerization reaction. In addition, in the curing reaction, as the number of functional groups contained in one molecule of a reactive monomer increases, the obtained three dimensional network structure is solid and firm. Therefore, three or more functional groups are preferably contained in one molecule. Therefore, the curing density is high, thereby improving the hardness, elasticity, uniformity, smoothness of the protection layer, which leads to improvement on durability of an image bearing member using the protection layer, and image quality In the present invention, any binder resin made by using known material can be used as long as it is formed by curing a polymerizable compound having a charge transport structure and a polymerizable compound having no charge transport structure. Specific examples of the curable resins include, but are not limited to, phenol resins, melamine resins, alkyd resins, urethane resins, amino resins, polyimide resins, siloxane resins, and acryl resins. Among these, phenol resins, acryl/methacryl resins, urethane resins, epoxy resins, and siloxane resins are preferably used. Among these, acryl/methacryl resins are particularly preferable because of its excellent characteristics. These curable resins form a three-dimensional network structure and are insoluble in an organic solvent. Therefore, in the present invention, the cured state of the curable resin represents that when, for example, an alcohol based organic solvent is attached to the cured resin, the layer is not dissolved therein.

In the present invention, as described above, a three dimensional developed network is formed on an electroconductive substrate by curing reaction between a polymerizable compound having a charge transport structure and a polymerizable compound having no charge transport structure. The protection layer can be more hardened by preliminarily admixing a curing agent, a catalyst, and a polymerization initiator. Therefore, the protection layer has an increased abrasion resistance and non-reactive functional groups rarely remain, which leads to prevention on deterioration of the electrostatic characteristics. In addition, the reaction is uniformly conducted so that cracking or distortion hardly occurs, which improves the cleaning property and has a significant impact on improvement on the durability of an image bearing member and the image quality.

With regard to the polymerizable compound having a charge transport structure, any polymerizable compound having a charge transport structure made by using known materials can be used as long as it contains a charge transport structure and a functional group to cure the resin. The charge transport structure represents a structure contained in a charge transport material, thereby demonstrating the charge transport property. The charge transport structure is typically classified into a structure that transports positive holes, and a structure that transport electrons. Both are included in the present invention.

The number of the charge transport structure, i.e., the structure that transports positive holes, or the structure that transport electrons, in a compound is at least one. A charge transport structure having multiple charge transport structures is preferable in terms of the charge transport property. In addition, a charge transport structure demonstrating a bipolar property, meaning that a positive hole transport structure and an electron transport structure are contained in the molecule of a polymerizable compound having a charge transport structure simultaneously, can be also used.

Specific examples of the positive hole transport structures among the charge transport structures include, but are not limited to, structures demonstrating electron donating property such as poly-N-vinylcarbazole, poly-γ-carbazolyl ethylglutamate, condensation product of pyrene-form aldehyde, polyvinylpyrene, polyvinyl phenanthrene, polysilane, oxazole, oxadiazol, imidazole, monoarylamine, diarylamine, triaryl amine, stilbene, α-phenyl stilbene, bendidine, diarylmethane, triarylmethane, 9-styryl anthracene, pyrazoline, divinyl benzene, hydrazone, indene, butadiene, bisstilbene, and enamine.

Specific examples of such electron transport structures include, but are not limited to, electron accepting structure material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, condensed heterocyclic quinine, diphenoquinone, benzoquinone, naphtharene tetracarboxylic acid diimide, and aromatic rings having a cyano group or a nitro group. Among these, triaryl amine structure is particularly effective.

Next, acryl/methacryl resins are described as an example in detail.

The polymerizable compound having no charge transport structure for use in the present invention represents a compound having a polymerizable functional group without a positive hole transport structure such as triaryl amine, hydrazone, pyrazoline, or carbazole, or an electron transport structure such as condensed polycyclic quinone, diphenoquinone or an electron absorbing aromatic ring having a cyano group or a nitro group. The polymerizable functional group is any polymerizable functional group which has a carbon-carbon double bond.

For example, 1-substituted ethylene functional groups and 1,1-substituted ethylene functional groups are suitably used as the polymerizable functional group.

(1) 1-Substituted Ethylene Functional Group

A specific example of 1-substituted ethylene functional groups is the functional group represented by the following chemical formula 6.

$$CH{=}CH_2{-}X_1{-} \qquad \text{Chemical formula 6}$$

In the chemical formula 6, $X_1$ represents an arylene group such as a substituted or non-substituted phenylene group, and a naphthylene group, a substituted or non-substituted alkenylene group, —CO—, —COO—, —CON($R_{226}$) (wherein, $R_{226}$ represents hydrogen, an alkyl group such as methyl group and ethyl group, an aralkyl group such as benzyl group, naphthyl methyl group, and phenethyl group, and an aryl group such as phenyl group and naphthyl group), or —S—.

Specific examples of such functional groups include, but are nor limited to, vinyl group, styryl group, 2-methyl-1,3-butadienyl group, vinyl carbonyl group, acryloyloxy group, acryloyl amide group, and vinylthio ether group.

(2) 1,1-Substituted Ethylene Functional Group

A specific example of 1,1-substituted ethylene functional groups is the functional group represented by the following chemical formula 7.

$$CH{=}CY_4{-}X_2{-} \qquad \text{Chemical formula 7}$$

In the chemical formula, $Y_4$ represents a substituted or non-substituted alkyl group, a substituted or non-substituted aralkyl group, an aryl group such as a substituted or non-substituted phenyl group and naphtylene group, a halogen atom, cyano group, nitro group, an alokoxy group such as methoxy group and ethoxy group, —$COOR_{229}$ ($R_{229}$ represents hydrogen atom, an alkyl group such as a substituted or non-substituted methyl group and ethyl group, an aralkyl group such as a substituted or non-substituted benzyl group, naphthylmethyl group, and phenethyl group, an aryl group such as substituted or non-substituted phenyl group and naphtyl group or —$CONR_{230}R_{231}$ ($R_{230}$ and $R_{231}$ independently represent a hydrogen atom, an alkyl group such as a substituted or non-substituted methyl group and ethyl group, an aralkyl group such as a substituted or non-substituted benzyl group, naphthyl methyl group, and phenethyl group, or an aryl group such as substituted or non-substituted phenyl group and naphtyl group). $X_2$ represents a single bond, the same substitution group as $X_1$, or an alkylene group. At least one of $Y_4$ and $X_2$ is an oxycarbonyl group, cyano group, an alkenylene group and an aromatic ring.

Specific examples of these functional groups include, but are nor limited to, α-cyanoacryloyloxy group, methacryloyloxy group, α-cyanoethylene group, α-cyanoacryloyloxy group, α-cyanophenylene group and methacryloyl amino group.

Specific examples of substitution groups further substituted to the substitution groups of $X_1$, $X_2$ and $Y_4$ include, but are not limited to, a halogen atom, nitro group, cyano group, an alkyl group such as methyl group and ethyl group, an alkoxy group such as methoxy group and ethoxy group, aryloxy group such as phenoxy group, aryl group such as phenyl group and naphtyl group, and an aralkyl group such as benzyl group and phenetyl group. Among these polymerizable functional groups, acryloyloxy group and methacryloyloxy group are particularly preferable.

With regard to the number of the functional groups of the polymerizable compound having no charge transport structure, the greater, the better. Particularly, a polymerizable compound having 3 or more functional groups is preferable. When a polymerizable monomer having 3 or more functional groups is cured, a three dimensional network structure is developed and thus a layer having a high hardness with an extremely high density and a high elasticity is obtained. In addition, the layer is uniform and smooth while demonstrating a high abrasion resistance and damage resistance. However, since a great number of bonds are instantly formed in the curing reaction depending on the curing condition and materials, volume contraction or internal stress may occur, which leads to cracking or peeling-off of the layer. If this is the case, a polymerizable monomer having one or two functional groups or mixture thereof is used to deal with such cracking or peeling-off.

Next, the polymerizable compound having no charge transport structure with three or more functional groups suitable to improve the abrasion resistance is described.

A compound having at least three acryloyloxy groups is obtained by performing ester reaction or ester conversion reaction using, for example, a compound having at least three hydroxyl groups therein and an acrylic acid (salt), a halide acrylate and an ester of acrylate.

A compound having at least three methacryloyloxy groups is obtained in the same manner. In addition, the number of the polymerizable functional groups in a monomer having at least three polymerizable functional groups can be the same or different from each other.

The polymerizable monomer having at least three functional groups without having a charge transport structure include the following compounds, but are not limited thereto.

Specific examples of the polymerizable compounds mentioned above for use in the present invention include, but are not limited to, trimethylol propane triacrylate (TMPTA), trimethylol propane trimethacrylate, HPA modified trimethylol propane triacrylate, EO modified trimethylol propane triacrylate, PO modified trimethylol propane triacrylate, caprolactone modified trimethylol propane triacrylate, pentaerythritol triacrylate, pentaerythritol tetra acrylate (PETTA), glycerol triacrylate, ECH modified glycerol triacrylate, EO modified glycerol triacrylate, PO modified glycerol triacrylate, tris (acryloxyrthyl)isocyanulate, dipenta erythritol hexacrylate (DPHA), caprolactone modified dipenta erythritol hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, EO modified phosphoric acid triacrylate, and 2,2,5,5-tetrahydroxy methyl cyclopentanone tetracrylate. These can be used alone or in combination.

In addition, the polymerizable compound having no functional group preferably has a ratio (molecular weight/the number of functional groups) of the molecular weight to the number of functional groups in the compound of 250 or less to form a dense cross linking bonds in the protection layer. Furthermore, when the ratio (molecular weight/the number of functional groups) is too large, the protection layer formed of such a compound is soft and thus the abrasion resistance thereof tends to deteriorate. Therefore, among the monomers specified above, a sole used of a monomer having an extremely long modified (e.g., HPA, EO, PO modified) group is not suitable.

In addition, the content ratio of the polymerizable compound having no charge transport structure is from 20 to 80% by weight and preferably from 30 to 70% by weight based on the total weight of the protection layer.

When the monomer content ratio is too small, the density of three-dimensional cross-linking bond in the protection layer tends to be low. Therefore, the abrasion resistance thereof is not drastically improved in comparison with a case in which a typical thermoplastic binder resin is used. A monomer content ratio that is too large means that the content of the charge transport compound decreases, which may significantly raise the residual voltage.

Desired electric characteristics and abrasion resistance vary depending on the process used. Therefore, it is difficult to jump to any conclusion but considering the balance of the combination, the range of from 30 to 70% by weight is most preferred.

Next, the polymerizable compound having a charge transport structure is described.

The polymerizable compound having a charge transport structure for use in the present invention represents a compound having a positive hole transport structure such as triaryl amine, hydrazone, pyrazoline, or carbazole, and/or an electron transport structure such as condensed polycyclic quinone, diphenoquinone or an electron absorbing aromatic ring having a cyano group or a nitro group while having a polymerizable functional group.

The polymerizable functional group specified above for the polymerizable compound mentioned above can be suitably used. Among these, acryloyloxy group and methcryloyloxy group are particularly suitable. The polymerizable compound having a charge transport structure for use in the protection layer for use in the present invention can be used irrespective of the number of functional groups. However, a polymerizable compound that has one functional group is preferable in terms of the stability of the electrostatic characteristics and the layer quality. A polymerizable compound having a charge transport structure having two or more functional groups is advantageous in terms of the cross linking density because multiple bonds are used to fix the compound in the cross linking structure. However, the charge transport structure is extremely bulky, which increases distortion in the cured layer structure and thus internal stress in the layer. In addition, the intermediate structure (cation radical) during charge transport is not stabilized. This leads to deterioration of the sensitivity due to the charge trap and a rise of the residual voltage.

Any material that can impart the charge transport function can be used to form the charge transport structure of the polymerizable compound having a charge transport structure. Among these, triaryl amine structure is preferable. For example, a compound having the structure represented by the following chemical formula 8 or 9 is suitable used because it improves the electrostatic characteristics such as sensitivity and residual voltage.

Chemical formula 8

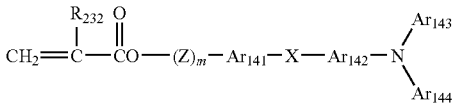

Chemical formula 9

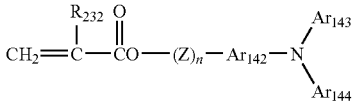

In the Chemical formulae 8 and 9, $R_{232}$ represents hydrogen atom, a halogen atom, a substituted or non-substituted alkyl group, a substituted or non-substituted aralky group, a substituted or non-substituted aryl group, a cyano group, a nitro group, an alkoxy group, —$COOR_{241}$, wherein $R_{241}$ represents hydrogen atom, a substituted or non-substituted alkyl group, a substituted or non-substituted aralkyl group or a substituted or non-substituted aryl group, a halogenated carbonyl group or $CONR_{242}R_{243}$, wherein $R_{242}$ and $R_{243}$ independently represent hydrogen atom, a halogen atom, a substituted or non-substituted alkyl group, a substituted or non-substituted aralkyl group or a substituted or non-substituted aryl group, $Ar_{141}$ and $Ar_{142}$ independently represent an arylene group. $Ar_{143}$ and $Ar_{144}$ independently represent a substituted or non-substituted aryl group. X represents a single bond, a substituted or non-substituted alkylene group, a substituted or non-substituted cycloalkylene group, a substituted or non-substituted alkylene ether group, oxygen atom, sulfur atom, or vinylene group. Z represents a substituted or non-substituted alkylene group, a substituted or non-substituted divalent alkylene ether group or a divalent alkyleneoxy carbonyl group. m and n represent an integer of from 0 to 3.

Specific examples of the substitution groups in the chemical formulae 12 and 13 include, but are not limited to, the following.

In the Chemical formulae 8 and 9, among the substitution groups of $R_{232}$, specific examples of the alkyl groups of $R_{232}$ include, but are not limited to, methyl group, ethyl group, propyl group, and butyl group. Specific examples of the aryl groups of $R_{1232}$ include, but are not limited to, phenyl group and naphtyl group. Specific examples of the aralkyl groups of $R_{232}$ include, but are nor limited to, benzyl group, phenthyl group, naphtyl methyl group. The alkoxy group of $R_{232}$ include, but are nor limited to, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group. Among these substitution groups for $R_{232}$, hydrogen atom and methyl group are particularly preferable.

$Ar_{143}$ and $Ar_{144}$ represent a substituted or non-substituted aryl group. Specific examples thereof include, but are not limited to, condensed polycyclic hydrocarbon groups, non-condensed ring hydrocarbon groups and heterocyclic groups. Specific examples of the condensed polycyclic hydrocarbon groups include, but are not limited to, a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include, but are not limited to, a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include, but are not limited to, a single-valent group such as carbazol, dibenzofuran, dibenzothiophene, oxadiazole, and thiadiazole.

The aryl groups represented by $Ar_{143}$ and $Ar_{144}$ can have a substitution group. Specific examples thereof are as follows:

(1) Halogen atom, cyano group, and nitro group;

(2) Alkyl group, preferably a straight chained or side chained alkyl group having 1 to 12, more preferably 1 to 8 and furthermore preferably from 1 to 4 carbon atoms. These alkyl groups can have a fluorine atom, a hydroxyl group, cyano group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are not limited to, methyl group, ethyl group, n-butyl group, I-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) Alkoxy group (—$OR_{233}$), and $R_{233}$ represents the alkyl group defined in (2). Specific examples thereof include, but are not limited to, methoxy group, ethoxy group, n-propoxy group, i-propoxy group, t-butoxy group, n-butoxy group, s-butoxy group, i-butoxy group, 2-hydroxy ethoxy group, benzyl oxo group, and trifluoromethoxy group;

(4) Aryloxy group, and specific examples of the aryl group of the aryloxy group include, but are not limited to, phenyl group, and naphtyl group. These can contain an alkoxy group having 1 to 4 carbon atoms, an alkyl group having a 1 to 4 carbon atoms, or a halogen atom as a substitution group. Specific examples include, but are not limited to, phenoxy group, 1-naphtyloxy group, 2-naphtyloxy group, 4-methoxyphenoxy group, and 4-methylphenoxy group; (5) An alkyl mercapto group or an aryl mercapto group; Specific examples thereof include, but are not limited to, methylthio group, ethylthio group, phenylthio group, and p-methylphenylthio group;

(6) Group represented by the following chemical formula: 10:

Chemical formula 10

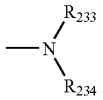

In Chemical formula 10, $R_{233}$ and $R_{234}$ independently represent a hydrogen atom, the alkyl group defined in (2), or an aryl group.

Specific examples of the aryl groups include, but are not limited to, phenyl group, biphenyl group, or naphtyl group. These can contain an alkoxy group having 1 to 4 carbon atoms, an alkyl group having 1 to 4 carbon atoms or a halogen atom as a substitution group.

$R_{233}$ and $R_{234}$ can share a linkage to form a ring.

Specific examples thereof include, but are not limited to, amino group, diethyl amino group, N-methyl-N-phenyl amino group, N,N-diphenyl amino group, N,N-di(tolyl) amino group, dibenzyl amino group, piperidino group, morpholino group, and pyrrolidino group;

(7) An alkylene dioxy group or an alkylene dithio such as methylene dioxy group and methylene dithio group; and (8) A substituted or non-substituted styryl group, a substituted or non-substituted β-phenyl styryl group, diphenyl aminophenyl group, ditolyl aminophenyl group, etc.

The arylene groups represented by $Ar_{141}$ and $Ar_{142}$ are divalent groups derived from the aryl group represented by $Ar_{143}$ and $Ar_{144}$ mentioned above.

X represents a single bond, a substituted or non-substituted alkylene group, a substituted or non-substituted cycloalkylene group, a substituted or non-substituted alkylene ether group, oxygen atom, sulfur atom, or vinylene group.

A straight chained or side chained alkyl group having 1 to 12, more preferably 1 to 8 and furthermore preferably from 1 to 4 carbon atoms is preferably specified. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms. Specific examples thereof include, but are note limited to, methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylpheny ethylene group, and 4-biphenyl ethylene group.

Specific examples of the substituted or non-substituted cycloalkylene groups include, but are not limited to, cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms.

Specific examples thereof include, but are not limited to, cyclohexylidene group, cyclohexylene group, and 3,3-dimethyl cyclohexylidene group.

Specific examples of the substituted or non-substituted alkylene ether group include, but are not limited to, ethyleneoxy, propyleneoxy, ethylene glycol, propylene glycol, diethylene glycol, tetraethylene glycol, and tripropylene glycol, and the alkylene group of the alkylene ether group may have a substitution group such as hydroxyl group, methyl group and ethyl group.

Vinylene group is represented by the chemical formula 11.

Chemical formula 11

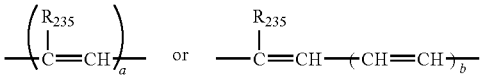

In the chemical formula 11, $R_{235}$ represents hydrogen or an alkyl group (the same as the alkylene groups defined in (2)) and an aryl group (the same as the aryl group represented by $Ar_{143}$, and $Ar_{144}$), and "a" represents 1 or 2 and "b" denotes an integer of from 1 to 3.

Z represents a substituted or non-substituted alkylene group, a substituted or non-substituted divalent alkylene ether group or a divalent alkyleneoxy carbonyl group in the chemical formulae 8 and 9.

Specific examples of the alkylene group are the same as the alkylene group specified for X.

Specific examples of the substituted or non-substituted divalent alkylene ether group are the same as the divalent group of the alkylene ether group specified for X.

A specific example of the divalent alkyleneoxy carbonyl group is a divalent caprolactone modified group.

In addition, a preferred polymerizable compound having the charge transport structure for use in the present invention is the compound represented by the following chemical formula 12.

In Chemical formula 16, "o", "p", "q" represent 0 or 1, $R_a$ represents hydrogen atom or methyl group, $R_b$ and $R_c$ are not hydrogen atom and independently represent an alkyl group having 1 to 6 carbon atoms. "s" and "t" represent an integer of from 0 to 3.

$Z_a$ represents a single bond, methylene group, ethylene group, —$CH_2CH_2O$—, —$CHCH_3CH_2O$—, or —$C_6H_5CH_2CH_2$—.

Among the compounds represented by the chemical formula 16 illustrated above, the compounds having methyl group or ethyl group as a substitution group of $R_b$ and $R_c$ are particularly preferred.

The polymerizable compound (monomer) having a functional group with a charge transport structure for use in the present invention represented by the chemical formulae 12, 13, or 16 in particular, is polymerized in a manner that both sides of the carbon-carbon double bond are open. Therefore, the polymerizable compound does not constitute an end of the structure but is set in a chained polymer. The polymerizable compound having a functional group is present in a main chain of a polymer in which cross-linking is formed by polymerization with a polymerizable monomer having at least three functional groups or a cross-linking chain between main chains. There are two kinds of the cross-linking chains. One is the cross-linking chain between a polymer and another polymer, and the other is the cross-linking chain formed by cross-linking a portion in the main chain present in a folded state in a polymer with a moiety deriving from a monomer polymerized away from the portion. Regardless of whether or not the radical polymerizable compound having a functional group with a charge transport structure is present in the main chain or in the cross-linking chain, the triaryl amine structure suspends from the chain portion. The triaryl amine structure has at least three aryl groups disposed in the radial directions relative to the nitrogen atom therein. Such a triaryl amine structure is bulky but does not directly joint with the chain portion and suspends from the chain portion via the carbonyl group, etc. That is, the triaryl amine structure is stereoscopically fixed in a flexible state. Therefore, these triaryl amine structures can be adjacent to each other with a moderate space in the polymer. Therefore, the structural distortion in the molecule is slight. In addition, the surface layer of a photoreceptor having such a structure is deduced to have an internal molecular structure with relatively few disconnections in the charge transport route.

Specific examples of the polymerizable compound having one functional group with a charge transport structure include, but are not limited to, the following Chemical structures.

Chemical formula 12

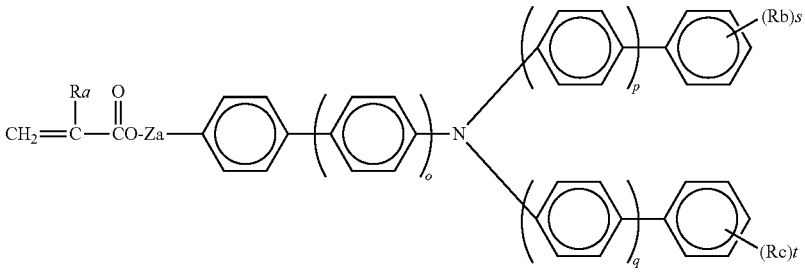

No. 1
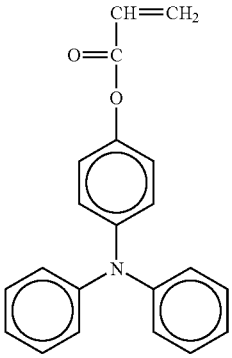
No. 2
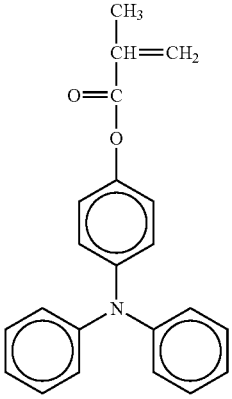
No. 3
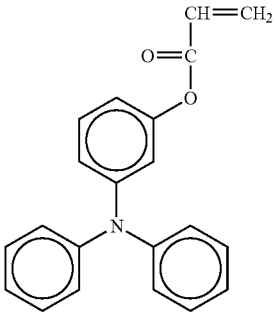
No.4
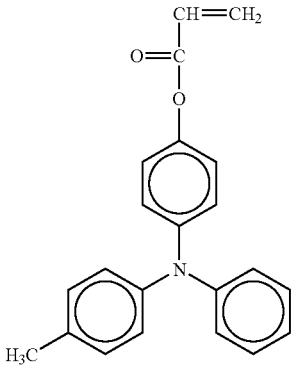
-continued
No. 5
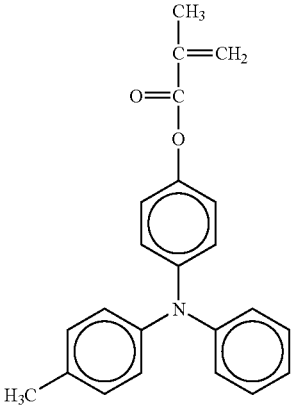
No. 6
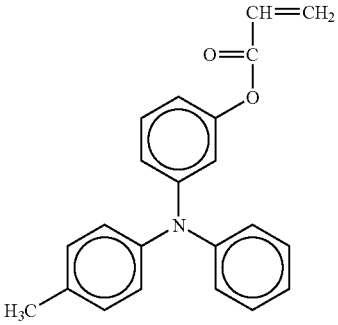
No. 7
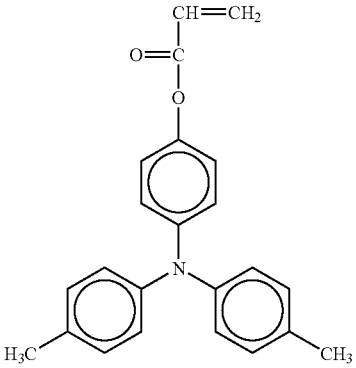
No. 8
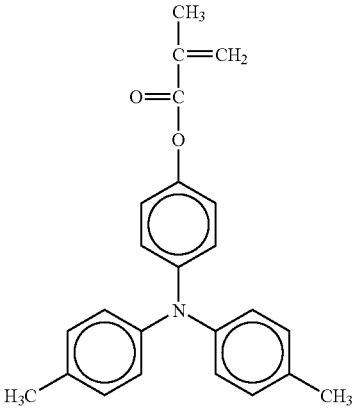

-continued
No. 9
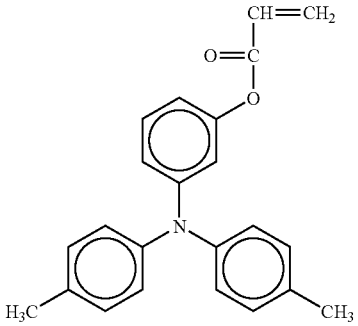
No. 10
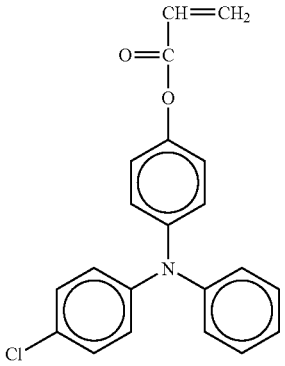
No. 11
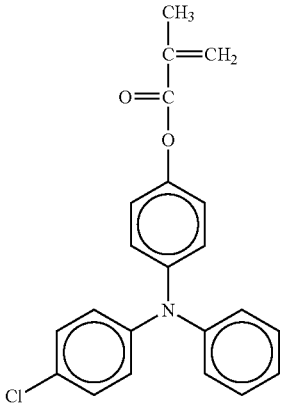
No. 12
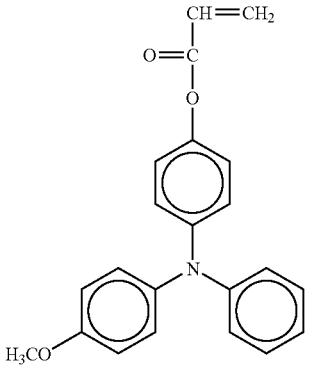
-continued
No. 13
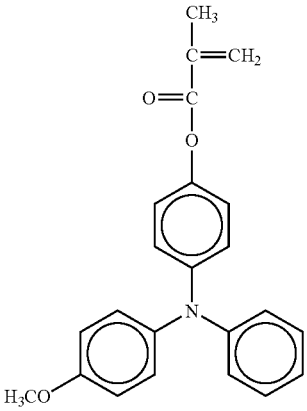
No. 14
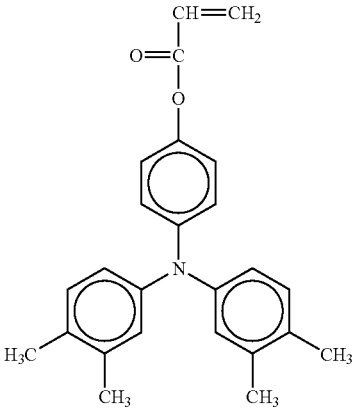
No. 15
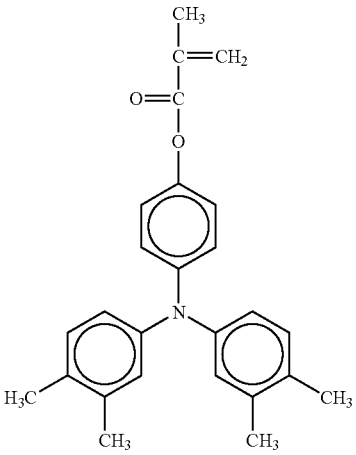
No. 16
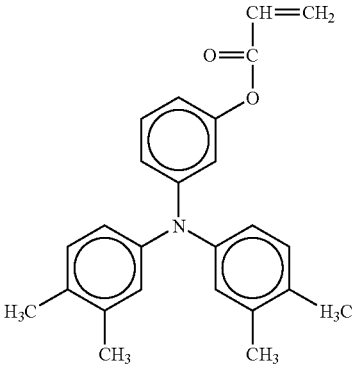

-continued
No. 17
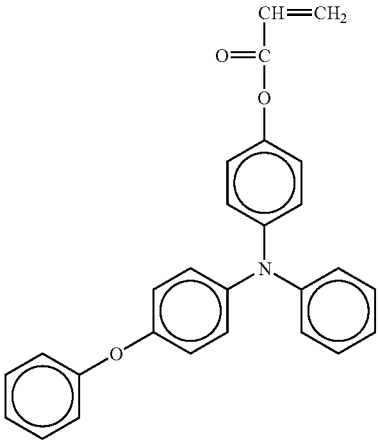
No. 18
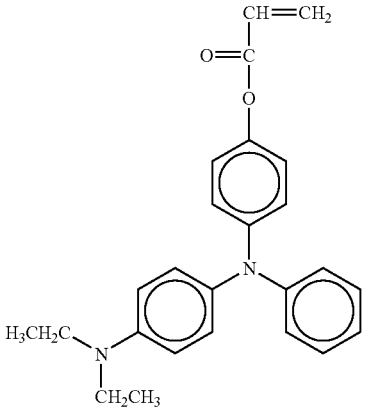
No. 19
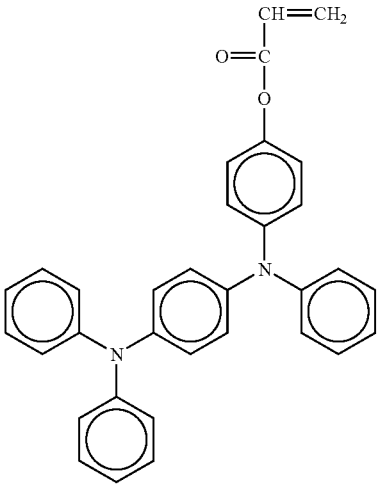
-continued
No. 20
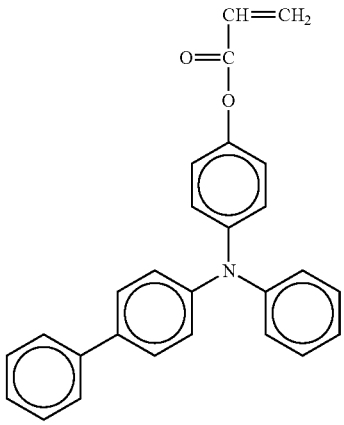
No. 21
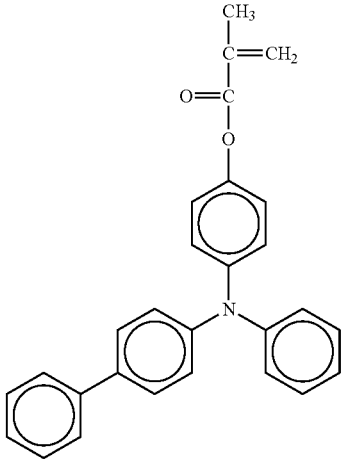
No. 22
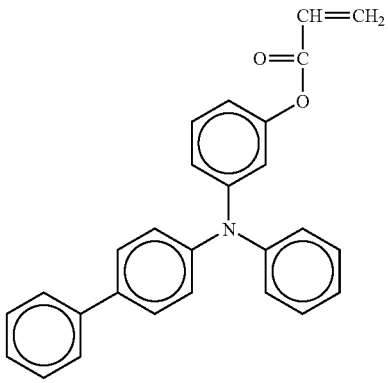

-continued
No. 23
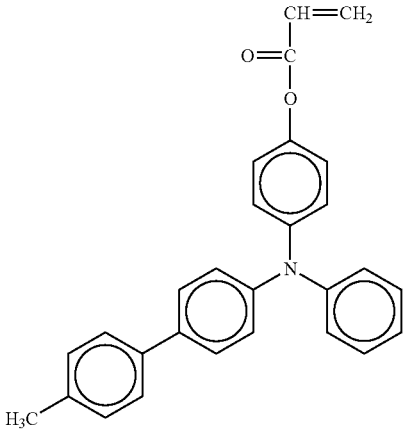
No. 24
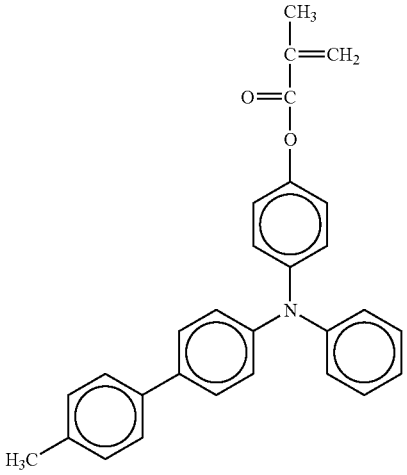
No. 25
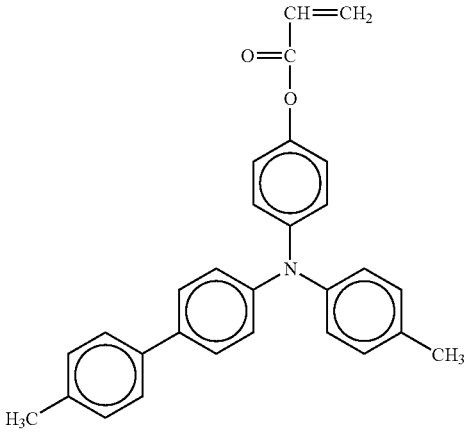
-continued
No. 26
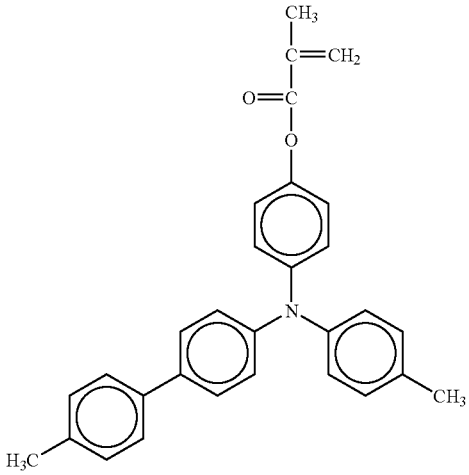
No. 27
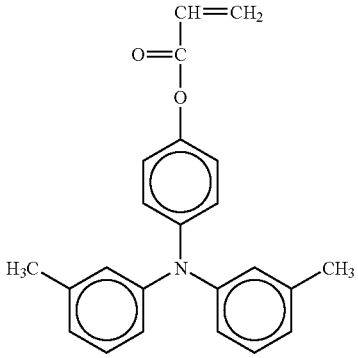
No. 28
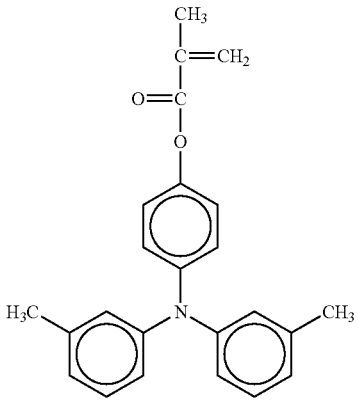

-continued
No. 29
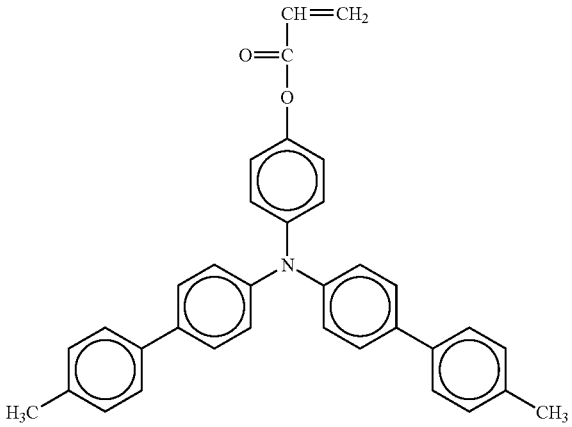
No. 30
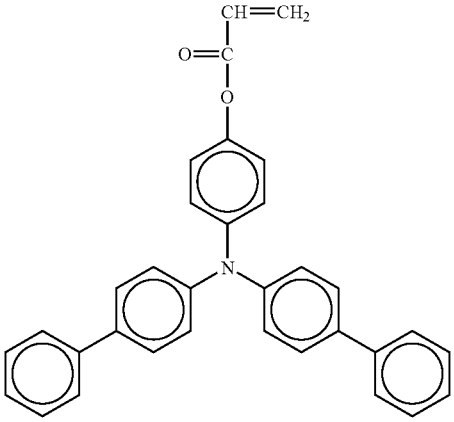
No. 31
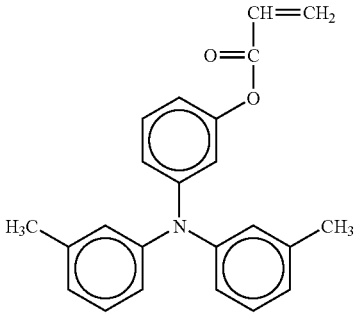
No. 32
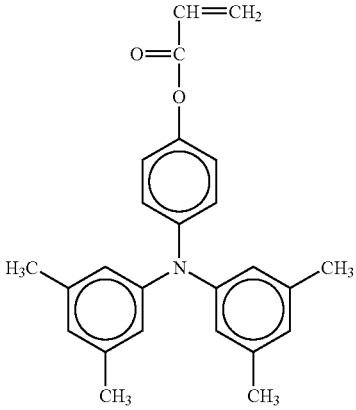
-continued
No. 33
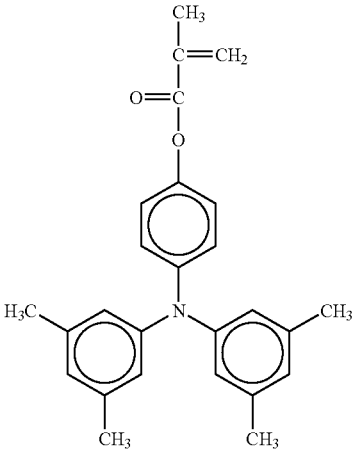
No. 34
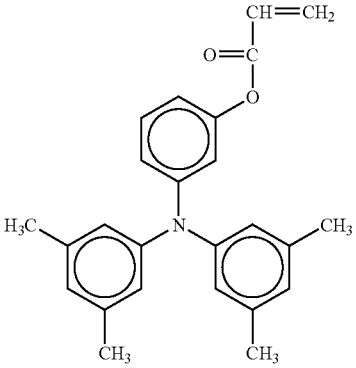
No. 35
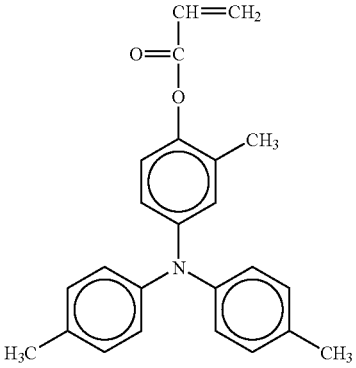
No. 36
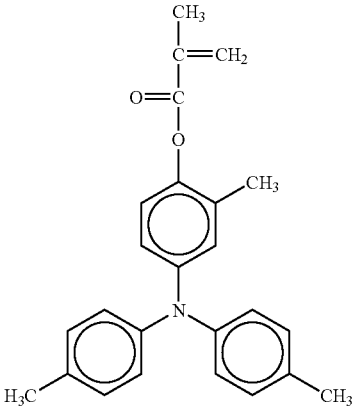

-continued
No. 37
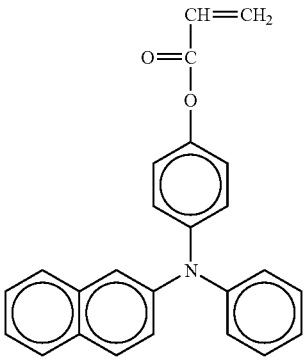
No. 38
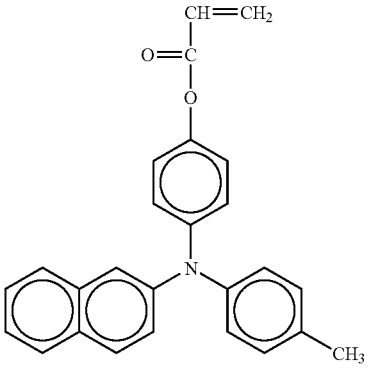
No. 39
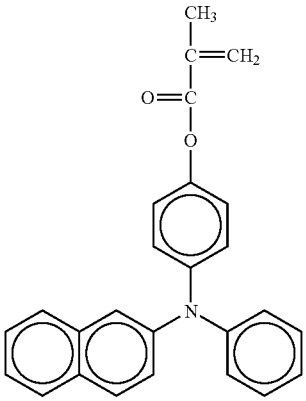
No. 40
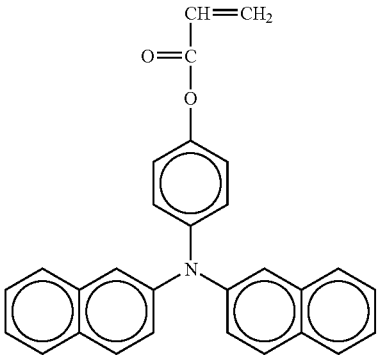
-continued
No. 41
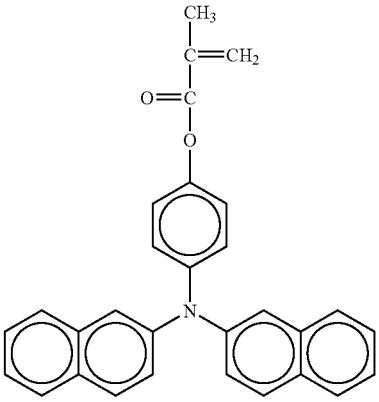
No. 42
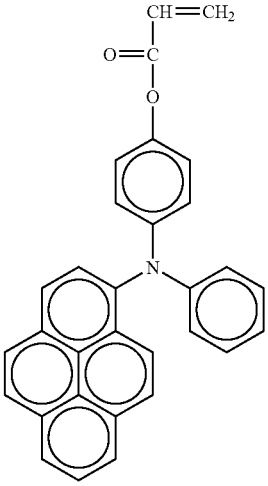
No. 43
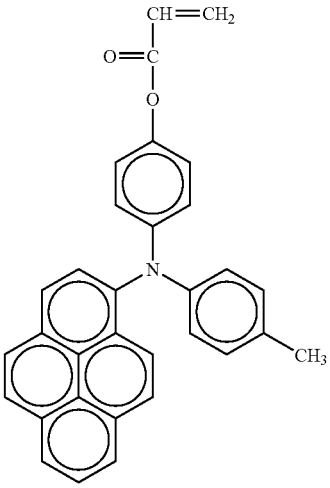

-continued
No. 44
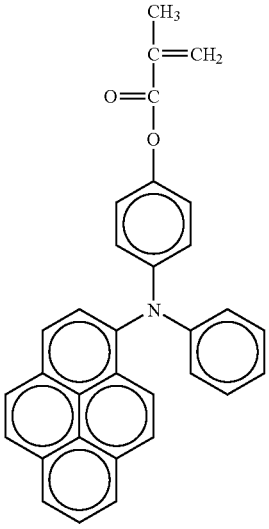
No. 45
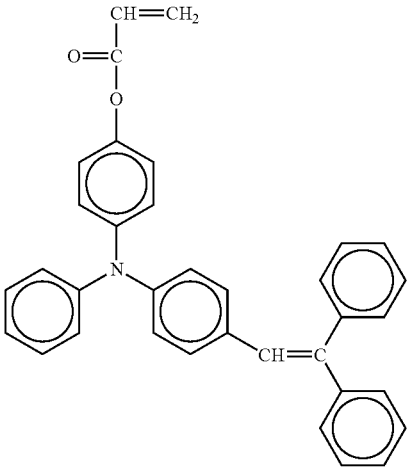
No. 46
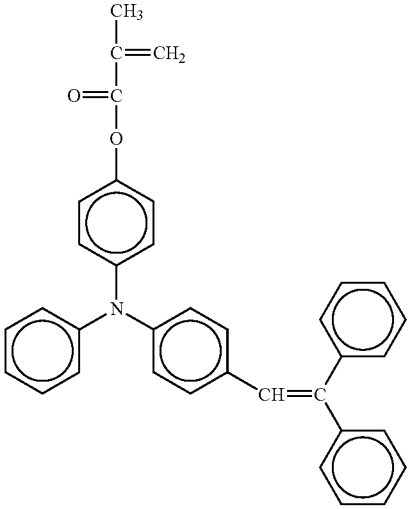
-continued
No. 47
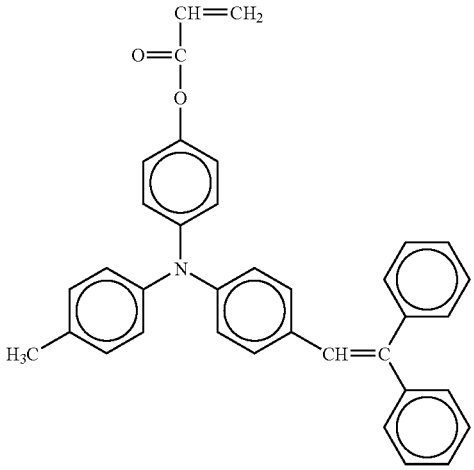
No. 48
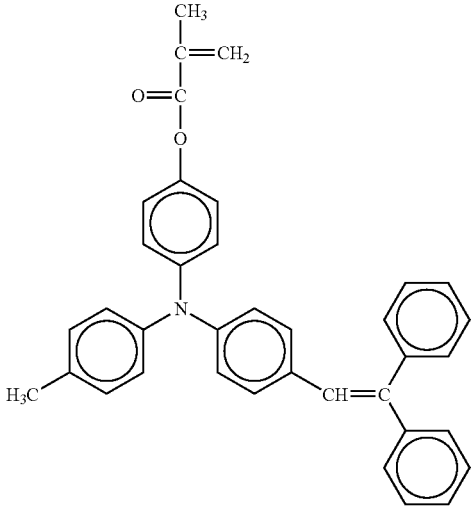
No. 49
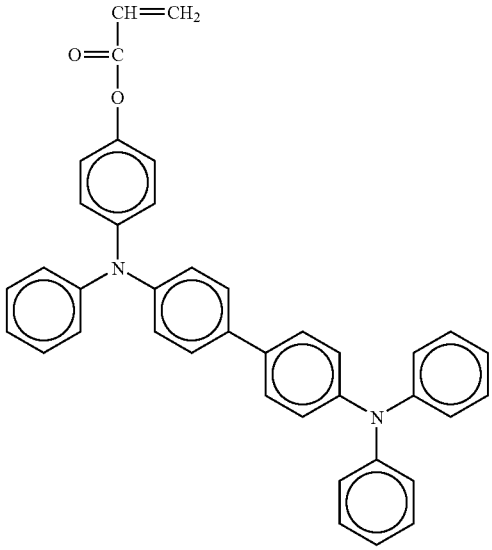

-continued
No. 50
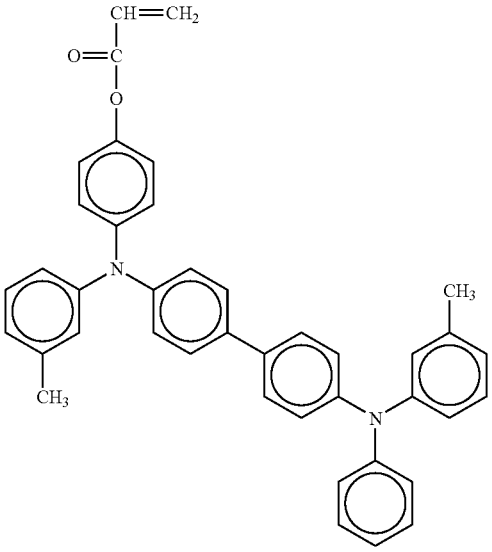
No. 51
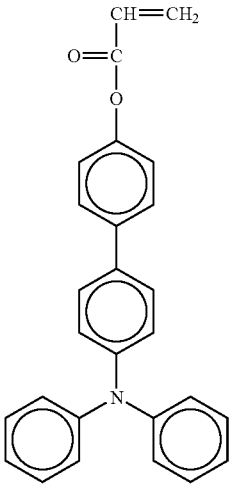
No. 52
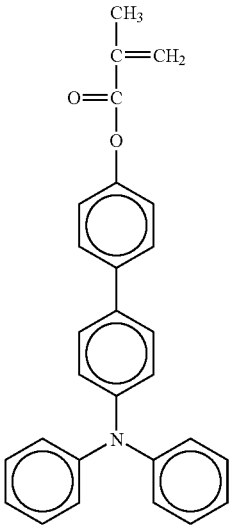
-continued
No. 53
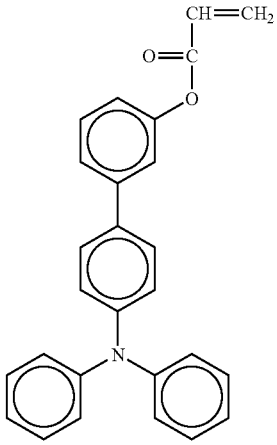
No. 54
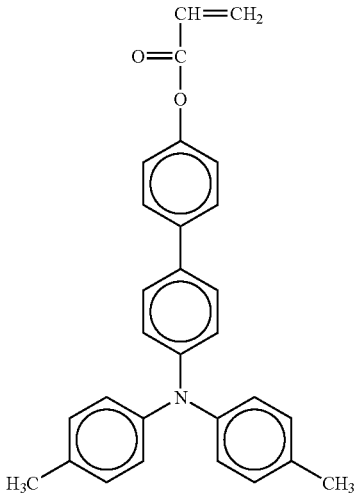
No. 55
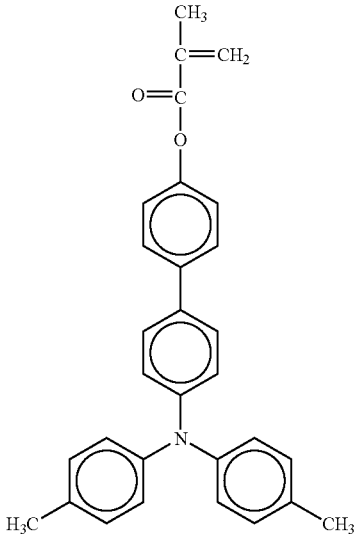

-continued
No. 56
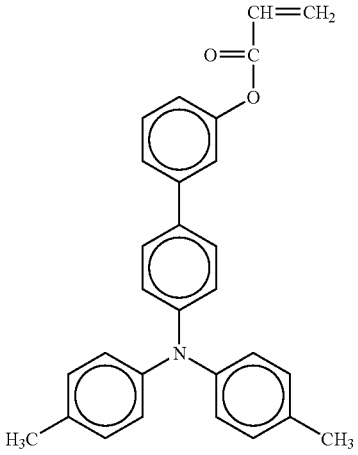
No. 57
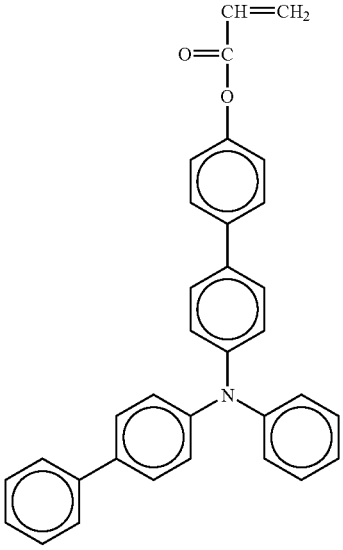
No. 58
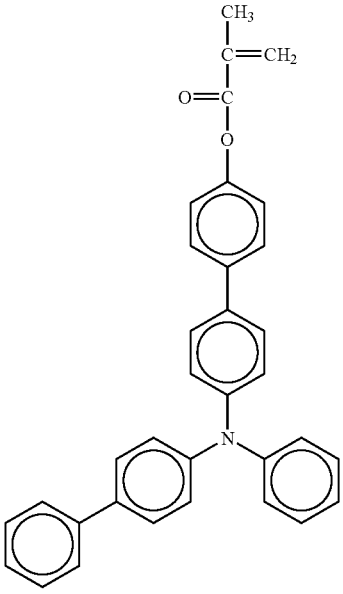
-continued
No. 59
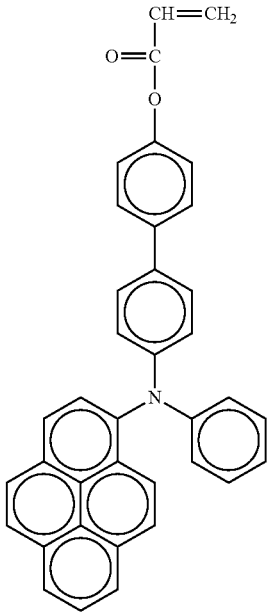
No. 60
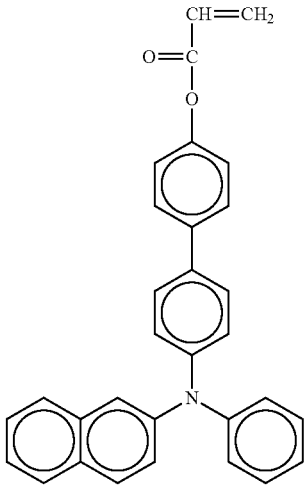
No. 61
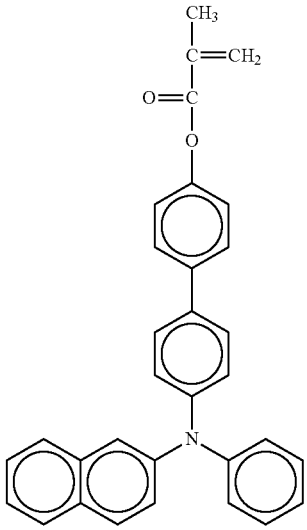

-continued
No. 62
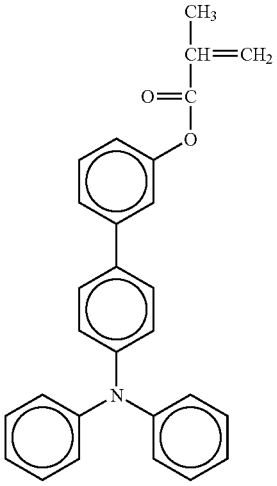
No. 63
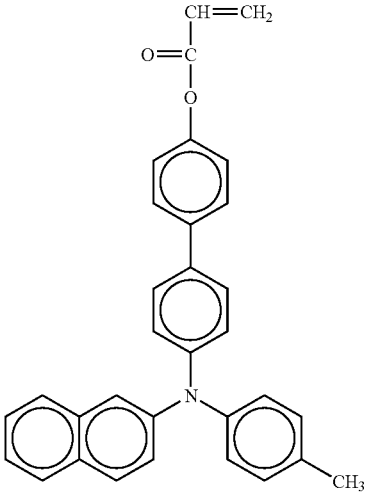
No. 64
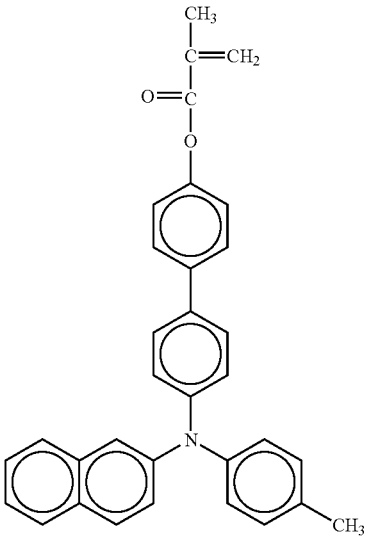
-continued
No. 65
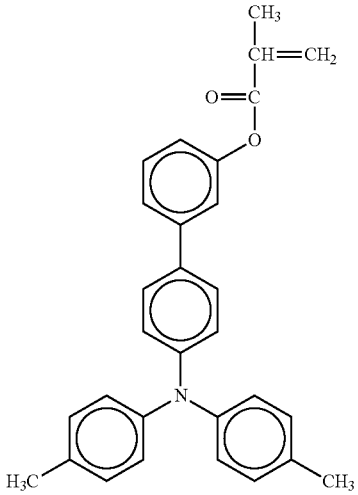
No. 66
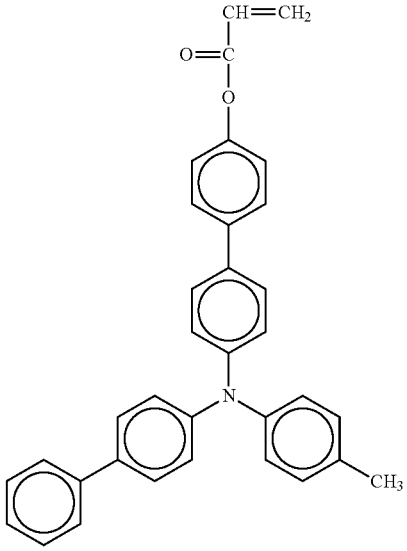
No. 67
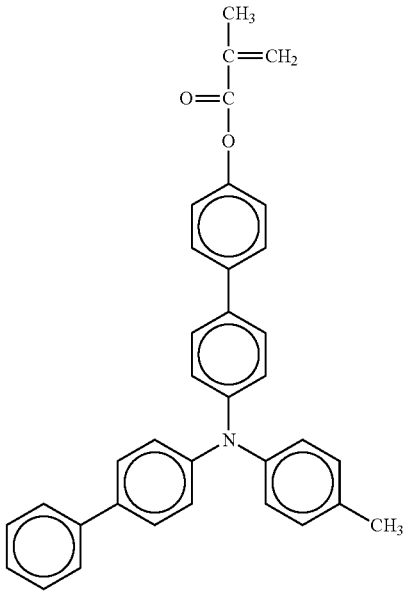

-continued
No. 68
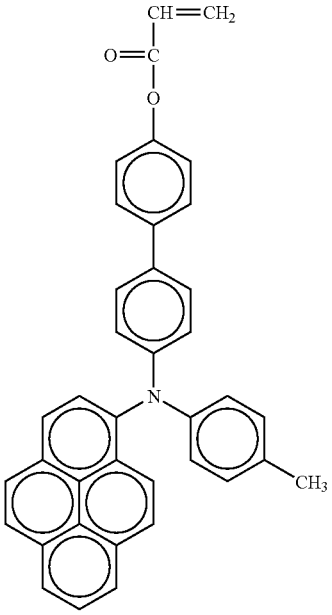
-continued
No. 70
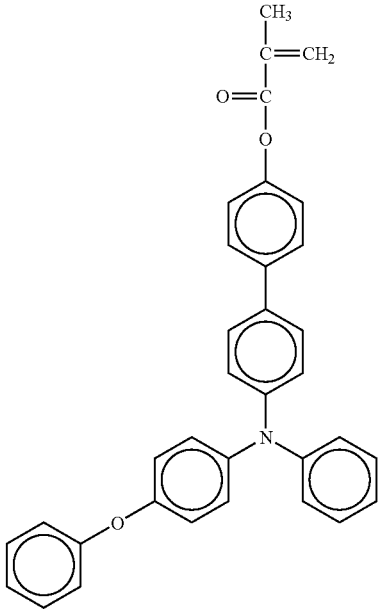
No. 69
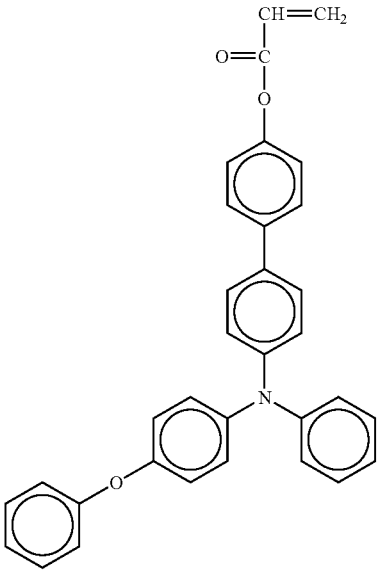
No. 71
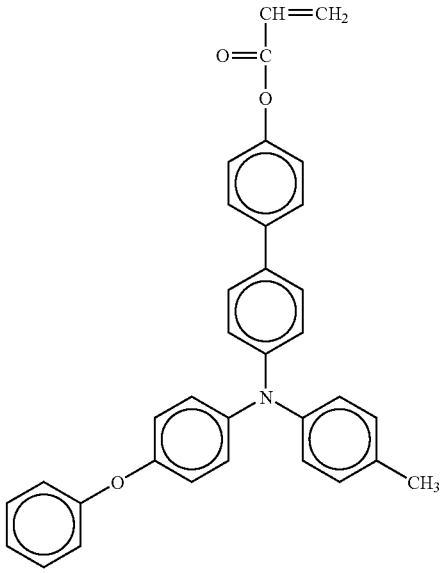

-continued
No. 72
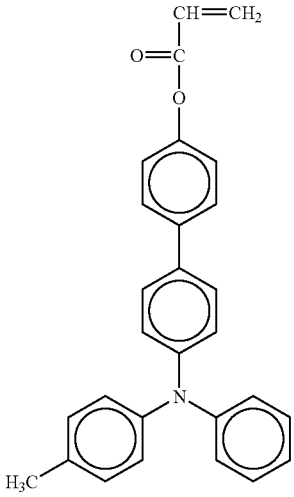
No. 73
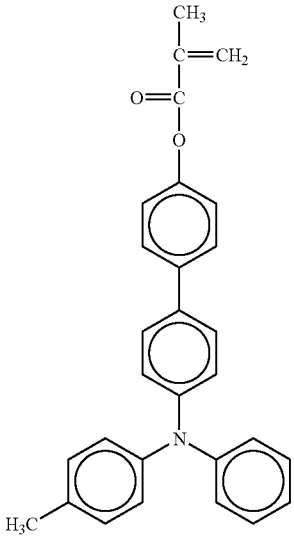
No. 74
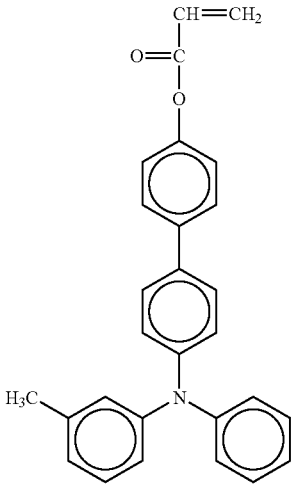
-continued
No. 75
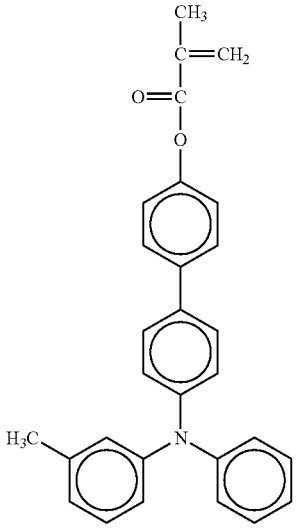
No. 76
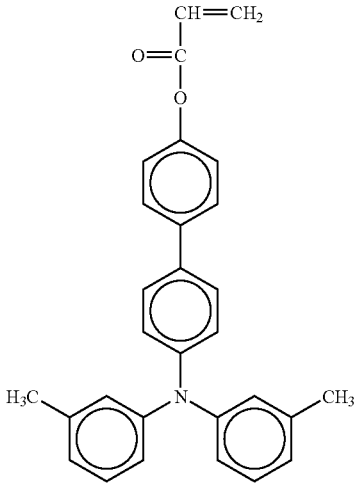
No. 77
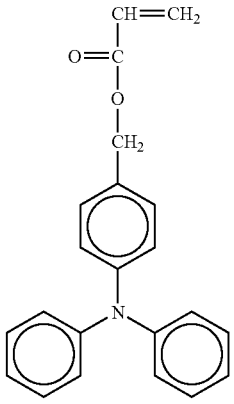

-continued
No. 78
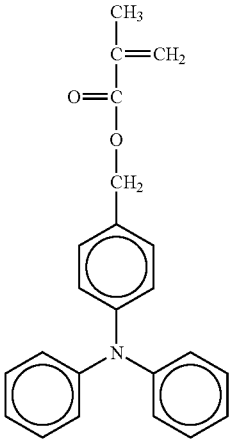
No. 79
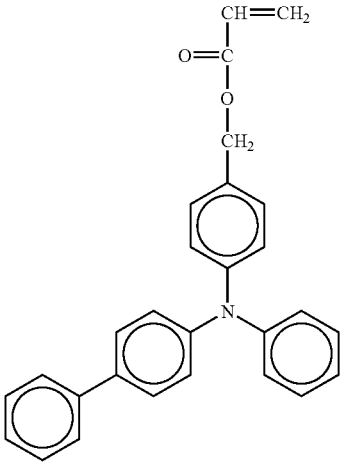
No. 80
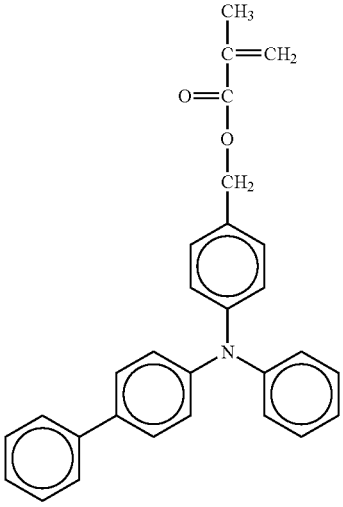
-continued
No. 81
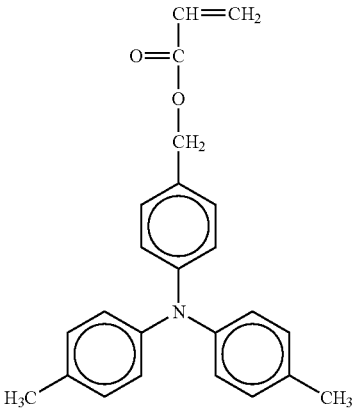
No. 82
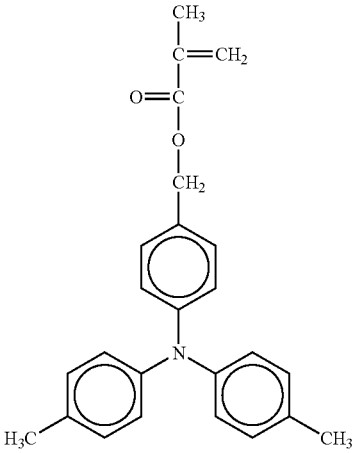
No. 83
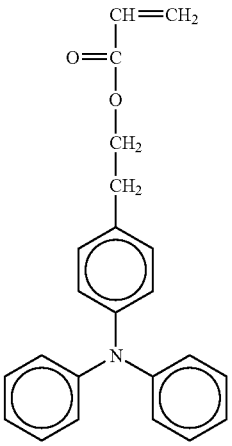

-continued
No. 84
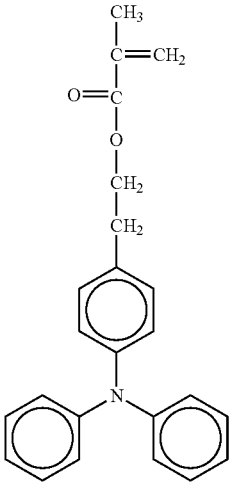
No. 85
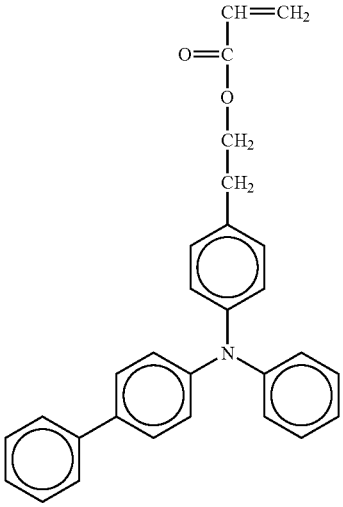
No. 86
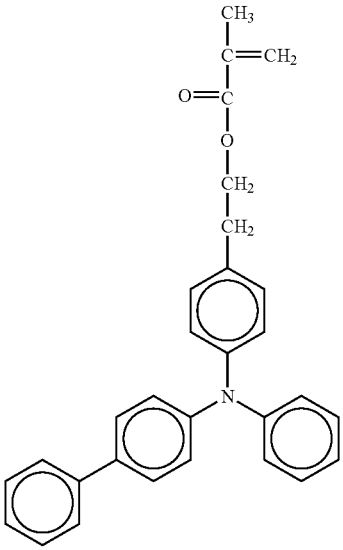
-continued
No. 87
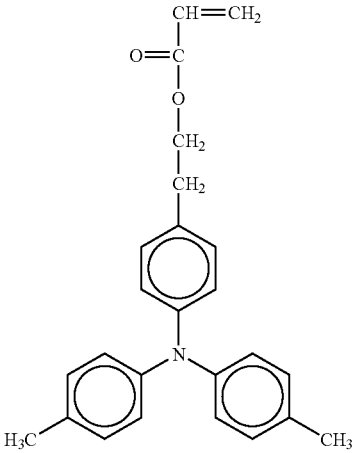
No. 88
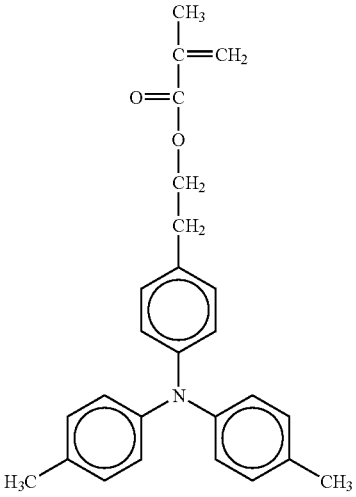
No. 89
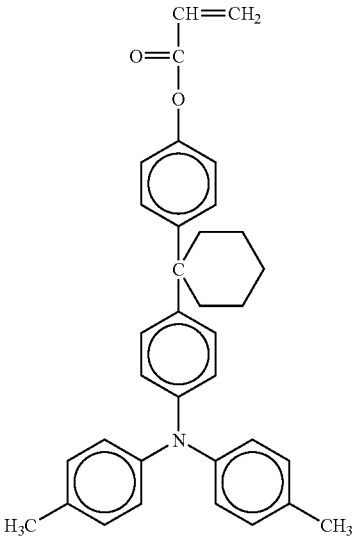

-continued
No. 90
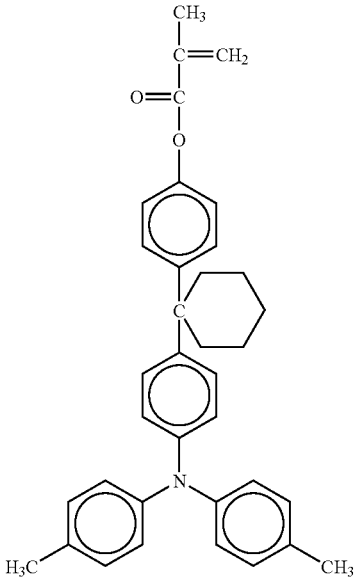
-continued
No. 92
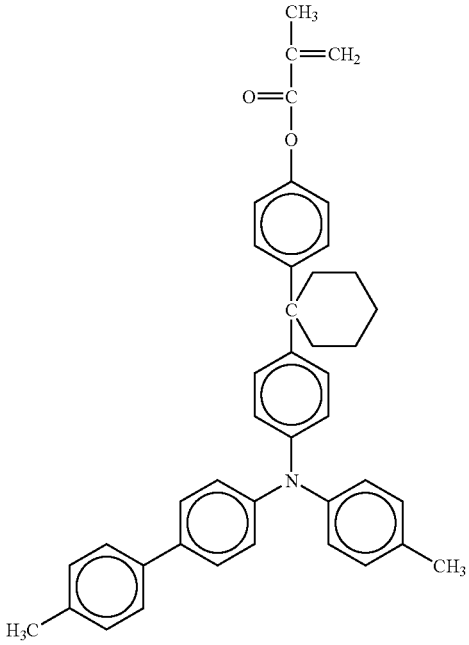
No. 91
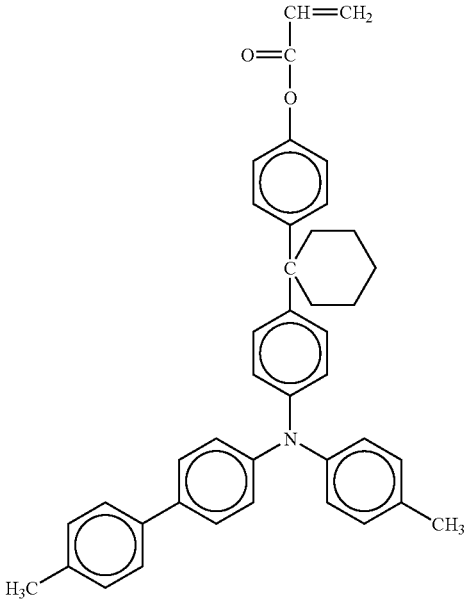
No. 93
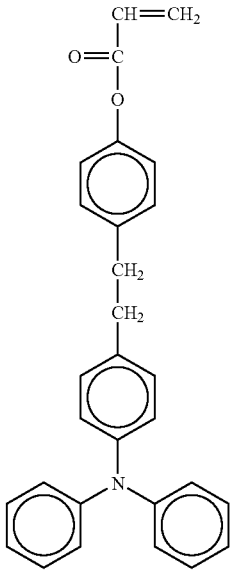

-continued
No. 94
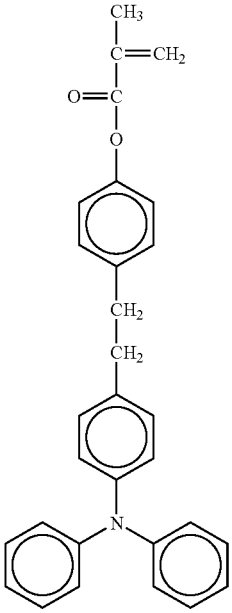
-continued
No. 96
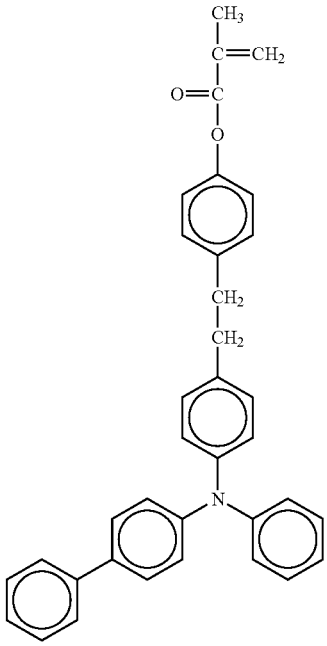
No. 95
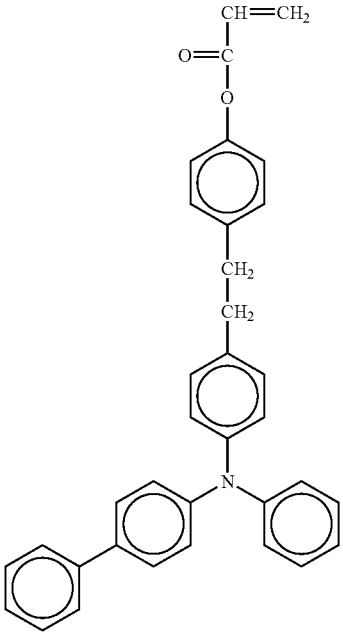
No. 97
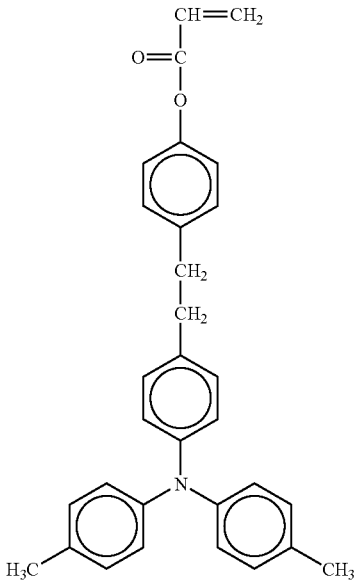

-continued
No. 98
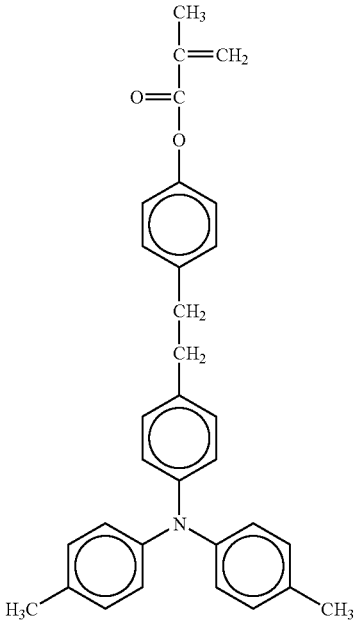
-continued
No. 100
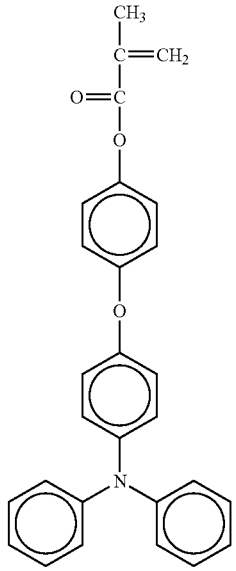
No. 99
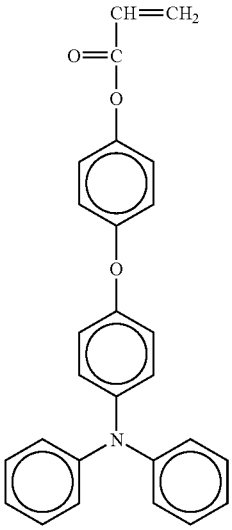
No. 101
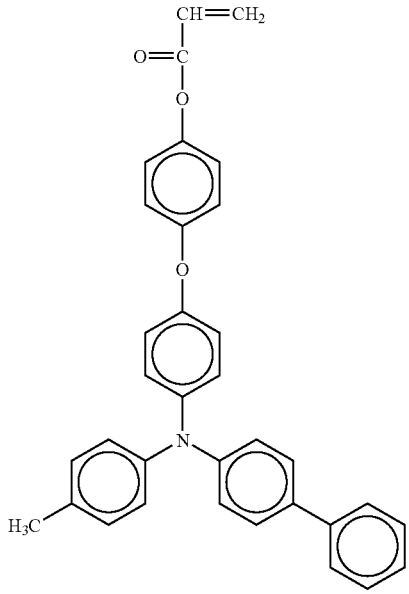

-continued
No. 102
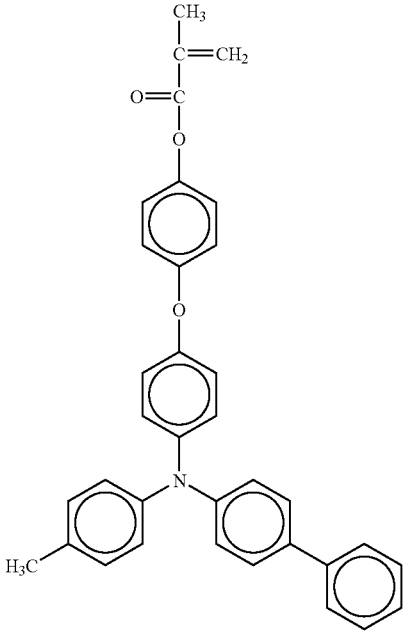
-continued
No. 104
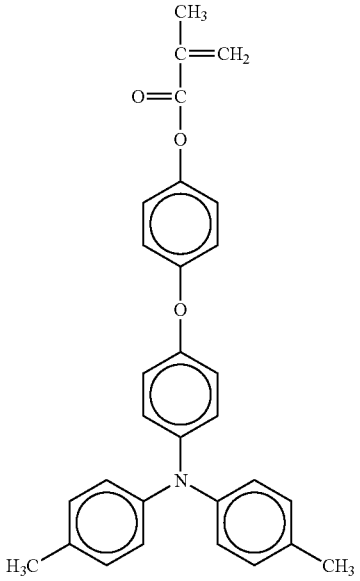
No. 103
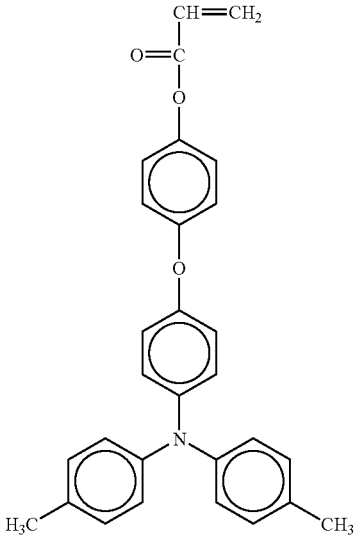
No. 105
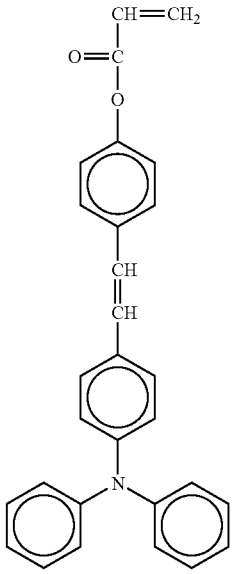

-continued
No. 106
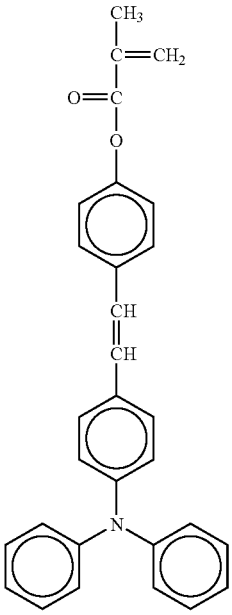
-continued
No. 108
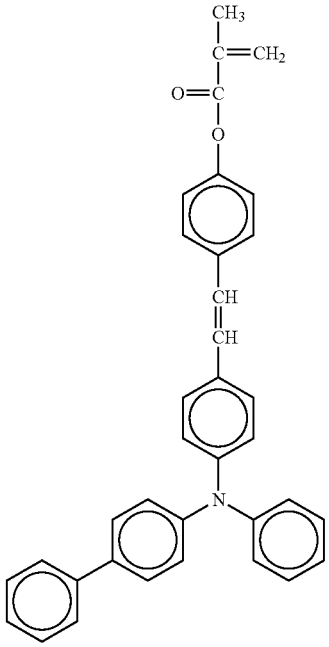
No. 107
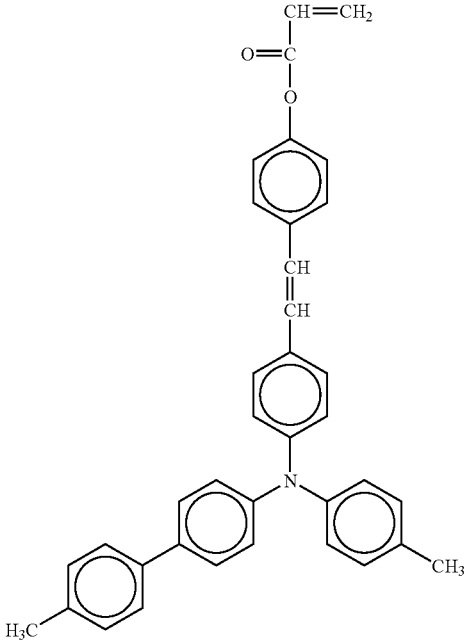
No. 109
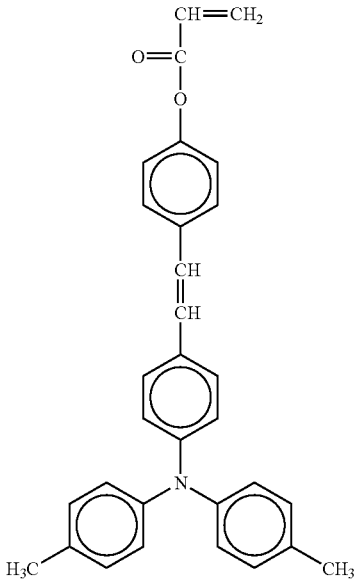

-continued
No. 110
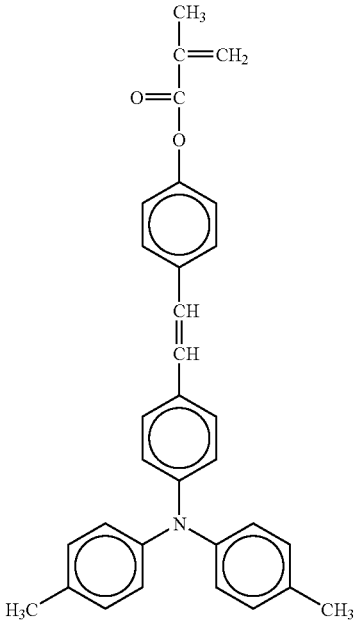
No. 111
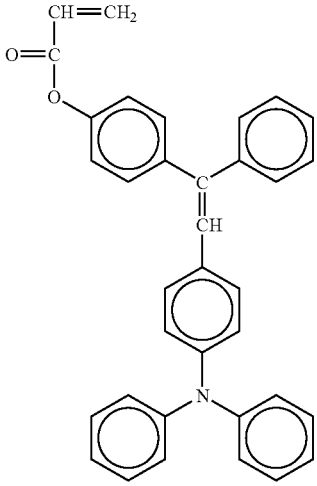
No. 112
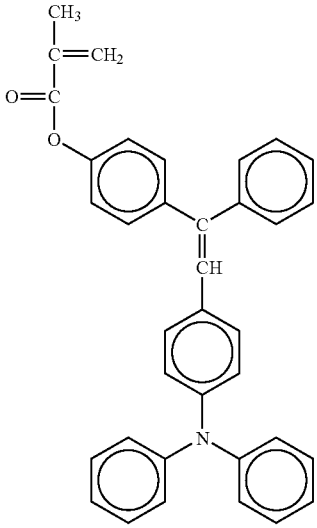
-continued
No. 113
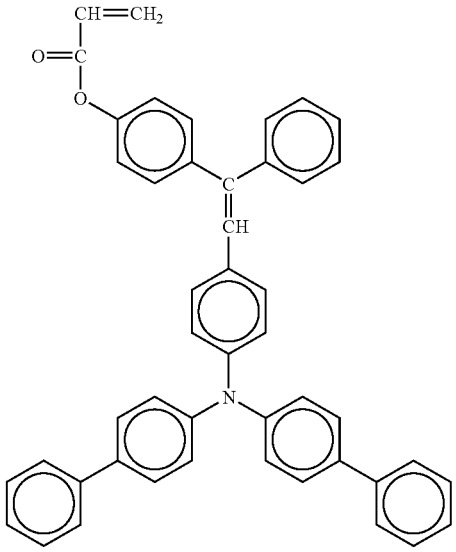
No. 114
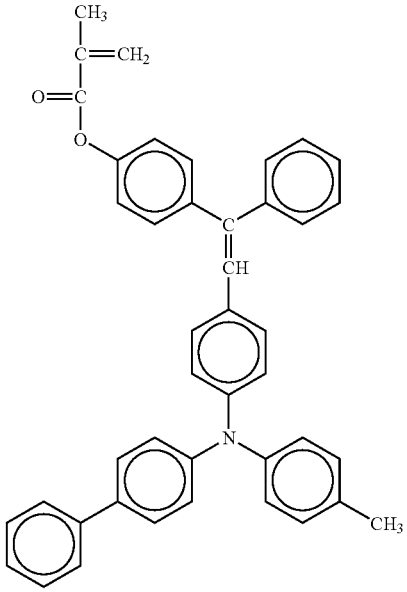
No. 115
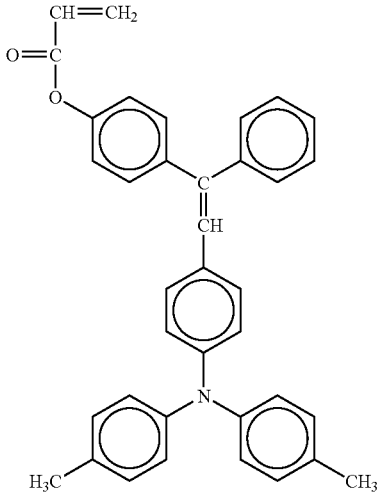

-continued
No. 116
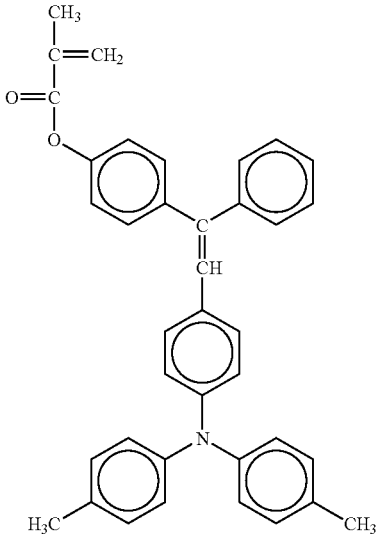
-continued
No. 118
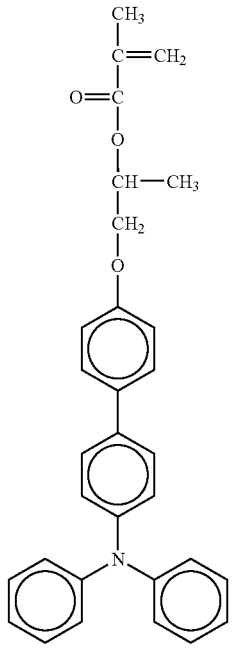
No. 117
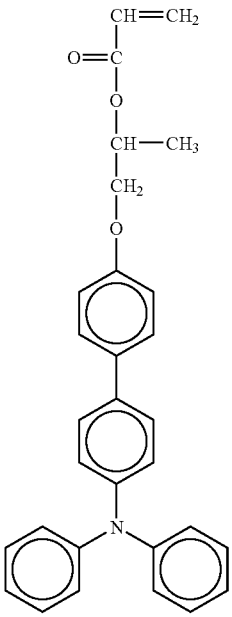
No. 119
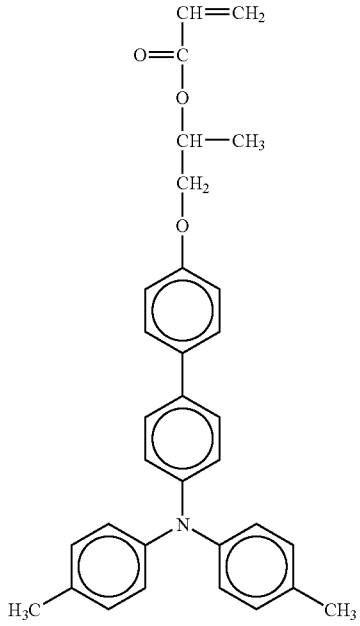

-continued
No. 120
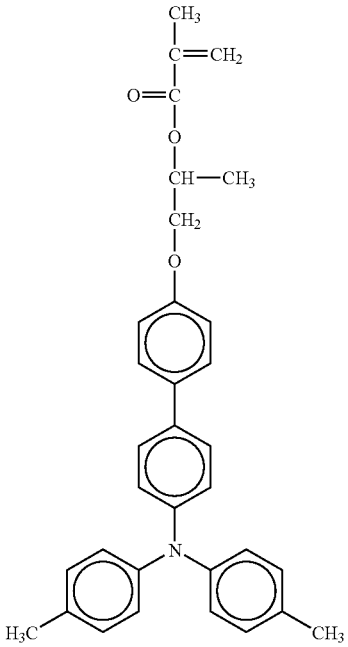
-continued
No. 122
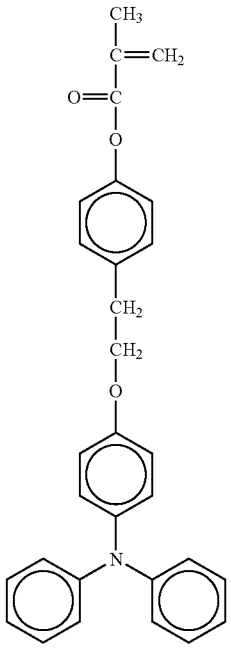
No. 121
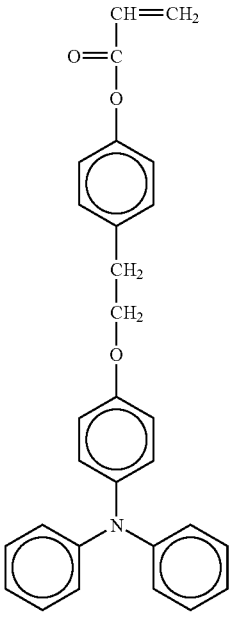
No. 123
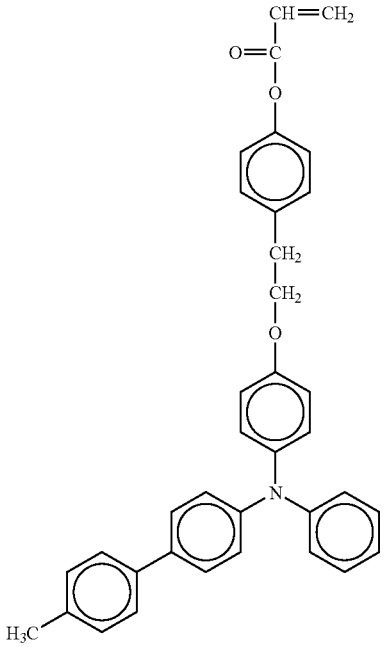

-continued
No. 124
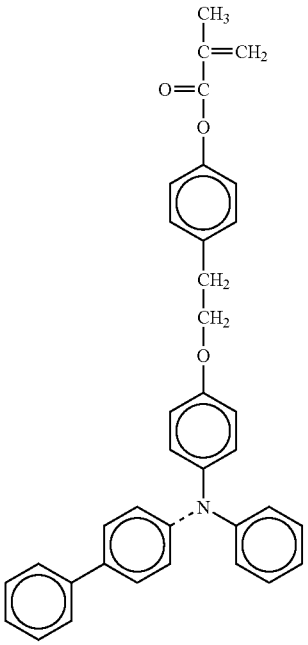
No. 125
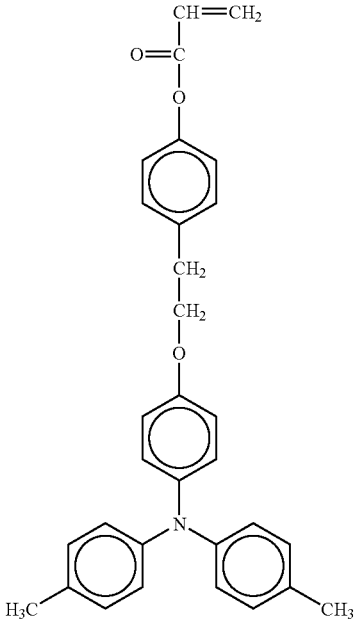
-continued
No. 126
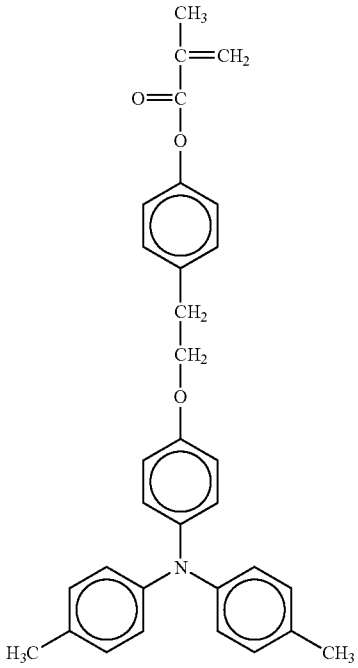
No. 127
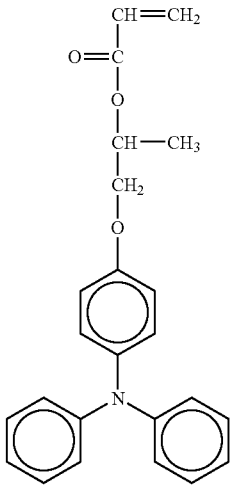

-continued
No. 128
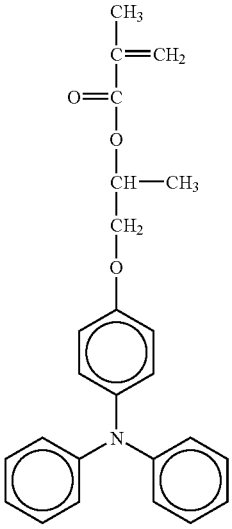
No. 129
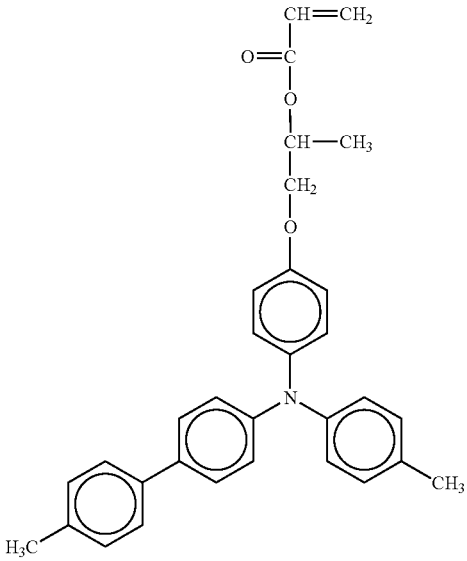
-continued
No. 130
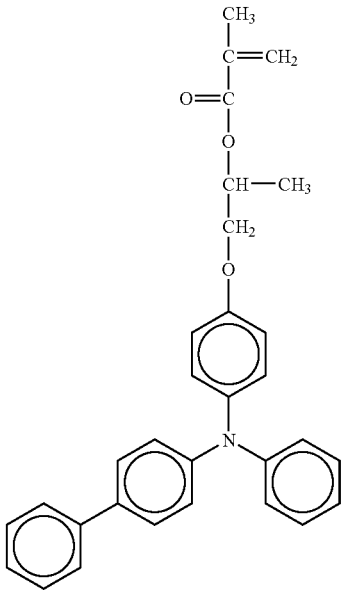
No. 131
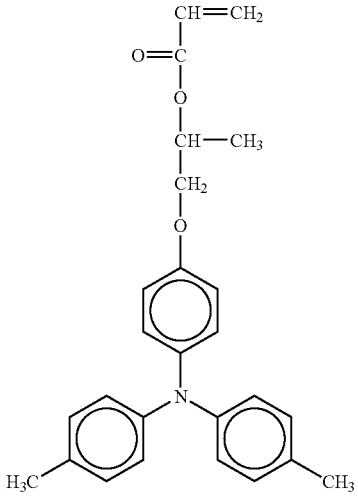
No. 132
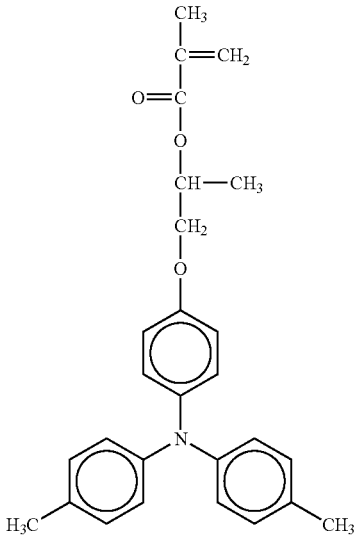

-continued
No. 133
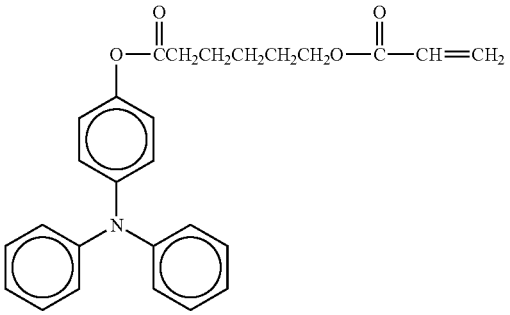
No. 134
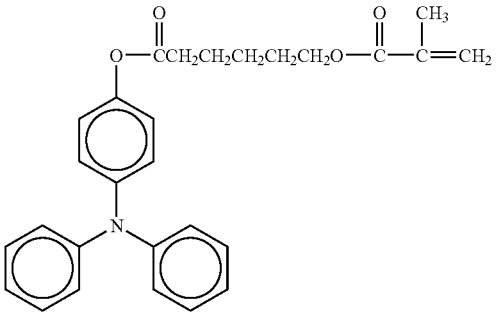
No. 135
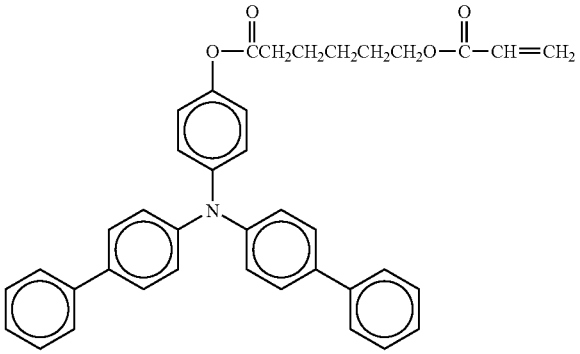
No. 136
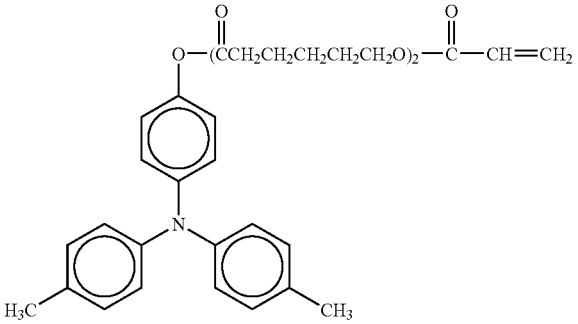
-continued
No. 137
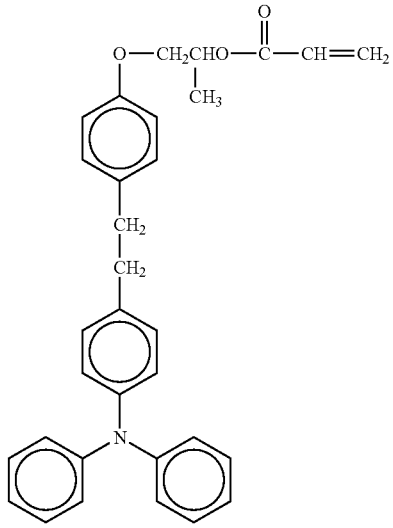
No. 138
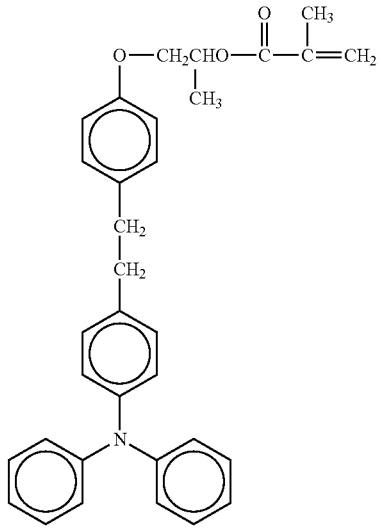

-continued
No. 139
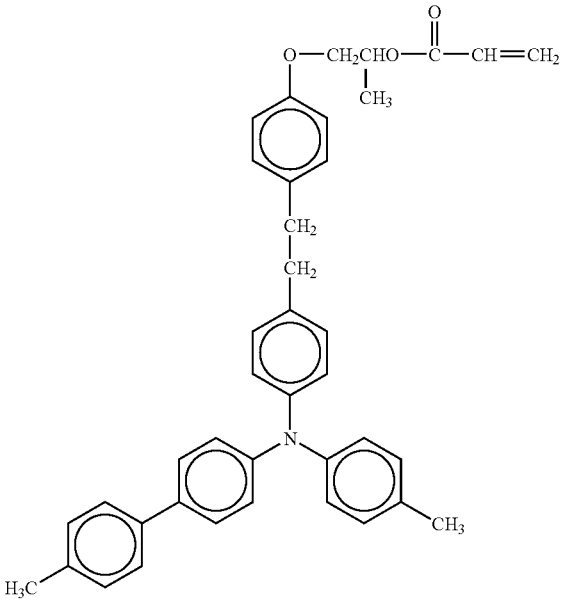
No. 140
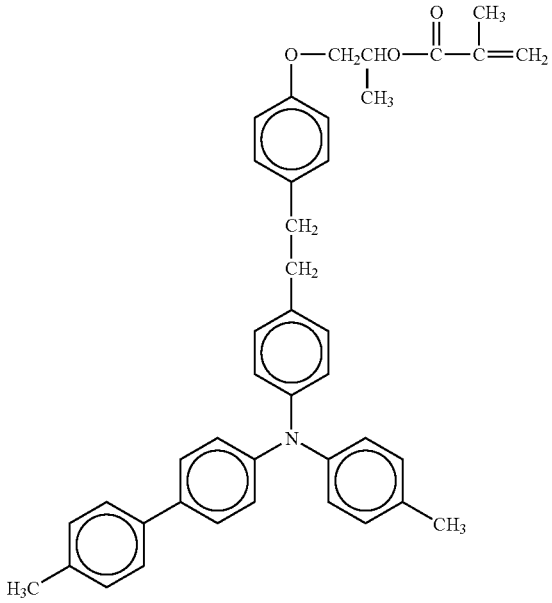
-continued
No. 141
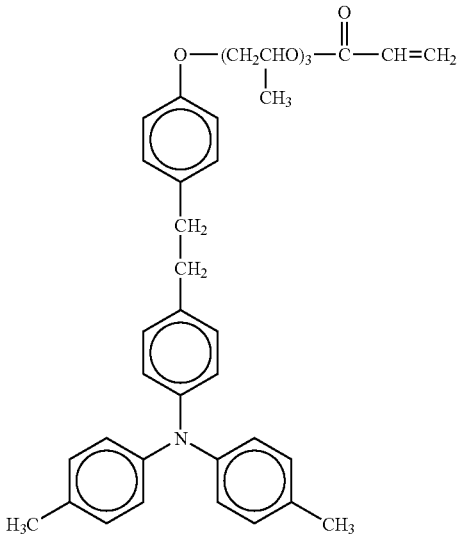
No. 142
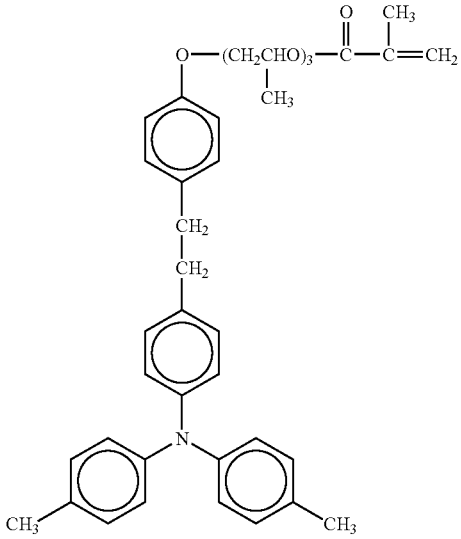
No. 143
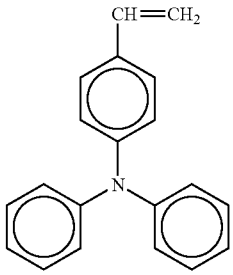

-continued
No. 144
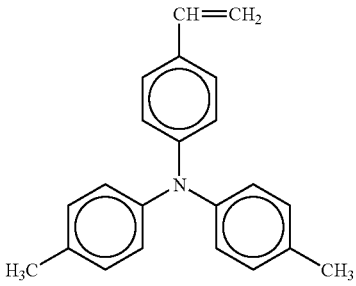
No. 145
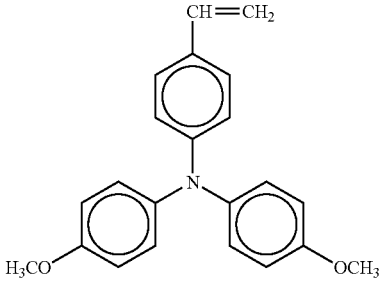
No. 146
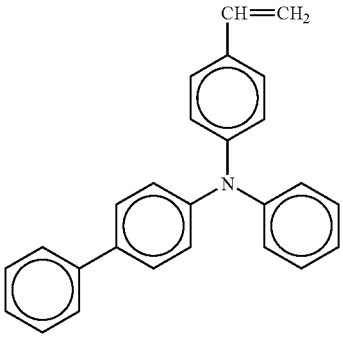
No. 147
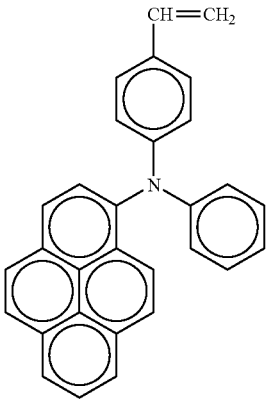
No. 148
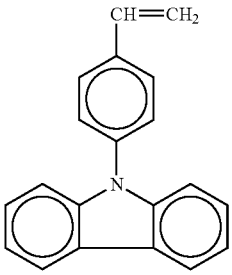
-continued
No. 149
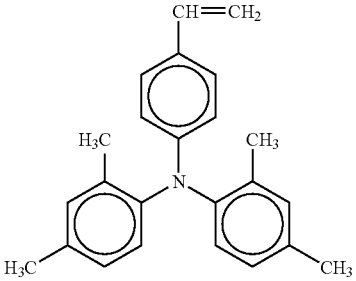
No. 150
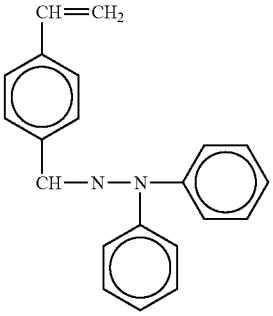
No. 151
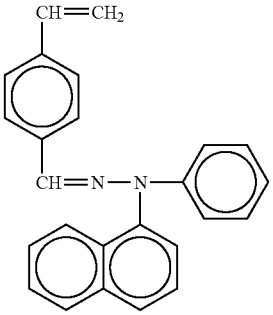
No. 152
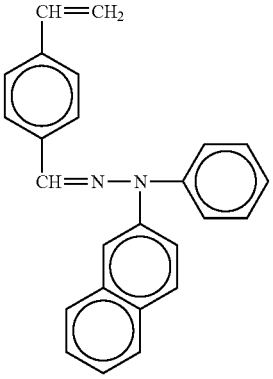
No. 153
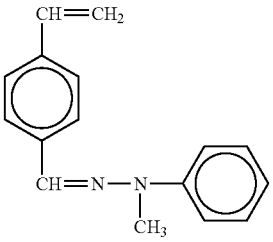

-continued

No. 154

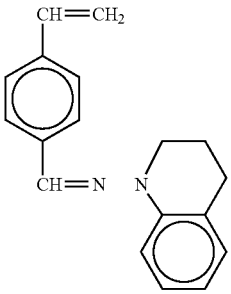

No. 155

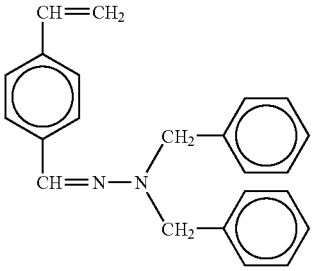

No. 156

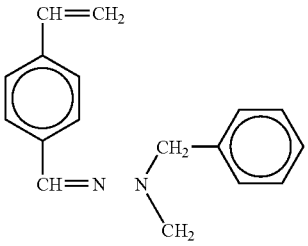

No. 157

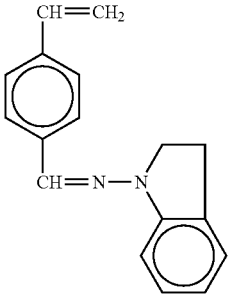

No. 158

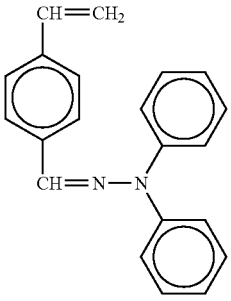

-continued

No. 159

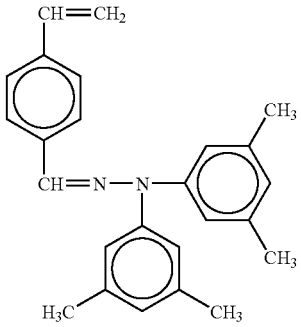

No. 160

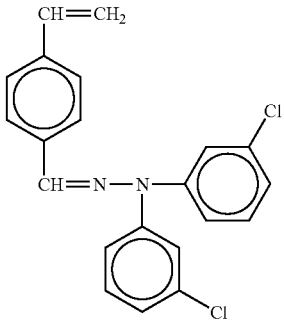

In addition, the polymerizable monomer having a charge transport structure imparts a charge transport power to the protection layer, and the content ratio of the polymerizable monomer having a charge transport structure is from 20 to 80% by weight, and preferably from 30 to 70% by weight based on the total weight of the protection layer.

A content of the polymerizable compound having a charge transport structure that is excessively small easily invites an insufficient charge transport power of the protection layer, which causes deterioration of electrostatic characteristics such as sensitivity, and a rise of the residual voltage over repetitive use.

A content of the radical polymerizable compound having a charge transport structure that is excessively large easily leads to reduction of the content of the compound having no charge transport structure. This easily leads to reduction of the cross linking density, which prevents demonstration of a high abrasion resistance.

Desired electrostatic characteristics and abrasion resistance vary depending on the process used. Therefore, it is difficult to jump to any conclusion but considering the balance of both, the range of from 30 to 70% by weight is most preferred.

The polymerizable compound having a charge transport structure is not isolated because it is cured. Even though the polymerizable compound is not isolated, the charge transport structure is quantified using a method such as FT-IR and thus can be used as the density ratio among the charge transport materials for use in the present invention.

As described above, a resin formed by curing a polymerizable compound having 3 or more functional groups with no charge transport structure and a polymerizable compound having one functional groups with a charge transport structure is particularly preferable. However, a polymerizable compound having one or two functional groups can be also suitably used, and is significantly effective depending on materials.

Any known polymerizable compounds can be used.

Specific examples of such radical monomers having one functional group include, but are not limited to, 2-ethyl hexyl acrylate, 2-hydroxy ethyl acrylate, 2-hydroxy propyl acrylate, tetrahydroflufrylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the polymerizable divalent functional groups include, but are not limited to 1,3-butane diol acrylate, 1,4-butane diol acrylate, 1,4-butane diol dimethacrylate, 1,6-hexane diol diacrylate, 1,6-hexane diol dimethaacrylate, diethylene glycol diacrylate, neopentyl glycol diacrylate, bisphenol A-EO modified diacrylate, bisphenol F-EO modified diacrylate, and neopentyl glycol diacrylate.

Specific examples of such functional monomers include, but are not limited to, a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; a vinyl monomer, an acrylate or a methacrylate having a polysiloxane group such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl with a siloxane repeating unit of 20 to 70 described in examined published Japanese patent applications Nos. (hereinafter referred to as JPP) H05-60503 and H06-45770.

Specific examples of the polymerizable oligomers include, but are not limited to, an epoxy acrylate based oligomer, a urethane acrylate based oligomer, and a polyester acrylate based oligomer.

In addition, a polymerization initiator can be optionally added to the liquid application for the protection layer to accelerate the curing reaction.

Specific examples of the thermal polymerization initiators include, but are not limited to, a peroxide based initiator such as 2,5-dimethyl hexane-2,5-dihydroperoxide, dicumyl peroxide, benzoyl peroxide, t-butylcumyl peroxide, 2,5-dimethyl-2,5-di(peroxybenzoyl)hexine-3, di-t-butyl beroxide, t-butylhydro beroxide, cumenehydro beroxide, lauroyl peroxide, and 2,2-bis(4,4-di-t-butylperoxydicyclohexy)propane; and an azo based initiator such as azobis isobutyl nitrile, azobis cyalohexane carbonitrile, azobis iso methyl butyric acid, azobis isobutyl amidine hydrochloride, and 4,4'-azobis-4-cyano valeric acid.

Specific examples of photopolymerization initiators include, but are not limited to, an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethylpentyl phosphine oxide, a methylphenyl glyoxy ester, 9,10-phenanthrene, an acridine based compound, a triadine based compound and an imidazole based compound.

In addition, a compound having an acceleration effect on photopolymerization can be used alone or in combination with the photopolymerization initiator.

Specific examples of such compounds include, but are not limited to, triethanolamine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

These polymerization initiators can be used alone or in combination.

The content of such a polymerization initiator is from 0.5 to 40 parts by weight and preferably from 1 to 20 parts by weight based on 100 parts by weight of the compound having a polymerization property.

Furthermore, the liquid application for use in formation of the protection layer for use in the present invention optionally includes additives such as various kinds of plasticizers (for relaxing internal stress or improving adhesiveness), a leveling agent, an anti-oxidizer, a light stabilizer, and an ultraviolet absorber.

Known additives can be used as these additives. A typical resin such as dibutylphthalate and dioctyl phthalate can be used as the plasticizer. The content thereof is not greater than 20% by weight and preferably not greater than 10% based on the total solid portion of the liquid application.

Silicone oils such as dimethyl silicone oil, methyl phenyl silicone oil and a polymer or an oligomer having a perfluoroalkyl group in its side chain can be used as the leveling agent. The content thereof is suitably not greater than 3% by weight based on the total solid portion of the liquid application. In addition, the additives of the antioxidizer, the light stabilizers, and the ultraviolet absorber include known antioxidizers, light stabilizers, and ultraviolet absorbers such as phenol based compounds, hindered phenol based compounds, hindered amine based compounds, paraphenylene diamines, hydroquinones, organic sulfur compounds, organic phosphorine compounds, benzophenones, salicylates, benzotriazoles, and quenchers (metal complex salts).

The protection layer for use in the present invention is formed by coating and curing a liquid application containing the filler and the polymerizable compound having a charge transport structure and the polymerizable compound having no charge transport structure described above on the charge transport layer described above.

When a liquid polymerizable compound is used for the liquid application, other components are possibly dissolved in the liquid before application. Optionally, the liquid application is diluted by a suitable solvent before coating.

The liquid application for the protection layer for use in the present invention contains a filler, a polycarbonate compound, a polymerizable compound having a charge transport structure, a polymerizable compound having no charge transport structure, and cyclopentanone. However, the organic solvent contained in the liquid application for the protection layer is not necessarily simple cyclopentanone. A mixture of cyclopentanone and an organic solvent having a boiling point of 100° C. or lower is rather preferable. Any organic solvent for use in the mixture that has a boiling point of 100° C. or lower is preferably used. Among these, tetrahydrofuran is most preferable. The liquid application is preferably prepared by dispersing the filler by using the filler, a polycarboxylic acid compound, and cyclopentanone, and mixing and stirring the resultant millbase with a solvent containing a polymerizable compound having a charge transport structure, a polymerizable compound having no charge transport structure and tetrahydrofuran. The additives described above such as the leveling agent, the antioxidizer, the light stabilizer, and the ultraviolet absorber are preferably contained in the solution containing a polymerizable compound having a charge transport structure, and a polymerizable compound having no charge transport structure.

There is no specific limit to the ratio of cyclopentanone to all the solvent contained in the liquid application for the protection layer.

Cyclopentanone is preferably contained in a relatively large amount when it is not used during the dispersion of the filler. However, when cyclopentanone is used as a dispersion medium for the filler, an extremely small amount of cyclopentanone is effective and preferable and thus increasing the amount thereof does not make a difference. The content ratio of cyclopentanone is preferably from 0.1 to 20% by weight and more preferably from 0.5 to 10% by weight based on the entire solvent for the liquid application for the protection layer. A content ratio that is too small tends to invite deterioration of the dispersion property and sedimentation property of the filler, degrade the layer quality of the surface of the protection layer, and have an adverse impact on peeling-off of the protection layer. A content ratio that is too large tends to invite an increase in the amount of the residual solvent in the protection layer and a rise of the residual voltage.

Any known method can be used in the filler dispersion process for use in the present invention as long as it is good to improve the dispersion property and the dispersion stability of the filler. As described above, the liquid application is preferably prepared by dispersing the filler by using the filler, a polycarboxylic acid compound, and cyclopentanone, and mixing and stirring the resultant millbase with a solvent containing at least a polymerizable compound having a charge transport structure, a polymerizable compound having no charge transport structure and tetrahydrofuran.

The mill base is prepared by a known method using a ball mill, an attritor, a sand mill, a bead mill, or ultrasonic and using a ball mill is particularly preferable in the present invention. The ball mill is preferable in terms that the polycarboxylic acid compound is absorbed on the surface of the filler at the same time with the pulverization of the agglomerated filler. In addition, the method of using a ball mil is suitable to improve the dispersion property and the dispersion stability of the filler, reduce the residual voltage and the potential at irradiated portions, and improve the layer quality.

Materials such as zirconia, alumina, glass, metal, etc, are used as the dispersion media for use in the dispersion. In the present invention, zirconia balls or alumina balls are preferable and alumina balls are most preferable. Alumina balls are excellent in terms of the dispersion property and a good impact on the electrostatic characteristics, particularly reduction on the residual voltage among the electrostatic characteristics. In addition, among the alumina balls, alumina balls having a purity of 99% or higher are more preferable. Abrasion powder is mixed into the dispersion media during dispersion but the amount of powder mixed thereinto can be reduced to 1/10 when alumina balls having a purity of 99% or higher are used instead of alumina balls having a purity of less than 99%. In addition, since the amount of impurities caonrtiend in the abrasion powder is also reduced, the residual voltage and the voltage at the irradiated portion can be reduced. Furthermore the variation of the voltage at the irradiated portion is reduced with regard to the image bearing member on the whole, which leads to production of images having less image density variation.

The density of the solid portion of the liquid application for the protection layer is preferably from 10 to 50% by weight and more preferably from 15 to 40% by weight. A solid portion ratio that is too low tends to increase the amount of a residual solvent, and the elution amount of the charge transport material in the charge transport layer to the protection layer, which may inhibit the curing reaction in the protection layer. By contrast, when the solid portion ratio in the liquid application is too high, the layer quality of the protection layer tends to deteriorate or application deficiency easily occurs. Known methods such as a dip coating method, a spray coating method, a bead coating method, and a ring coating method can be used to apply a liquid application of the protection layer. To reduce the eluction amount of the charge transport material in the charge transport layer, it is preferable to reduce the amount of contained solvent and the contact time with the solvent during application formation. Therefore, a spray coating method, or a ring coating method in which the amount of application is regulated is preferable.

In the present invention, subsequent to application of the liquid application of the protection layer, the liquid applied is cured by application of external energy such as heat, light and radiation ray to form the protection layer.

Heat can be applied to the protection layer from the application surface side or the substrate side using a gas such as air and nitrogen, vapor, or various kinds of heat media, infra-red radiation and electromagnetic wave. The heating temperature is not lower than 100° C. and preferably not higher than 170° C. When the heating temperature is too low, the reaction speed tends to be slow so that the curing reaction may not be complete.

A heating temperature that is too high tends to cause non-uniform curing reaction, thereby significantly distorting the inside of the protection layer and resulting in a great number of non-reacted residual groups and reaction terminated ends.

A method of heating the protection layer at a relatively low temperature, for example, lower than 100° C., followed by heating at a relatively high temperature, for example, higher than 100° C., is suitable to uniformly conduct the curing reaction.

As light energy, a UV irradiation light source such as a high pressure mercury lamp or a metal halide lamp having a main emission wavelength in the ultraviolet area is used. A visible light source can be selected depending on the absorption wavelength of a compound containing a polymerizable monomer and a photopolymerization initiator.

The irradiation light amount is preferably from 50 $mW/cm^2$ to 1,000 $mW/cm^2$. When the irradiation light amount is too small, it takes a long time to complete the curing reaction.

An irradiation light amount that is too large tends to prevent a uniform curing reaction, which results in local wrinkling on the surface of the cured protection layer and a great number of non-reacted residual groups and reaction terminated ends. In addition, rapid cross-linking increases the internal stress, which leads to cracking and peeling-off of the layer. Beams of electron can be used as the radiation ray energy. Among these forms of energies, thermal or light energy is suitably used in terms of easiness of reaction speed control and simplicity of a device.

The layer thickness of the protection layer is preferably from 1 to 9 μm, and more preferably from 2 to 5 μm. A layer thickness that is too thick tends to raise the residual voltage and degrade the sensitivity, and easily causes cracking and peeling-off of the layer. In the present invention, since the protection layer has extremely high abrasion resistance and damage resistance, and the curing reaction in the protection layer is hardly inhibited, the layer thickness of the protection layer is made to be thinner. However, a layer thickness that is too thin may lead to the deterioration of the layer quality and result in uneven cross linking reaction. Therefore, the layer thickness is preferably 1 μm or more.

The present invention is highly effective because the protection layer that forms the uppermost surface layer is cured. Curing of the protection layer is tested according to the insolubility thereof in an organic solvent. In the method of testing the solubility of the protection layer in an organic solvent, a droplet of an organic solvent that has a highly dissolution property for a polymer, such as tetrahydrofuran, and dichloromethane, is dropped onto the surface of an image bearing member and subsequent to natural drying, the change of the form of to surface of the image bearing member is observed by a stereomicroscope for determination. An image bearing member that is dissolved in an organic solvent changes such that concave portions are formed at the center portion of the droplet with the surrounding portion thereof swollen, the charge transport material precipitates, which causes clouded, and the surface swells and then is shrink, which causes wrinkle. By contrast, an image bearing member that is not dissolved in an organic solvent is free from such phenomena and remains unchanged to the droplet of the organic solvent.

Next, the case in which urethane resin is used as a curable resin is described below. Known urethane resins are used. Urethane resins are excellent in abrasion resistance and preferably used as the protection layer.

Urethane resins have a high abrasion resistance, excellent electrostatic characteristics, and a high layer quality. Therefore, the urethane resins are suitable to improve the durability of an image bearing member and the image quality. Urethane resins are formed by, for example, a combination of a polyol as an active hydrogen component, and a multi-valent isocyanate. Known polyols can be used and specific examples thereof include, but are not limited to, polyether polyols such as polyaklylenooxide, polyester polyols such as aliphatic polyesters having a hydroxyl group at its end, acryl based polymer polyols such as a copolymer of hydroxymethacrylate, epoxy polyols such as epoxy resins, polyols having fluorine, and polycarbonate dials having a polycarbonate skeleton.

The polyols have two or more functional groups and more preferably three or more functional groups, thereby making a strong and firm three dimensional network structure. Consequently, the curing property is improved and the strength of the layer is improved. Polyols having a molecular weight of from 100 to 150 is widely used. However, the volume shinks severely depending on the curing condition, which leads to egradation of the layer quality.

In this case, JP 3818535 describes a technology to relax the volume shrinkage during the curing reaction for which a polyol having a molecular weight of 1,000 or more is separately added.

Typical isocyanate material is used for the polyvalent isocyanate of the curing agent. However, an isocyanate that does not cause a change in color of the layer over time is preferable. Specific examples of the multi-valene diisocyanates include, but are not limited to, isocyanate compounds such as trilene diisocyanate (TDI), diphenylmethane diisocyanate (MDI), xylene diisocyanate (XDI), hexamethylene diisocyanate (HDI), isophorone diisocyanate (IPDI), bis(isocyanate methyl)cyclohexane (HDXI), trimethylhexamethylene diisocyanate (TMDI), polyisocyanates such as an adduct of HDI-trimathylol propane, HDI-isocyanate, HDI-biulet, an adduct of XDI-trimethylol propane, an adduct of IPDI-trimethylol propane, and IPDI-iscyanulate. As isocyanates having an amide bond for use in the present invention, an adduct of HDI-trimethylol propane, an adduct of IPDI-trimethylol propane, and HDI-biulet are used alone or in combination. The ratio (NCO/OH) of the number of NCO functional groups in the isocyanate to the number of OH functional groups is preferably from about 1.0 to about 1.5.

The polyol having the charge transport structure specified above in the same structure, and known material can be used as the reactive compound having a charge transport structure as long as it contains multiple functional groups (e.g., a functional group such as amino group and an SH group having an active hydrogen group, polyhalogen substituted siloxane or polyalkoxy substituted siloxane producing an Si—OH group upon hydrolysis by moisture in air) to conduct curing reaction with a polyisocyanate, etc. The charge transport structure is any of a positive hole transportability, an electron transportability or both as described above. Among these, compounds having a triarylamine structure are particularly preferable. In addition, hydroxyl group is generally used as a functional group for the curing reaction. Specific examples of reactive compounds having the triphenyl amine structures include, but are not limited to, the following: chemical structures.

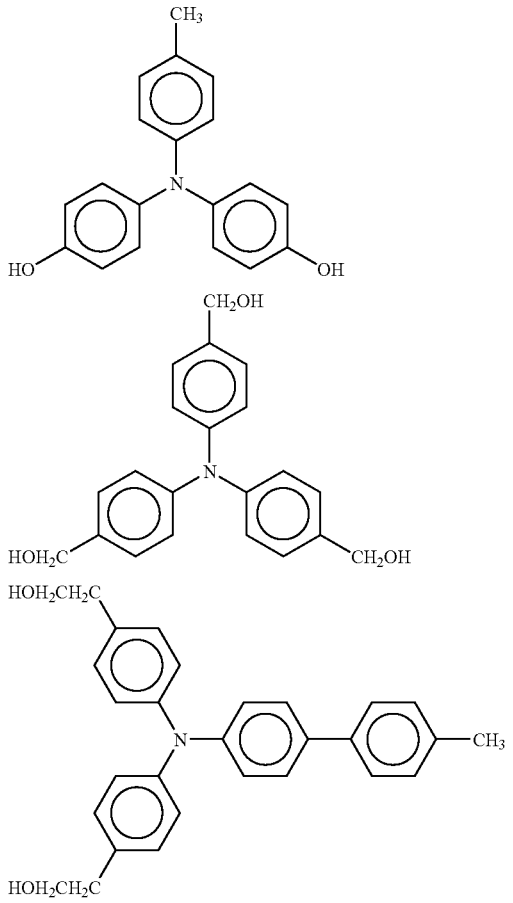

-continued

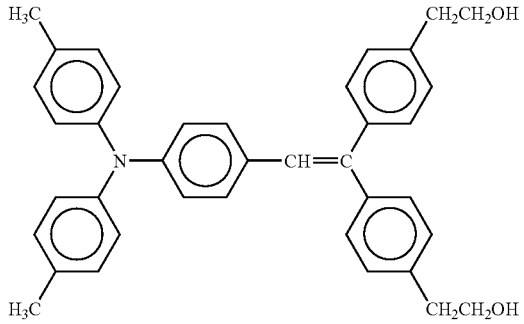

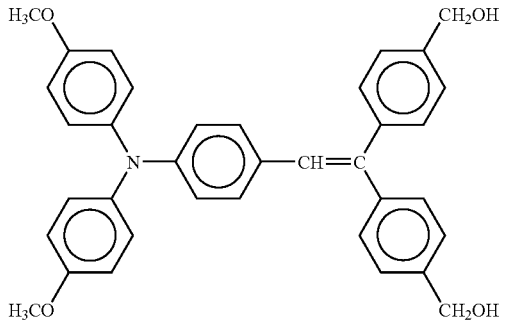

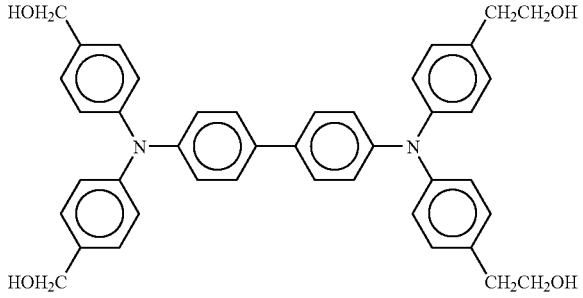

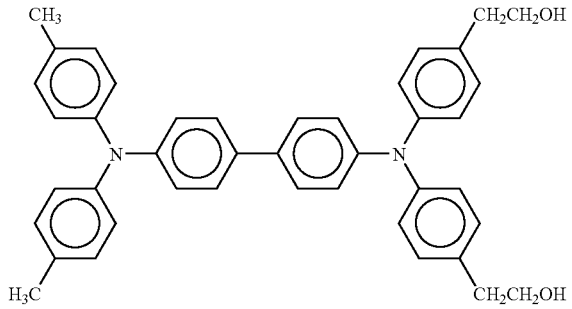

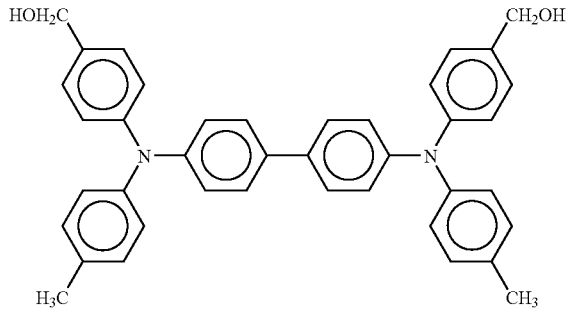

-continued

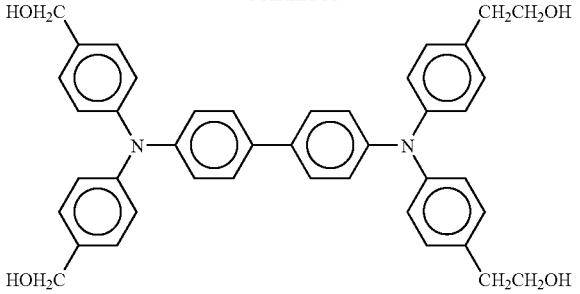

The materials and the methods described for the acryl/methacryl resins can be applied with regard to the filler, various kinds of additives and formation of the protection layers.

As described above, a great number of curable resins can be used to from the protection layer. In addition, any other known curable resin can be suitably used.

Undercoating Layer

In the image bearing member of the present invention, an undercoating layer can be provided between the electroconductive substrate and the charge generation layer. Typically, such an undercoating layer is mainly made of a resin. Considering that the charge generation layer and the charge transport layer are applied on the undercoating layer (i.e., the resin) in a form of solvent, a resin that is hardly soluble in a known organic solvent is preferably used. Specific examples of such resins include, but are not limited to, water soluble resins such as polyvinyl alcohol, casein, and sodium polyacrylate, alcohol soluble resins such as copolymer polyamide (copolymerized nylon) and methoxymethylized polyamide (nylon) and curable resins which form a three dimensional mesh structure, such as polyurethane, melamine resins, phenol resins, alkyd-melamine resins, isocyanates and epoxy resins.

In addition, inclusion of metal oxides in the undercoating layer is suitable to prevent the occurrence of moiré fringe and reduce the residual voltage. The moiré fringe is a kind of image deficiency caused by an interference pattern referred to as a moire due to the optical interference when an image is written by a coherent light beam such as a laser beam. Basically, the moiré fringe is prevented because the undercoating layer scatters the incident laser beam. Therefore, the undercoating layer contains a material having a large reaction index. A structure in which an inorganic pigment is dispersed in a binder resin is most suitable to prevent moiré fringe.

One of usable inorganic pigments is white pigment and specific examples thereof include, but are not limited to, metal oxide such as titanium oxide, zinc oxide, calcium fluoride, silicon oxide, magnesium oxide, aluminum oxide, tin oxide, zirconium oxide, and indium oxide.

Furthermore, the undercoating layer preferably has a function of transferring charges having the same polarity as that of the charges on the surface of an image bearing member from the charge generation layer to the electroconductive substrate to reduce the residual voltage and the inorganic pigment mentioned above bears that function. For example, when an image bearing member of a negative charging type is used, the undercoating layer can reduce the residual voltage by having an electron conductivity. The metal oxides mentioned above are suitably used as these inorganic pigments. However, although the residual voltage is reduced by the existence of inorganic pigments having a low resistance and an increase in the addition ratio thereof, the background fouling may worsen. Therefore, the layer structure and the layer thickness of the undercoating layer in an image bearing member and an addition amount of the inorganic pigments is adjusted to have a good combination between the reduction on the background fouling and the residual voltage. In consideration of prevention of moiré fringes, an increase of the residual voltage and background fouling, titanium oxide is most suitable among the metal oxides mentioned above.

Such an undercoating layer is mainly formed of a binder resin, and an inorganic pigment (metal oxide) and a liquid dispersion for application is obtained by wet dispersion in a state in which a solvent is contained. Acetone, methylethylketone, methanol, ethanol, butanol, cyclohexanone, dioxane and a solvent mixture thereof are suitably used as the solvent. The inorganic pigments are dispersed with a binder resin in a solvent by a typical method using such as a ball mill, sand mill, and an attritor to prepare the liquid application. The binder resin can be added before dispersion and after dispersion as a resin solution. In addition, an agent, an additive, a curing promoter, etc. can be optionally added for curing (cross-linking) and a dispersion agent can be added to improve the dispersion property of the inorganic pigment. Using such a liquid application, the undercoating layer is formed on an electroconductive substrate using a known method such as a dipcoating method, a spraycoating method, a ring coating method, a bead coating method and a nozzle coating method. After application of the liquid, the undercoating layer is formed by optional curing treatment such as light irradiation for drying or curing. The layer thickness of the undercoating layer varies depending on the kind of the inorganic pigment contained therein and is preferably from 0 to 20 μm and more preferably from 2 to 10 μm.

In addition, an intermediate layer can be provided between the electroconductive substrate and the undercoating layer or the undercoating layer and the charge generation layer. The intermediate layer is provided to reduce the infusion of positive holes from the electroconductive substrate and the main purpose of the intermediate layer is to prevent the background fouling. Generally, the intermediate layer is mainly formed of a binder resin. Specific examples of the resins include, but are not limited to, polyamide, alcohol soluble polyamide (soluble nylon), water soluble polyvinylbutyral, polyvinyl butyral, and polyvinyl alcohol. The method described above and known application methods are employed as the intermediate layer formation method. The layer thickness of the intermediate layer is suitably from about 0.05 to 2 μm. Provision of the intermediate layer and the undercoating layer significantly improves the effect on reduction of the background fouling.

In the present invention, an anti-oxidizer, a plasticizer, a lubricant, an ultraviolet absorber, a leveling agent, etc. can be added to at least one layer of the protection layer, the charge generation layer, the charge transport layer, the undercoating layer, and the intermediate layer to improve the environmental resistance, particularly to prevent the degradation of sensitivity, the rise in residual potential and the reduction on charging. The following materials are typically used for these compounds.

Specific examples of the anti-oxidizers that can be added to each layer include, but are not limited to, the following.

(a) Phenol Compounds 2,6-di-t-butyl-p-cresol, butylated hydroxyanisol, 2,6-di-t-butyl-4-ethylphenol, n-octadcyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

(b) Paraphenylene Diamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(c) Hydroquinones 2,5-di-t-octylhydroquinone, 2,6-didodecylhydroquinone, 2-dodecylhydroquinone, 2-dodecyl-5-chlorohydroquinone, 2-t-octyl-5-methyl hydroquinone, and 2-(2-octadecenyl)-5-methylhydroquinone.

(d) Organic Sulfur Compounds

Dilauryl-3,3'-thiodipropionate, distearyl-3,3'-thiodipropyonate, and ditetradecyl-3,3'-thiodipropyonate.

(e) Organic Phosphorous Compounds

Triphenyl phosphine, tri(nonylphenyl)phosphine, tri(dinonylphenyl)phosphine, tricresyl phosphine, and tri(2,4-dibutylphenoxy)phosphine.

Specific examples of the plasticizers that can be added to each layer include, but are not limited to, the following (a) Phosphoric Ester Based Plasticizer Triphenyl phosphate, tricresyl phosphate, trioctyl phosphate, octyldiphenyl phosphate, trichloroethyl phosphate, cresyl diphenyl phosphate, tributyl phosphate, tri-2-ethylhexyl phosphate, and triphenyl phosphate.

(a) Phthalic Ester Based Plasticizer

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzil phthalate, butyllauryl phthalate, methyloleyl phthalate, octyldecyl phthalate, dibutyl fumarase, and dioctyl fumarase.

(c) Aromatic Carboxyl Ester Based Plasticizer

Trioctyl trimellitic acid, tri-n-octyl trimellitic acid, and octyl oxybenzoate.

(d) Aliphatic Dibasic Acid Ester Based Plasticizer

Dibutyl adipate, n-hexyl adipate, di-2-ethylhexyl adipate, di-n-octyl adipate, n-octyl-n-decyl adipate, diisodecyl adipate, dicapryl adipate, di-2-ethyl-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophyalate, and di-n-octyl tetrahydrophtalate.

(e) Aliphatic Ester Derivative

Butyl oleate, glycerin monoloeic acid ester, methyl acetyl ricinolate, pentaerythritol ester, dipentaerythritolhexaester, and triacetine, and tributyrin.

(f) Oxic Acid Ester Based Plasticizer

Methyl acetyl ricinoleate, butyl acetyl ricinoleate, butylphthalyl butyl glicolate, and tributyl acetyl citrate.

(g) Epoxy Plastic Agent

Epoxidized soy bean oil, epoxidized linseed oil, butyl epoxy stearate, decyl epoxy stearate, octyl epoxy stearate, benzyl epoxy stearate, dioctyl epoxy hexahydrophthalate, and didecyl epoxyhexahydrophyalate.

(h) Diol Ester Based Plasticizer

Diethylene glycol dibenzoate, and triethylene glycol di-2-ethyl butylate.

(i) Choline Containing Plasticizer

Clorinated paraffin, chlorinated diphenyl, chlorinated aliphatic methyl, and methoxychlorinated aliphatic methyl.

(j) Polyestel Based Plasticizer

Polypropylene adipate, polypropylene cebacate, polyester, and acetylized polyester.

(k) Sulfuric Acid Derivatives p-toluene sulfone amide, o-toluene sulfone amide, p-toluene sulfone ethyl amide, o-toluene sulfone ethyl amide, toluene sulfone-N-ethyl amide, and p-toluene sulfone-N-cyclohexyl amide.

(i) Citric Acid Derivatives

Triethyl citrate, triethyl acetyl citrate, tributyl citrate, tributyl acetyl citrate, tri-2-ethyl hexyl acetyl citrate, and acetyl citrate-n-octyl decyl.

(m) Others

Terphenyl, partially hydrogenerated terphenyl, camphort, 2-nitrodiphenyl, dinonyl naphthaline, and methyl abietate.

Specific examples of the lubricants that can be added to each layer include, but are not limited to, the following.

(a) Hydrocarbon Compounds

Liquid paraffin, paraffin wax, microwax, and low polymerized polyethylene.

(d) Aliphatic Compounds

Lauric acid, myristic acid, paltimic acid, stearic acid, arachidic acid, and behenic acid.

(c) Aliphatic Amide Based Compound

Stearyl amide, palmitic amide, oleic amide, methylene bisstearoamide, and ethylene bisstaroamide.

(d) Esterified Compounds

Lower alcohol ester of an aliphatic acid, multi-valent alcohol ester of an aliphatic acid, and aliphatic acid polyglycol esters.

(e) Alcohol Based Compounds

Cetyl alcohol, stearyl alcohol, ethylene glycol, polyethylene glycol, and polyglycerol.

(f) Metal Soap

Lead stearate, cadmium stearate, barium stearate, calcium stearate, zinc stearate and magnesium stearate.

(g) Natural Wax

Carnauba wax, candelila wax, bees wax, whale wax, insect wax and montan wax (h) Others Silicone compounds, and fluorinated compounds Specific examples of the ultraviolet absorber that can be added to each layer include, but are not limited to, the following.

(a) Benzophenones 2-hydrosybenzophenone, 2,4-dihydroxybenzophenone, 2,2',4-trihydroxybenzophenone, 2,2',4,4'-tetrahydroxy benzophenone, and 2,2'-dihydroxy-4-methoxy dibenzophenone.

(b) Salicylates

Phenylsalicylate, and 2,4-di-t-butylphenyl-3,5-di-t-butyl-4-hydroxybenzoate.

(a) Benzotriazoles (2'-hydroxyphenyl)benzotriazole, (2'-hydroxy-5'-methylphenyl)benzotriazole, (2'-hydroxy-5'-methyl phenyl)benzotriazole, and (2'-hydroxy-3'-tertiary butyl-5'-methylphenyl)-5-chlorobenzotriazole.

(d) Cyanoacrylates

Ethyl-2-cyano-3,3-diphenylacrylate, and methyl-2-carbomethoxy-3(paramethoxy)acrylate.

(e) Quenchers (Metal Salts)

Nickel (2,2'-thiobis(4-t-octyl)phenolate)normalbutyl amine, nickeldibutyldithiocarbamate, nickel dibutyldithiocarbamate, and cobalt dicyclohexyldithiophosphate.

(f) HALS (Hindered Amines)

Bis(2,2,6,6-tetramethyl-4-piperidyl)cebacate, bis(1,2,2,6,6-pentamethyl-4-piperidyl)cebacate, 1-[2-[3-(3,5-di-t-butyl-4-hydroxyphenyl)propionyloxy]ethyl]-4-[3-(3,5-di-t-butyl-4-hydroxyphenyl)propionyloxy-2,2,6,6-tetramethyl pyridine, 8-benzil-7,7,9,9-tetramethyl-3-octyl-1,3,8-triazaspiro[4,5] undecane-2,4-dione, and 4-benzoyloxy-2,2,6,6-tetramethyl piperidine Image Forming Apparatus Next, the image forming apparatus is described in detail with reference to the accompanying drawings.

Figure 3:
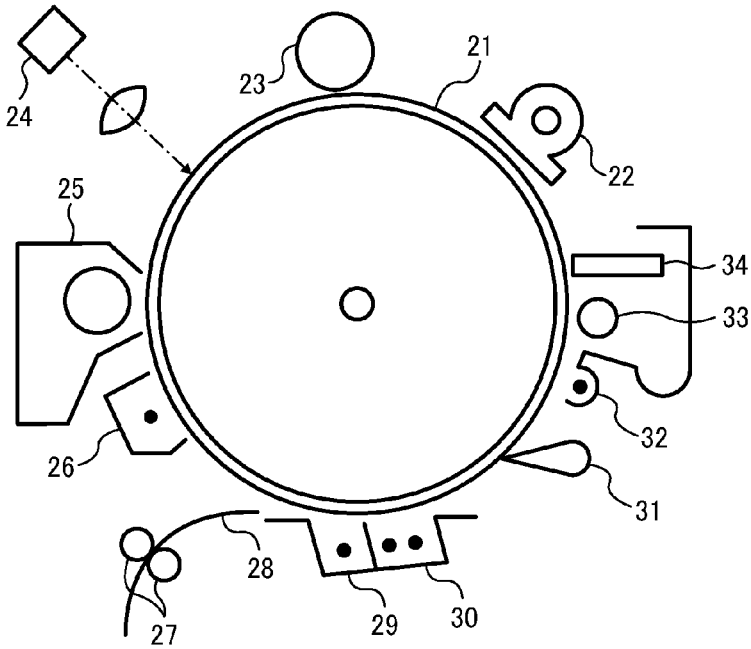
FIG. 3 is a schematic diagram illustrating an example of the image formation process for use in the present invention.

FIG. 3 is a schematic diagram illustrating an example of the image forming apparatus of the present invention. This is only a representative example and the present invention is not limited thereto. The variations that are described later are also within the scope of the present invention. An image bearing member 21 has a drum form but is not limited thereto. An image bearing member may employ a sheet form or an endless belt form. A reference numeral 22 represents a discharging lamp, 23 represents a charging device, 24 represents an image irradiation portion, 25 represents a development unit, 26 represents a charging device before transfer, 27 represents registration rollers, 28 represents a transfer sheet, 29 represents a transfer charging device, 30 a separation charging device, 31 represents a separation claw, 32 represents a charging device before cleaning, 33 represents a fur brush, and 34 represents a blade.

The image forming apparatus of the present invention includes a charging device, an irradiation device, a development device, a transfer device, a fixing device, a cleaning device, and a discharging device on a necessity basis. Other devices can be optionally provided to the image forming apparatus.

There can be used known charging devices employing, for example, a corona charging system such as a corotron, or a scoroton in which a high voltage is applied to a wire, a solid discharging system in which a high frequency voltage is applied to electrodes pinching an insulation board instead of wire, a contact type roller charging system in which a high voltage is applied to a member having a roller to charge an image bearing member while the member is in contact with the image bearing member, a vicinity disposition type roller charging system in which a member having a roller form charges an image bearing member with a gap between the roller and an image formation area of 100 μm or less, or a contact charging system using a brush, a film, a blade, etc., to charge an image bearing member while they are in contact with the image bearing member as the charging device.

In the corona charging system, a high voltage is applied to a wire having a diameter of from 50 to 100 μm, thereby ionizing the air around and the ionized air is transferred toward the image bearing member to charge the image bearing member. Corona charging system is typified into corotron and scorotron. A scorotron has a structure in which screen electrodes (grid) are arranged on a corotron. The screen electrodes are arranged with a gap between them of from 1 to 3 mm and stretched at a position 1 to 2 mm away from an image bearing member. Therefore, when a charging time is elongated, the charging voltage is restricted by a voltage applied to the grid electrodes so that the surface voltage saturates. Therefore, the charging voltage can be controlled by the grid potential to conduct uniform charging. For a high speed performance, a double wire type in which two wires are suspended is particularly preferable. In addition, among the two wire type, a structure in which the two wires are separated is also suitable. A gap of 1.5 mm or higher per 1 kV is required to prevent discharging between the wires or the wire and the casing.

Figure 4:
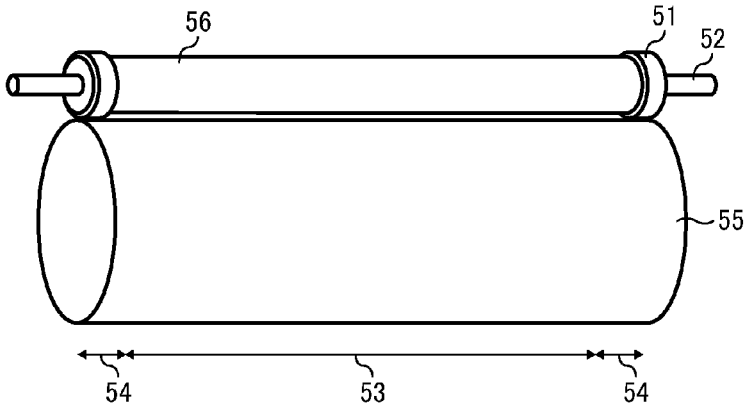
FIG. 4 is a diagram illustrating the charging device employing a vicinity arrangement roller system.

The charging system using a roller form is a method in which a voltage is applied to an electroconductive roller, which is brought into contact with the image bearing member to charge it. The system using a roller form has such advantages that the applied voltage is relatively low in comparison with that of the corona charging system, the size can be reduced, and the amount of produced ozone is extremely small. However, the charging property may deteriorate due to contamination of the roller and the working life of thereof when the roller is used in an extremely high speed condition. Furthermore, the charging system having a roller form also suitably employs a vicinity disposition system in which the roller is provided such that the roller is not in contact with the image bearing member in the image formation area. Therefore, the charging roller is contaminated with development material and paper dust during repetitive use. Thus, the charging reduction, production of abnormal images and abrasion can be limited. As a method of providing a charging roller in the vicinity of an image bearing member in the image formation area, there is provided a method in which a gap is provided between the roller and the image bearing member in the image formation area. For example, as illustrated in FIG. 4, a gap tape (gap formation member 51 having a uniform thickness is provided to a charging roller 56 to maintain a gap. A reference numeral 55 represents an image bearing member, 52 represents a metal shaft, 53 represents an image formation area, and 54 represents a non-imag formation area. The gap between the image bearing member and the charging roller is preferably small, which is 100 μm or less, and more preferably 50 μm or less. As a structure in which the charging roller is not in contact with the image bearing member is employed, discharging is accordingly uneven, which may unstabilize the charging of the image bearing member. Therefore, it to is preferable to form an application bias obtained by overlapping an AC component with a DC component, thereby significantly stabilizing the charging of the image bearing member.

Any device that irradiates an image bearing member with light that is absorbed by a charge generation material can be used as the irradiation device.

The charged image bearing member is irradiated with light, which is absorbed by the charge generation material to generate a pair of charges. One charge of the pair moves to the surface to cancel the surface charge and thus a latent electrostatic image is formed thereon.

Typical illuminating materials, for example, a fluorescent lamp, a tungsten lamp, a halogen lamp, a mercury lamp, a sodium lamp, a light emitting diode (LED), a semiconductor laser (LD), and electroluminescence (EL) can be used as the light source of the irradiation device as long as the materials satisfy the condition mentioned above. Among these, the light emitting diode or the semi-conductor laser is advantageous and most suitable in terms of high speed performance and size reduction. Various kinds of optical filters, for example, a sharp cut filter, a band-pass filter, a near infrared filter, a dichroic filter, a coherent filter and a color conversion filter, can be used in combination with these light sources to irradiate an image bearing member with light having only a particular wavelength.

In addition, a mutt-beam irradiation device, particularly a surface emitting laser, is preferable in the present invention. Also, the speed of the performance of an image forming apparatus is improved by increasing the number of rotation of a polygon mirror and the number of image scanning frequency in the sub-scanning direction. However, there is a limit to increasing the number of rotation of a polygon mirror. Thus, a multi-beam scanning irradiation method using a multi-beam recording head is employed in which multiple light beam sources are arranged in the sub-scanning direction to scan an image bearing member with multiple beams in the primary scanning direction in one scanning. According to the multi-beam recording head, the number of rotation of a polygon mirror required in the case of one-beam light source is reduced to 1/n thereof for a light source using "n" light beams. That is, the rotation speed can be "n" times as fast as that in a single light beam light source. In addition, the scanning speed has thus an allowance and the scanning density can be increased so that an image with a high definition can be output at a high speed.

Figure 5:
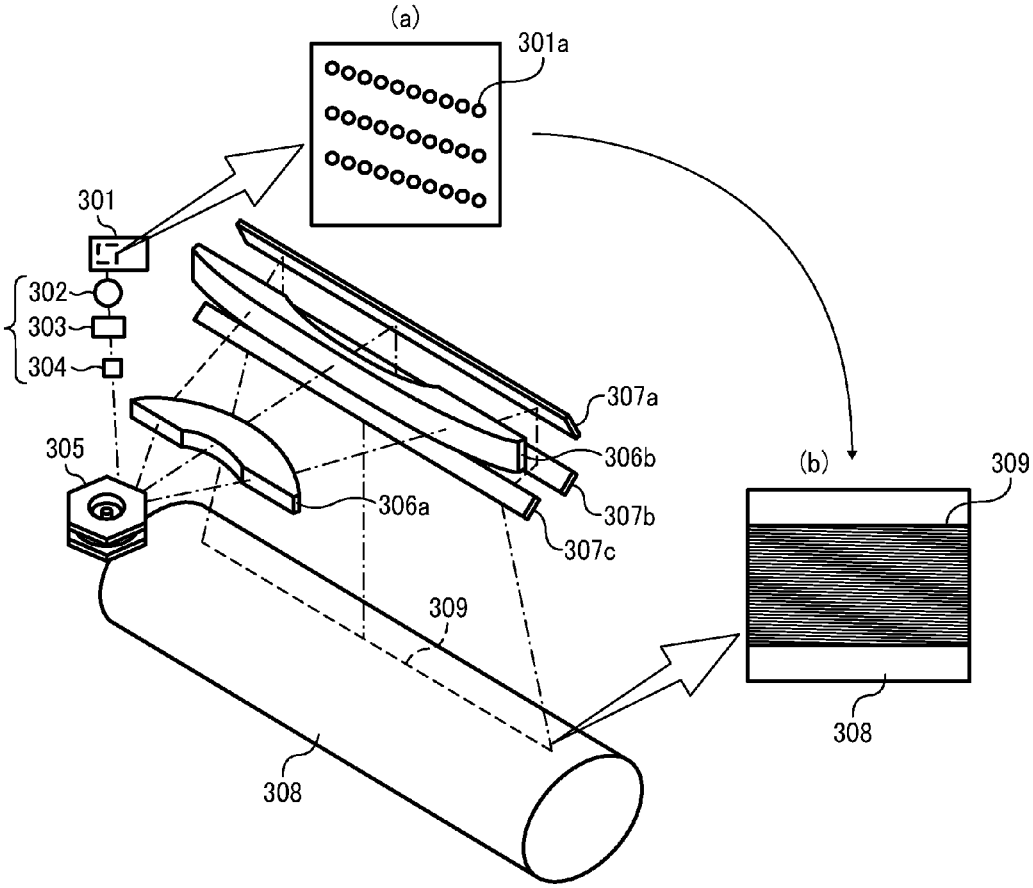
FIG. 5 is a schematic diagram illustrating another example of the image formation process for use in the present invention.

FIG. 5 is a diagram illustrating an example of the multi-beam irradiation device for use in the present invention. Multiple laser beams emitted from a light source 301 in which multiple luminous points 301*a* are arranged in one or two dimensions is collimated or significantly collimated by a collimate lens 302 and deflected to the main scanning direction by a polygon mirror 305 via a cylindrical lens 303, and an aperture 304. The laser beam deflected by the polygon mirror 305 is converged by a scanning lens 1 (306*a*) and a scanning lens 2 (306*b*), focused on a surface 308 of the image bearing member via flection mirrors 1, 2, and 3 (307*a*, 307*b*, 307*c*), and scanned in the main scanning direction (305). An edge emitting laser or a surface emitting laser can be used as a light source of the multiple irradiation device. In particular, the surface emitting laser can form a laser array in which luminous points are arranged in two dimensions, which is preferable in terms of high speed performance, size reduction and an increase in the image definition. The combination of 302, 303, and 304 are referred to as a coupling optical system. In addition, (a) represents an enlarged diagram illustrating the light source 301, and (b) represents an enlarged diagram illustrating the scanning.

Thus, the multi-beam irradiation device increases the performance speed of the image bearing member irrespective of the limit on the rotation speed of the polygon mirror. In addition, since the impact ascribable to the overlapping of multiple laser beams can be reduced, the present invention is particularly advantageous in a combination with the multi-beam irradiation.

The development process is a process in which a latent electrostatic image formed by the irradiation device is developed with toner to form a toner image on the image bearing member. A negative image (reverse development) is obtained when the latent electrostatic image is developed with toner having the same polarity with that of the image bearing member, and, a positive image, when developed with toner having an opposite polarity to that of the image bearing member. Development system is typified into a single component development system using only toner, and a two component development system using a mixture of toner and carriers. Both systems are suitable in the present invention. In addition, when a full color image is developed by overlapping multiple color toner images each other on an image bearing member according to a development method in which a toner image is developed while in contact with the image bearing member, a toner image may disturb the previously developed toner image when overlapped. Thus, a system, for example, a jumping development system, in which an image is developed without a contact between the image bearing member and the development device is preferably used.

The transfer process is a process of transferring the toner image formed on the image bearing member to a transfer material (e.g., transfer medium such as paper). A charging device can be used as the transfer device. For example, the transfer charger 29 illustrated in FIG. 3 or a combination thereof with the separation charger 30 can be suitably used. The transfer system can be classified into a direct transfer system in which a toner image is directly transferred from the image bearing member to a transfer medium by the transfer device described above, and an intermediate transfer system in which a toner image on the image bearing member is temporarily transferred to an intermediate transfer body and then transferred to a transfer medium such as paper. Both transfer systems can be suitably used. The latter transfer system (intermediate transfer system) is preferable in terms of improvement on the image quality and thus suitable for a full color image forming apparatus, but is disadvantageous in terms of high speed performance and size reduction. Thus, the transfer system is selected according to the usage purpose.

In addition, a fixed voltage system or a fixed current system can be employed when an image is transferred. The fixed current system is more preferable because it is stable and the amount of transfer charge is maintained at the same level. The higher the transfer current, the better the transferability. As the linear speed of the image bearing member increases, the transferability tends to deteriorate. Thus, increasing the transfer current is preferable.

The fixing process is a process of fixing a toner image transferred to a transfer medium such as paper thereon by heat and pressure. Any method can be employed as the fixing method as long as it fixes toner on the transfer medium. To be specific, heat and/or pressure is applied. A combination of a heating roller and a pressure roller, or a combination thereof with an endless belt is also suitable.

The cleaning process is a process of cleaning the surface of an image bearing member of toner remaining thereon after development and transfer. Any method can be employed as long as it cleans the surface of the image bearing member. Specific examples of the cleaning devices include, but are not limited to, a fur brush, a blade or a combination thereof. Other devices such as a magnetic brush, an electrostatic brush and a magnetic roller can also be suitably used. The surface of the image bearing member is contaminated with various kinds of foreign objects such as development material, paper dust, and products by discharging in addition to the toner remaining on the image bearing member, which have an adverse impact on the image quality. Therefore, such foreign objects are also removed in the cleaning process.

The discharging process is a process of discharging the image bearing member to remove a latent electrostatic residual contrast image after removal of the residual toner in the cleaning process because the latent electrostatic residual contrast image may be visualized or result in a ghost image in the next image formation cycle. Any device can be used as long as the charge generation material absorbs the light emitted from the device. For example, a fluorescent lamp, a tungsten lamp, a halogen lamp, a mercury lamp, a sodium lamp, a light emitting diode (LED), a semiconductor laser (LD), a xenon lamp and electroluminescence (EL) can be used as the discharging device and a combination of these and the optical filter mentioned above in the irradiation device is also suitable. In addition to the optical light irradiation system, a method of discharging by application of a reversed bias can be employed, which is preferable in terms of limiting the metal fatigue.

In the present invention, a mechanism of applying a lubricant to the surface of an image bearing member is suitably provided as described above. Such a lubricant prevents turning inward and/or outward of a cleaning blade and its anticipated adverse result such as bad cleaning performance. In addition, a lubricant that is applied to the surface of the image bearing member prevents deterioration of the surface of the image bearing member due to charging. That is, application of a lubricant is suitable to have a good combination of a long working life of the image bearing member and production of quality images thereby.

Furthermore, abrasion resistance, damage resistance, and cleaning performance of the image bearing member can be improved.

The application method of a lubricant material includes a method of solidifying a lubricant material, scraping the solid lubricant material with a brush and applying it to an image bearing member, a method in which a lubricant material is directly brought into contact with an image bearing member, a method in which a powder mixture of a lubricant material with a development agent is prepared, and supplied and applied to the surface of an image bearing member in the development process, etc. In the present invention, a lubricant material that is applied to the surface of an image bearing member can be used in any manner. Among the methods, the method of applying the lubricant by scraping it with a brush is most preferable. In addition, another method is preferably used in which a blade is brought into contact with the surface of an image bearing member to uniformly extend coated lubricant material thereon while in contact therewith. In this method, the cleaning blade can bear this function as the application blade or an application blade dedicated for application of a lubricant material can be separately provided apart from the cleaning blade. The application mechanism of a lubricant material is preferably arranged in the process after the cleaning process.

Any lubricant material that uniformly attaches, the surface of an image bearing member and resultantly imparts lubricant properties thereto can be used as the lubricant material for use in the present invention. For example, waxes and lubricating materials are suitably used. Preferred specific examples of the waxes include, but are not limited to, ester based compounds (waxes), or olefin based compounds (waxes). The ester based waxes represent compounds having an ester bonding, e.g., natural waxes such as carnauba wax, candelilla wax, and rice wax, and montan wax. Specific examples of the olefin based waxes include, but are not limited to, synthesis waxes such as polyethylene wax, and polypropylene wax. Specific examples of the lubricating materials include, but are not limited to, fluorine containing resins such as PTFE, PFA and PVDF, silicone resins, polyolefin resins, and aliphatic metal salts such as zinc stearate, zinc laurate, zinc myristate, calcium stearate, and aluminum stearate. Among these, zinc stearate is most preferable.

Tandem System Image Forming Apparatus

A tandem system image forming apparatus includes the same number of image bearing members as development units separately provided for corresponding color toners, thereby independently conducting development of each color toner in parallel followed by overlapping of each color toner image to obtain a full color image. To be specific, at least four color development units and image bearing members of yellow (Y), magenta (M), cyan (C), and black (K) required for full color printing are provided, thereby achieving extremely high speed full color printing in comparison with a single drum system in which processes are repeated four times to obtain a full color image. Therefore, the tandem system is particularly suitable for the present invention.

Figure 6:
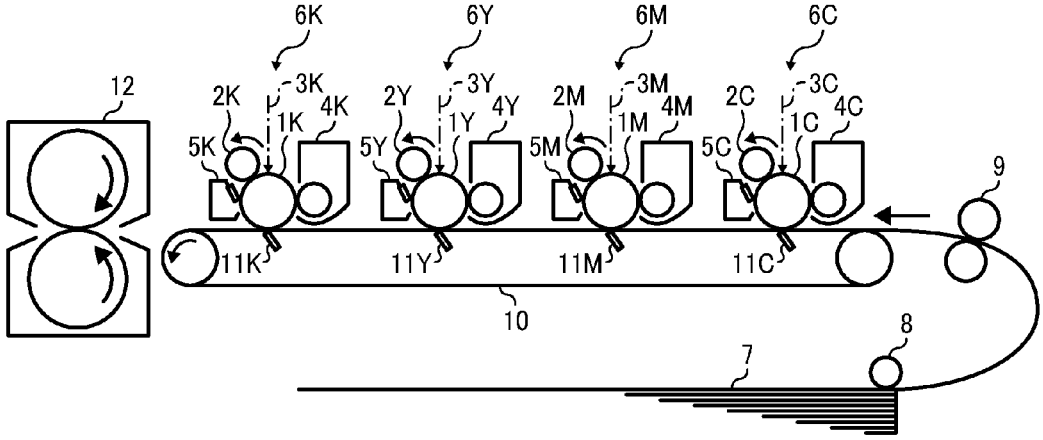
FIG. 6 is a schematic diagram illustrating yet another example of the image formation process for use in the present invention.

FIG. 6 is a schematic diagram illustrating a full color image forming apparatus employing a tandem system for use in the present invention. In FIG. 6, reference numerals 1C, 1M, 1Y, and 1K represent image bearing members having a drum form for use in the present invention. The image bearing members 1C, 1M, 1Y, and 1K rotate in the direction indicated by an arrow and there are provided therearound at least charging devices 2C, 2M, 2Y, and 2K, development device 4C, 4M, 4Y, and 4K, and cleaning devices 5C, 5M, 5Y, and 5K arranged according to the rotation direction of the image bearing members.

An irradiation device (not shown) emits laser beams 3C, 3M, 3Y, and 3K from the rear side of the image bearing members between the charging devices 2C, 2M, 2Y, and 2K and the development device 4C, 4M, 4Y, and 4K to form latent electrostatic images on the image bearing members 1C, 1M, 1Y, and 1K. Four development components 6C, 6M, 6Y, and 6K including the image bearing members 1C, 1M, 1Y, and 1K are arranged along a transfer belt 10 functioning as a transfer medium conveyor device. The transfer belt 10 is in contact with the image bearing members 1C, 1M, 1Y, and 1K between the development device 4C, 4M, 4Y, and 4K and the cleaning devices 5C, 5M, 5Y, and 5K of each development component 6C, 6M, 6Y, and 6K. Transfer brushes 11C, 11M, 11Y, and 11K that apply a transfer bias are provided on the side of the transfer belt 10 reverse to the side thereof on which the image bearing members 1C, 1M, 1Y, and 1K are in contact. Each image formation component 6C, 6M, 6Y, and 6K is of the same structure except that toners contained in the development devices 4C, 4M, 4Y, and 4K have different colors from each other.

The full color image forming apparatus having the structure illustrated in FIG. 6 forms images as follows. In the image formation component 6C, 6M, 6Y, and 6K, the image bearing members 1C, 1M, 1Y, and 1K are charged by the charging devices 2C, 2M, 2Y, and 2K that rotate in the direction indicated by an arrow (the seine direction as the rotation direction of the image bearing members 1C, 1M, 1Y, and 1K) and irradiated with the laser beams 3C, 3M, 3Y, and 3K by the irradiation device (not shown) situated outside the image bearing members 1C, 1M, 1Y, and 1K to form latent electrostatic images corresponding to an image of each color. Then, the latent electrostatic images are developed by the development devices 4C, 4M, 4Y and 4K to form toner images. The development devices 4C, 4M, 4Y, and 4K develop the latent electrostatic images with toner of C (cyan), M (magenta), Y (yellow), and K (black), respectively. Respective toner images formed on the four image bearing members 1C, 1M, 1Y, and 1K are overlapped on a transfer medium 7. The transfer medium 7 is sent out from a tray by a feeding roller 8, temporarily held at a pair of registration rollers 9 and fed to the transfer belt 10 in synchronization with image formation on the image bearing members 1C, 1M, 1Y, and 1K. The transfer medium 7 held on the transfer belt 10 is transferred to the contact point (transfer portion) with the image bearing members 1C, 1M, 1Y, and 1K where each color toner image is transferred.

The toner images on the image bearing members 1C, 1M, 1Y, and 1K are transferred to the transfer medium 7 by an electric field formed by a potential difference between the transfer bias applied to the transfer brushes 11C, 11M, 11Y, and 11K and the voltage of the image bearing members 1C, 1M, 1Y, and 1K. The transfer medium 7 on which four color toner images are overlapped through the four transfer portions are conveyed to a fixing device 12 where the toner is fixed followed by discharging of the transfer medium 7 to a discharging portion (not shown). In addition, toner which has not been transferred to the image bearing members 1C, 1M, 1Y, and 1K and remains thereon are collected by the cleaning devices 5C, 5M, 5Y, and 5K. The image formation elements are arranged in the sequence of C (cyan), M (magenta), Y (yellow), and K (black) from the upstream to the downstream relative to the transfer direction of the transfer medium, but are not limited thereto. The sequence of the color is arbitrarily selected. In addition, when a document of only black color is output, a mechanism to suspend the image formation elements 6C, 6M, and 6Y) other than the black color is particularly suitable for the present invention. The charging devices 2C, 2M, 2Y, and 2K are in contact with the image bearing members 1C, 1M, 1Y, and 1K in FIG. 6. Alternatively, the charging mechanism as illustrated in FIG. 4 which has a suitable gap of from about 10 to about 200 μm between the charging devices 2C, 2M, 2Y, and 2K and the image bearing members 1C, 1M, 1Y, and 1K can be preferably used in terms that toner filming to the charging devices 2C, 2M, 2Y, and 2K is limited.

Process Cartridge

Figure 7:
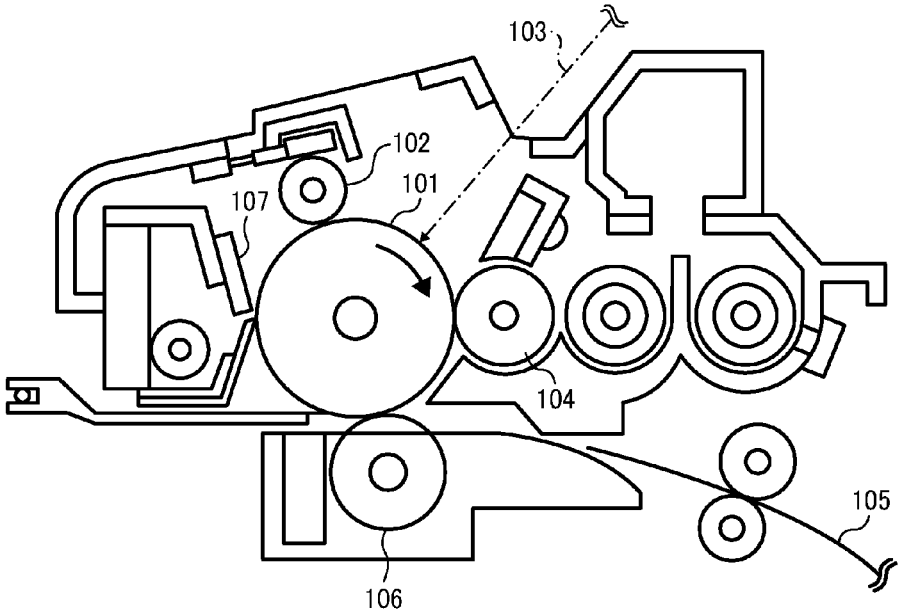
FIG. 7 is a schematic diagram illustrating an example of the process cartridge of the present invention.

The image formation device as described above can be assembled into a photocopier, a facsimile machine, or a printer in a fixed manner and each image formation element can be incorporated into such an apparatus in a form of a process cartridge. The process cartridge is a device (part) including an image bearing member and at least one device selected from ocher optional devices such as a charging device, an irradiation device, a development device, a transfer device, a cleaning device and a discharging device and detachably attachable to the main body of an image forming apparatus. There is no specific limit to the form of a process cartridge but a typical form thereof is as illustrated in FIG. 7. Reference numerals 101, 102, 103, 104, 105, 106, and 107 in FIG. 7 represent a drum, a contact type charging device, image irradiation, a development device, a transfer medium, a contact type transfer body, and a cleaning unit, respectively.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Titanylphthalocyanine Crystal

The method of synthesizing titanyl phthalocyanine crystal for use in the present invention is described below. Titanyl phthalocyanine is synthesized according to JOP 2004-83859. 292 parts of 1,3-diiminoisoindoline and 1,800 parts of sulfolane are mixed and 204 parts of titanium tetrabutoxido is dropped thereto in nitrogen atmosphere. Thereafter, the temperature is raised to 180° C., and the resultant is stirred to conduct reaction for 5 hours while the reaction temperature is maintained in a range of from 170 to 180° C. After the reaction is complete, the resultant is naturally cooled down and the precipitation is filtered. The filtered resultant is washed with chloroform until the obtained powder indicates the color of blue. Next, the resultant powder is washed with methanol several times. Further, the resultant is washed with hot water of 80° C. several times and dried to obtain a coarse titanyl phthalocyanine. The titanyl phthalocyanine is dissolved in strong sulfuric acid the amount of which is 20 times as much as that of the titanyl phthalocyanine. The resultant is dropped to iced water the amount of which is 100 times as much as the resultant. The precipitated crystal is filtrated and water-washing is repeated with deionized water having a pH of 7.0 and a specific electric conductivity of 1.0 μS/cm until the washing water is neutral to obtain a wet cake (water paste) of titanyl phthalocyanine dye. The pH value of the deionized water and the specific electric conductivity after washing was 6.8 and 2.6 μS/cm, respectively.

Figure 8:
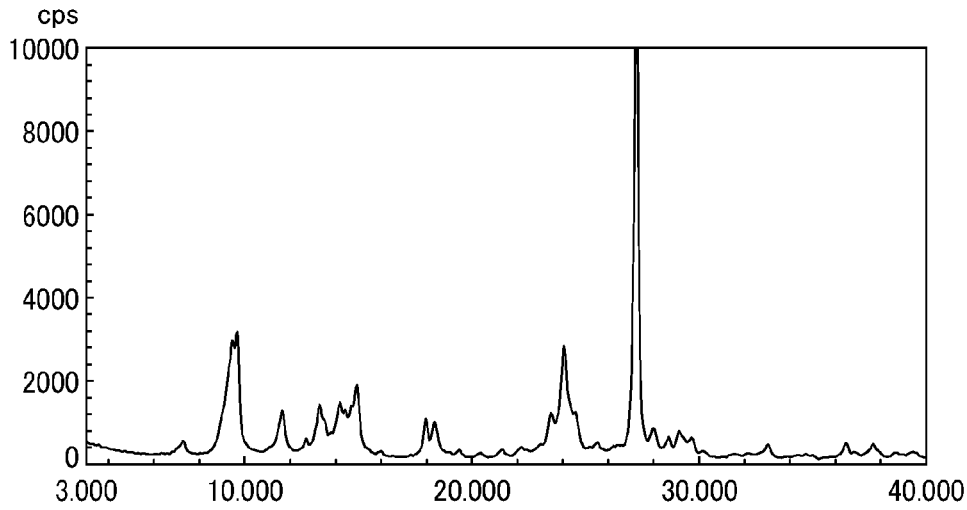
FIG. 8 is a diagram illustrating an X-ray diffraction spectrum chart where Y axis represents counts per second (cps) and X axis represents an angle (2θ)

40 parts of the thus obtained wet cake (water paste) is put in 200 parts of tetrahydrofuran and vigorously stirred with HOMOMIXER (MARKII f model, KENIS, Ltd.) (at 2,000 rpm) at room temperature until the color of the paste changed from navy blue to light blue (20 minutes after initiation of stirring), followed by immediate filtration with a reduced pressure. The crystals on the filtration device are washed with tetrahydrofuran to produce a wet cake of the pigment. The wet cake is then dried for 2 days at 70° C. under a reduced pressure (5 mmHg) to produce 8.5 parts of a titanyl phthalocyanine crystal. Hereinafter, this is referred to as "Pigment 1" The solid portion density of the wet cake was 15 weight %. The weight ratio of the solvent for crystal conversion to the wet cake is 33. No halogenated material is used in the raw material of Synthesis Example 1. The thus obtained titanyl phthalocyanine powder measured using X ray diffraction spectrum under the following conditions had a CuKα X ray diffraction spectrum having a wavelength of 1.542 Å such that the maximum diffraction peak was observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 9.4°±0.2° and 7.3°±0.2° and no peak at 26.3±0.2°. The results are shown in FIG. 8.

Measuring Conditions of X Ray Diffraction Spectrum
X ray tube: Cu
Voltage: 50 kV
Current: 30 mA.
Scanning speed: 2°/minute
Scanning area: 3 to 40°
Time constant: 2 seconds The pigment mentioned above and 2-butanone solution where polyvinyl butyral is dissolved are put in a marketed bead mill dispersion device using PSZ balls having a diameter of 0.5 mm. Dispersion is performed for 120 minutes at 3,000 rpm to prepare a liquid dispersion.

Synthesis of Azo Pigment

Azo pigment is prepared according to the method described in JP 3026645.

The Cyclohexanone solution in which polyvinyl butyral is dissolved and the azo pigment are put in a ball mill dispersion device using PSZ balls having a diameter of 10 mm. Dispersion is performed for 7 days at 85 rpm to prepare a liquid dispersion.

Synthesis Example of Polymerizble Compound Having Charge Transport Structure

The polymerizable compound having the charge transport structure in the present invention is synthesized according to the method described in, for example, JP 3164426. An example thereof is as follows.

(1) Hydroxyl Group Substituted Triarylamine Compound (Represented by the Following Chemical Structure B)

240 ml of sulfolane are added to 113.85 g (0.3 mol) of methoxy group substituted triaryl amine compound represented by the Chemical structure A and 138 g (0.92 mol) of sodium iodide. The mixture is heated to 60° C. in nitrogen air stream. 99 g (0.91 mol) of trimethyl chlorosilane is dropped to the liquid in one hour and the resultant is stirred at about 60° C. for 4 hours to complete the reaction. About 1.5 liter of toluene is added to the reaction liquid. Subsequent to cooling down to room temperature, the liquid is repeatedly washed with water and sodium carbide aqueous solution. Thereafter, the solvent is removed from the toluene solution. The toluene solution is purified with column chromatography treatment {absorption medium (silica gel), developing solvent (toluene: ethyl acetate=20:1)}. Cyclohexane is added to the obtained light yellow oil to precipitate crystal. 88.1 parts (yield ratio=80.4%) of the white crystal represented by the following Chemical structure B is thus obtained.

Melting point:: 64.0 to 66.0° C.

TABLE 1

| | C | H | N |
|---|---|---|---|
| Measured value | 85.06 | 6.41 | 3.73 |
| Calculation value | 85.44 | 6.34 | 3.83 |

Chemical Structure A

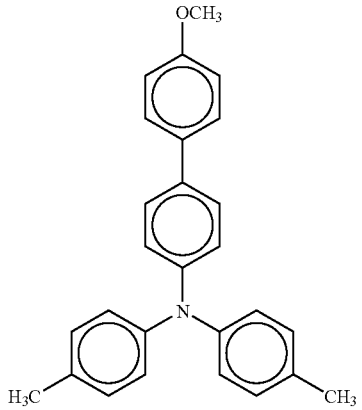

Chemical Structure B

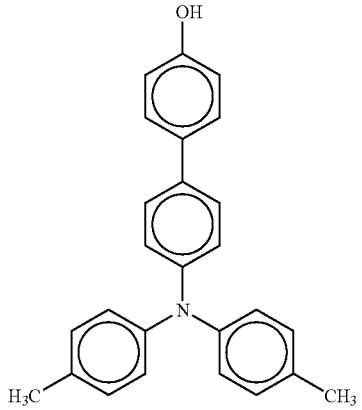

(2) Synthesis Example of Triaryl Amino Group Substituted Acrylate Compound (Illustrated Chemical Compound No. 54)

82.9 g (0.227 mol) of the hydroxyl group substituted triaryl amine compound (Chemical structure 3) obtained in (1) is dissolved in 400 ml of tetrahydrofuran and sodium hydroxide aqueous solution (NaOH: 12.4 g, water: 100 ml) is dropped thereto. The solution is cooled down to 5° C. and 25.2 parts (0.272 mol) of chloride acrylate is dropped thereto in 40 minutes. Thereafter, the solution is stirred at 5° C. for 3 hours to complete the reaction. The resultant reaction liquid is poured to water and extracted by toluene. The extracted liquid is repeatedly washed with sodium acid carbonate and water. Thereafter, the solvent is removed from the toluene aqueous solution and purified by column chromatography treatment (absorption medium: silica gel, development solvent: toluene). n-hexane is added to the obtained colorless oil to precipitate crystal. 80.73 g (yield ratio: 84.8%) of white crystal of the Illustrated Chemical Compound No. 54 is thus obtained.

Melting point:: 117.5 to 119.0° C.

TABLE 2

| Element analysis (%) | | | |
|---|---|---|---|
| | C | H | N |
| Measured value | 83.13 | 6.01 | 3.16 |
| Calculation value | 83.02 | 6.00 | 3.33 |

Example 1

The liquid application of an intermediate layer, the liquid application of an undercoating layer, the liquid application of a charge generation layer, and the liquid application of a charge transport layer having the following recipes are applied to an aluminum cylinder having an outer diameter of 60 mm in this order by a dip coating method followed by drying in an oven to obtain an intermediate layer having a thickness of about 0.6 μm, an undercoating layer having a thickness of about 3 μm, a charge generation layer having a thickness of about 0.2 μm, and a charge transport layer having a thickness of about 24 μm. The drying condition for each layer is: 130° for 10 minutes for the intermediate (resin) layer; 130° C. for 20 minutes for the undercoating layer; 90° C. for 20 minutes for the charge generation layer; and 120° C. for 20 minutes for the charge transport layer. The ionization potential of the charge transport layer is 5.25 eV.

| Liquid Applicatoin for Intermediate Layer | |
|---|---|
| N-methoxy methylized nylon (FR-101, manufactured by Namariichi Co., Ltd.) | 5 parts |
| Methanol | 70 parts |
| n-butanol | 30 parts |

| Liquid Application for Undercoating Layer | |
|---|---|
| Titanium oxide A (CR-El, manufactured by Ishiahara Sangyo Kaisha Ltd.: Average primary particle diameter: about 0.25 μm | 50 parts |
| Titanium oxide B (PT-401Ml, manufactured by Ishiahara Sangyo Kaisha Ltd.: Average primary particle diameter: about 0.07 μm | 20 parts |
| Alkyd resin (Beckozole M6401-50, manufactured by Dainippon Ink and Chemicals, Inc.; Solid portion: 50%) | 14 parts |
| Melamine resin (L-145-60, manufactured by Dainippon Ink and Chemicals, Inc.; solid portion: 60%) | 8 parts |
| 2-butanone | 70 parts |

| Liquid Applicatoin for Charge Generation Layer | |
|---|---|
| Titanylphthalocyanine having an X-ray spectrum illustrated in FIG. 8 | 8 parts |
| Ionizatoin potential | 5.27 eV |
| Polyvinylbutyral (BX-1, manufactured by Sekisui Chemical Co., Ltd.) | 4 parts |
| 2-butanone | 400 parts |

| Liquid Applicatoin for Charge Transport Layer | |
|---|---|
| Polycarbonatel (Z polika, manufactured by Teijin Chemicals Ltd.) | 10 parts |
| Charge transport material represented by CTM14 (molecular weight: 700.98): | 10 parts |
| Anti-Oxidizer represented by the following chemical formula 13 | 0.5 parts |

Chemical formula 13

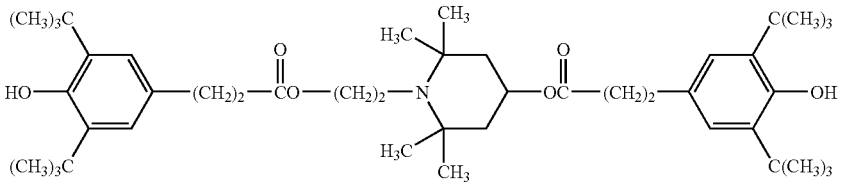

| | |
|---|---|
| Silicone oil (1 $cm^2/s$ (100 cSt), manufactured by Shin-etsu Chemical Co., Ltd.) | 0.002 parts |
| Tetrahydrofuran | 100 parts |
| Anti-Oxidizer represented by the following chemical formula 14 | 0.03 parts |

Chemical formula 14

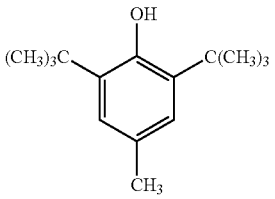

A protection layer is formed on the charge transport layer by a spray coating method using the following liquid application for the protection layer. Alumina balls (purity: 93%) having a Φ of 5 mm are placed in a glass pot having a volume of 70 cc and in addition, the following filler, polycarboxylic acid compound and cyclopentanone are placed therein to conduct dispersion at 150 rpm for 24 hours by the ball mil. Thereafter, tetrahydrofuran is added thereto followed by stirring to obtain a mill base. The mill base is mixed with a solution in which other materials are preliminarily mixed to prepare the liquid application for the protection layer. The protection layer is naturally dried for 10 minutes after the liquid application of the protection layer is applied. Then, the protection layer is irradiated and cured with light emitted by a UV lamp system (manufactured by Fusion) using a metal halide lamp under the condition of an irradiation distance of 50 mm, an irradiation intensity of 500 mW/cm$^2$ and an irradiation time of 50 seconds at about 42° C. A protection layer having a thickness of about 3 μm is obtained after drying for 30 minutes at 130° C. to manufacture the image bearing member of the present invention. The ionization potential of the protection layer is 5.42 eV.

| Mill Base | |
|---|---|
| Alumina filler (SUMICORUNDUM AA-03, manufactured by Sumitomo Chemical Co., Ltd.; Average primary particle diameter: 0.3 μm) | 8 parts |
| Polycarboxylic acid compound (BYK P104, manufactured by BYK-Chemie U.S. Inc.); acid value: 180 mgKOH/g; non-volatile portion: 50% | 0.2 parts |
| Cyclopentanone | 8 parts |
| Tetrahydrofuran | 12 parts |

| Liquid Applicatoin for Protection Layer | |
|---|---|
| Mill base prepared above | 3 parts |
| Radical polymerizable compound having no charge transport structure (KAYARAD TMPTA, manufactured by Nippon Kayaku Co., Ltd., molecular weight of 296, 3 functional groups, molecular weight/the number of functional groups = 99)] | 4 parts |
| Radical polymerizable compound having one functional group with a charge transport structure Illustrated Compound No. 54 | 4 parts |
| Photo polymerization initiator (1-hydroxy-cyclohexyl-phenyl-ketone (IRGACURE 184, manufactured by Chiba Specialty Chemicals)) | 0.5 parts |
| Tetrahydrofuran | 50 parts |

Comparative Example 1

The image bearing member is manufactured in the same manner as in Example 1 except that tetrahydrofuran is used instead of cyclopentanone.

Comparative Example 2

The image bearing member is manufactured in the same manner as in Example 1 except that cyclohexanone is used instead of cyclopentanone.

Comparative Example 3

The image bearing member is manufactured in the same manner as in Example 1 except that toluene is used instead of cyclopentanone.

Comparative Example 4

The image bearing member is manufactured in the same manner as in Example 1 except that xylene is used instead of cyclopentanone.

Comparative Example 5

The image bearing member is manufactured in the same manner as in Example 1 except that 1,3-dioxolan is used instead of cyclopentanone.

Comparative Example 6

The image bearing member is manufactured in the same manner as in Example 1 except that 2-propanol is used instead of cyclopentanone.

Example 2

The image bearing member is manufactured in the same manner as in Example 1 except that the alumina balls are replaced with ziaconia balls having a Φ of 2 mm, and the mill base is prepared by dispersion for 3 hours by a paint shaker after the filler, polycarboxylic acid compound and cyclopentanone are placed in the glass pot, followed by mixing with tetrahydrofuran.

Comparative Example 7

The image bearing member is manufactured in the same manner as in Example 2 except that tetrahydrofuran is used instead of cyclopentanone.

Example 3

The image bearing member is manufactured in the same manner as in Example 2 except that a liquid mixture of tetrahydrofuran and cyclopentanone with a ratio of 7 to 3 is used as the dispersion solvent.

Comparative Example 8

The image bearing member is manufactured in the same manner as in Example 1 except that the polycarboxylic acid compound is not added.

Example 4

The image bearing member is manufactured in the same manner as in Example 1 except that the filler contained in the liquid application for a protection layer is changed to the following.

| | |
|---|---|
| α-aluminum (SUMICORUNDUM AA-05, manufactured by Sumitomo Chemical Co., Ltd.; average primary particle diameter: 0.5 μm | 2 parts |

Comparative Example 9

The image bearing member is manufactured in the same manner as in Example 2 except that the filler contained in the liquid application for a protection layer is changed to the following.

| | |
|---|---|
| α-alumina (SUMICORUNDUM AA-05, manufactured by Sumitomo Chemical Co., Ltd.; average primary particle diameter: 0.5 μm | 2 parts |

Example 5

The image bearing member is manufactured in the same manner as in Example 1 except that the filler contained in the liquid application for a protection layer is changed to the following.

| | |
|---|---|
| Silical (SO-E2, manufactured by Admatechs Company Limited; average primary particle diameter: 0.5 μm). | 1 part |

Example 6

The image bearing member is manufactured in the same manner as in Example 1 except that the charge transport material contained in the charge transport layer is changed to the compound (molecular weight: 700.98) represented by CTM13. The ionization potential of the charge transport layer is 5.28 eV.

Example 7

The image bearing member is manufactured in the same manner as in Example 1 except that the charge transport material contained in the charge transport layer is changed to the compound (molecular weight: 676.87) represented by CTM4. The ionization potential of the charge transport layer is 5.31 eV.

Example 8

The image bearing member is manufactured in the same manner as in Example 1 except that the charge transport material contained in the charge transport layer is changed to the compound (molecular weight: 672.92) represented by CTM17. The ionization potential of the charge transport layer is 5.39 eV.

Example 9

The image bearing member is manufactured in the same manner as in Example 1 except that the charge transport material contained in the charge transport layer is changed to the compound (molecular weight: 881.23) represented by CTM52. The ionization potential of the charge transport layer is 5.40 eV.

Example 10

The image bearing member is manufactured in the same manner as in Example 1 except that the charge transport material contained in the charge transport layer is changed to the compound (molecular weight: 615.83) represented by CTM54. The ionization potential of the charge transport layer is 5.37 eV.

Comparative Example 10

The image bearing member is manufactured in the same manner as in Example 1 except that the charge transport material contained in the charge transport layer is changed to α-phenylstilbene derivative (molecular weight: 451.62) represented by the following chemical structure. The ionization potential of the charge transport layer is 5.39 eV.

Comparative Example 11

The image bearing member is manufactured in the same manner as in Example 1 except that the charge transport material contained in the charge transport layer is changed to α-phenylstilbene derivative (molecular weight: 483.62) represented by the following chemical formula 15. The ionization potential of the charge transport layer is 5.24 eV.

Chemical formula 15

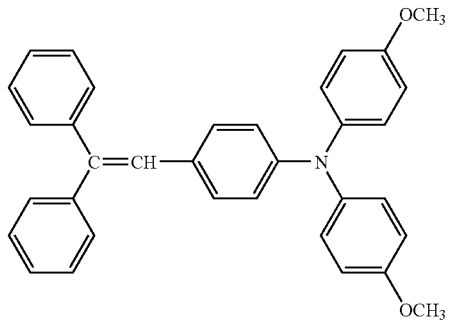

Comparative Example 12

The image bearing member is manufactured in the same manner as in Example 1 except that the charge transport material contained in the charge transport layer is changed to α-phenylstilbene derivative (molecular weight: 423.56) represented by the following chemical formula 16. The ionization potential of the charge transport layer is 5.50 eV.

Chemical formula 16

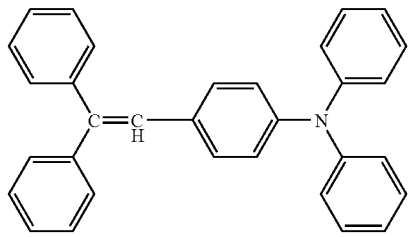

Comparative Example 13

The image bearing member is manufactured in the same manner as in Example 1 except that the charge transport material contained to in the charge transport layer is changed to α-phenylstilbene derivative (molecular weight: 379.51) represented by the following chemical formula 17. The ionization potential of the charge transport layer is 5.38 eV.

Chemical formula 17

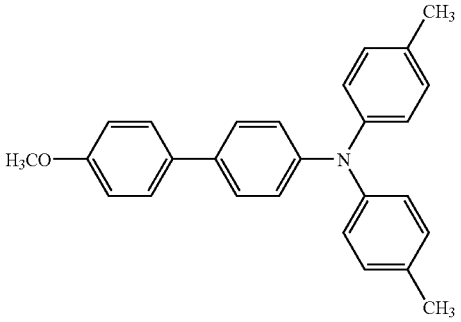

Comparative Example 14

The image bearing member is manufactured in the same manner as in Example 1 except that the charge transport material contained in the charge transport layer is changed to a bendidine derivative (molecular weight: 544.75) represented by the following chemical formula 18. The ionization potential of the charge transport layer is 5.32 eV.

Chemical formula 18

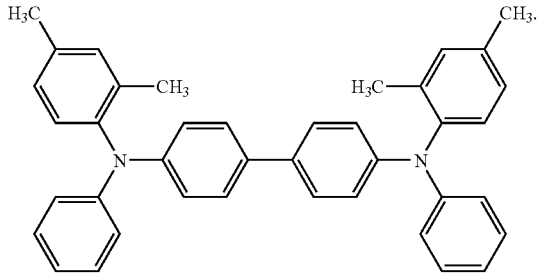

Comparative Example 15

The image bearing member is manufactured in the same manner as in Example 1 except that the liquid application for the charge transport layer is changed to the following recipe. The ionization potential of the charge transport layer is 5.41 eV.

| Liquid Applicatoin for Charge Transport Layer | |
|---|---|
| Charge transport polymer material represented by the following chemical formula 19 (weight average molecular weight: 195,000) | 20 parts |

Chemical formula 19

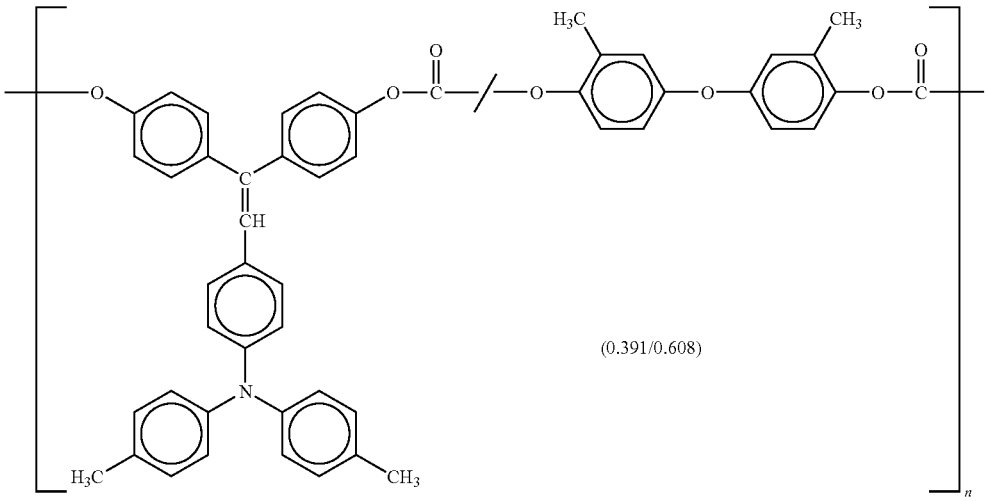

| | |
|---|---|
| Anti-Oxidizer represented by the following chemical formula 20 | 0.3 parts |

Chemical formula 20

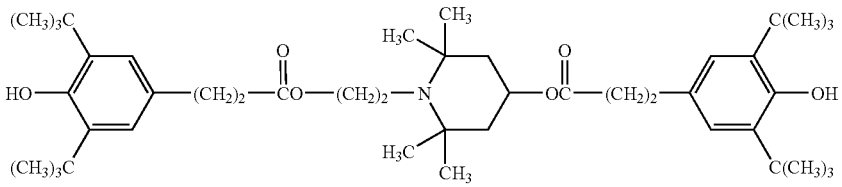

| | |
|---|---|
| Silicone oil (1 $cm^2/s$ (100 cSt), manufactured by Shin-etsu Chemical Co., Ltd.) | 0.002 parts |
| Tetrahydrofuran | 100 parts |

-continued

| Liquid Applicatoin for Charge Transport Layer | |
|---|---|
| Anti-oxidizer represented by the following chemical formula 21 | 0.03 parts |

Chemical formula 21

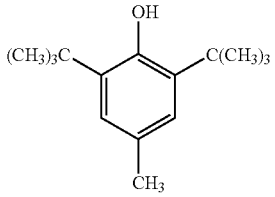

Comparative Example 16

The image bearing member is manufactured in the same manner as in Example 1 except that the liquid application for the protection layer is changed to the following recipe (no mill base is added). The ionization potential of the charge transport layer is 5.42 eV.

| Liquid Applicatoin for Protection Layer | |
|---|---|
| Radical polymerizable compound having no charge transport structure: (caprolactone modified dipentaerythritol hexaacrylate (KAYARAD DPCA-60, manufactured by Nippon Kayaku Co., Ltd., molecular weight of 1,263, 6 functional groups, molecular weight/the number of functional groups = 211)] | 4 parts |
| Radical polymerizable compound having one functional group with a charge transport structure (Illustrated Compound No. 54) | 4 parts |
| Photo polymerization initiator (2,2-dimethoxy-1,2-diphenylethane-1-one (IRGACURE 651, manufactured by Chiba Specialty Chemicals)) | 1 part |
| Tetrahydrofuran | 50 parts |

Example 11

The image bearing member is manufactured in the same manner as in Example 1 except that the radical polymerizable compound having no charge transport structure contained in the liquid application for the protection layer is changed to the following compound. The ionization potential of the charge transport layer is 5.42 eV.

| | |
|---|---|
| Radical polymerizable monomer having a charge transport structure: (caprolactone modified dipentaerythritol hexaacrylate (KAYARAD DPCA-120, manufactured by Nippon Kayaku Co., Ltd., molecular weight of 1,947, 6 functional groups, molecular weight/the number of functional groups = 325) | 10 parts |

The image bearing member is manufactured in the same manner as in Example 1 except that the radical polymerizable compound having a charge transport structure contained in the liquid application for the protection layer is changed to 7 parts of the illustrated compound No. 54 having one functional group and 3 parts of the compound having two functional groups represented by the following structure. The ionization potential of the charge transport layer is 5.44 eV.

| | |
|---|---|
| Radical polymerizable compound having one functional group with a charge transport structure (Illustrated Compound No. 54) | 7 parts |
| Radical polymerizable compound having two functional groups with a charge transport structure represented by the following chemical formula 22 | 3 parts |

Chemical formula 22

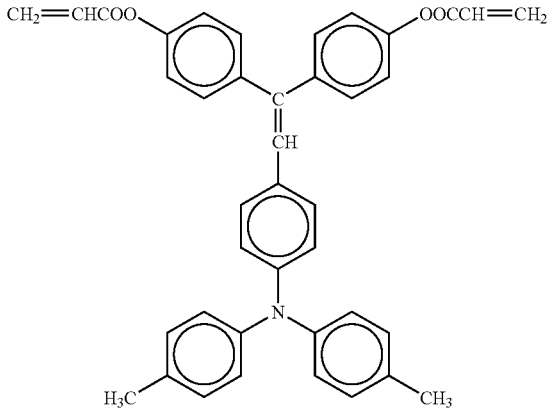

Example 13

The image bearing member is manufactured in the same manner as in Example 1 except that the liquid application for the protection layer is changed to the liquid application for the protection layer having the following recipe with no optical irradiation treatment but heating and drying treatment at 150° C. for 20 minutes. The ionization potential of the charge transport layer is 5.40 eV.

Liquid Application for Protection Layer

Mill Base of Example 1

Isocyante: (Sumidul HT (HDI adduct) (manufactured by Sumitomo Chemical Bayer Co., Ltd.)

Polyol 1 represented by the following chemical formula 23

Chemical formula 23

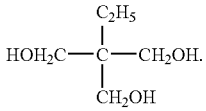

Polyol 2 (LZR170, manufactured by Fujikura Kasei Co., Ltd.)

Reactive Compound Having Charge Transport Structure represented by the following chemical formula 24

Chemical formula 24

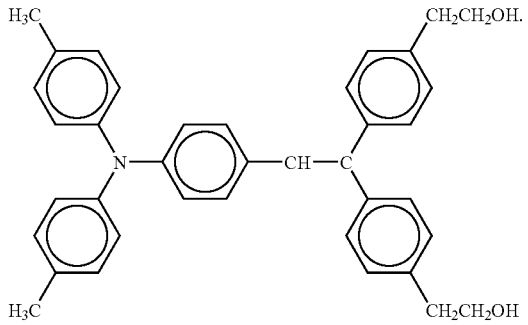

Solvent tetrahydrofuran/cyclohexanone

Mixing Condition (part)

Mill base/isocyanate/polyol 1/polyol 2/reactive compound having a charge transport structure/tetrahydrofuran=2/3/2/8/10/120.

-continued

| Liquid Applicatoin for Protection Layer | |
|---|---|
| Chemical formula 25 | |
| 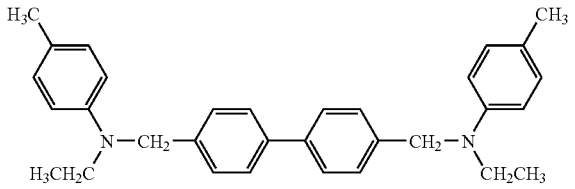 | |
| Tetrahydrofuran | 600 parts |

Example 14

The image bearing member is manufactured in the same manner as in Example 1 except that the liquid application for the charge generation layer having the following recipe and the liquid application for the charge transport layer having the following recipe are applied to form a charge generation layer and a charge transport layer. The ionization potential of the charge transport layer is 5.39 eV.

| Liquid Applicatoin for Charge Generation Layer | |
|---|---|
| Asymmetric bisazo pigment represented by the following chemical formula 26 | 5 parts |
| Ionizatoin potential | 5.82 eV |
| Chemical formula 26 | |
| 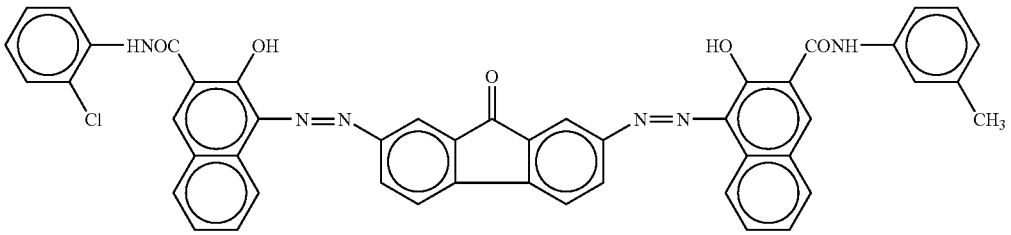 | |
| Polyvinylbutyral (BM-S, manufactured by Sekisui Chemical Co., Ltd. | 1.5 parts |
| Cyclohexanone | 250 parts |
| 2-butanone | 100 parts |

Comparative Example 17

The image bearing member is manufactured in the same manner as in Example 1 except that the liquid application for the protection layer is changed to the liquid application for the protection layer having the following recipe with no optical irradiation treatment but heating and drying treatment at 150° C. for 20 minutes. The ionization potential of the charge transport layer is 5.39 eV.

| Liquid Applicatoin for Protection Layer | |
|---|---|
| Mill base of Example 1 | |
| Polycarbonatel (Z polika, manufactured by Teijin Chemicals Ltd. | 10 parts |
| Charge transport material represented by CTM17 (molecular weight: 672.92): | 7 parts |
| Compound having an alkylamino group represente by the following chemical formula 25: | 1 part |

| Liquid Applicatoin for Charge Transport Layer | |
|---|---|
| Polycarbonatel (Z polika, manufactured by Teijin Chemicals Ltd.) | 10 parts |
| Charge transport material represented by CTM17 (molecular weight: 672.92): | 7 parts |
| Silicone oil (1 $cm^2/s$ (100 cSt), manufactured by Shin-etsu Chemical Co., Ltd.) | 0.002 parts |
| Tetrahydrofuran | 100 parts |
| Anti-Oxidizer represented by the following chemical formula 27 | |
| Chemical formula 27 | |
| 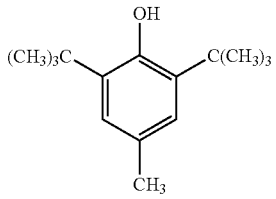 | |

-continued

| Liquid Applicatoin for Charge Transport Layer |
|---|
| Anti-Oxidizer represented by the following chemical formula 28<br>Chemical formula 28 |

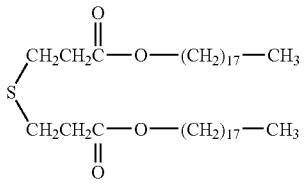

Comparative Example 18

The image bearing member is manufactured in the same manner as in Example 14 except that the liquid application for the protection layer is changed to the liquid application for the protection layer having the following recipe with no optical irradiation treatment but heating and drying treatment at 150° C. for 20 minutes. The ionization potential of the protection layer and the charge transport layer is 5.39 eV.

| Liquid Applicatoin for Protection Layer | |
|---|---|
| Mill base of Example 1 | 6.5 parts |
| Polycarbonatel (Z polika, manufactured by Teijin Chemicals Ltd. | 10 parts |
| Charge transport material represented by CTM17 (molecular weight: 672.92): | 7 parts |
| Anti-Oxidizer represented by the following chemical structure | 0.5 parts |
| Tetrahydrofuran | 600 parts |

Example 15

The image bearing member is manufactured in the same manner as in Example 1 except that the additional amount of the polycarbonate compound in the mill base is changed from 0.2 parts to 0.28 parts.

Example 16

The image bearing member is manufactured in the same manner as in Example 1 except that the additional amount of the polycarbonate compound in the mill base is changed from 0.2 parts to 0.32 parts.

Example 17

The image bearing member is manufactured in the same manner as in Example 1 except that the additional amount of the polycarbonate compound in the mill base is changed from 0.2 parts to 0.8 parts.

Example 18

The image bearing member is manufactured in the same manner as in Example 1 except that the additional amount of the polycarbonate compound in the mill base is changed from 0.2 parts to 1.6 parts.

Example 19

The image bearing member is manufactured in the same manner as in Example 1 except that the additional amount of the polycarbonate compound in the mill base is changed from 0.2 parts to 2.0 parts.

Comparative Example 19

The image bearing member is manufactured in the same manner as in Comparative Example 18 except that the additional amount of the polycarbonate compound in the mill base is changed from 0.2 parts to 0.32 parts.

Comparative Example 20

The image bearing member is manufactured in the same manner as in Comparative Example 18 except that the additional amount of the polycarbonate compound in the mill base is changed from 0.2 parts to 0.8 parts.

Example 20

The image bearing member is manufactured in the same manner as in Example 1 except that the polycarboxylic acid compound is changed to the following polycarboxylic acid compound.

BYK-P105, manufactured by BYK Chemie; acid value: 365 mgKOH/g; non-volatile portion: 100%

Example 21

The image bearing member is manufactured in the same manner as in Example 16 except that the alumina balls for use in dispersion is changed to alumina balls having a purity of 99.6% and the rotation speed during dispersion is changed to 200 rpm.

Example 22

The image bearing member is manufactured in the same manner as in Example 21 except that the alumina halls for use in dispersion is changed to alumina balls having a purity of 99.9%, the dispersion time is changed to 48 hours, and the rotation speed during dispersion is changed to 200 rpm.

Evaluation on Settling Down of Filler

The dispersion stability of the fillers is evaluated with regard to the liquid application for the protection layer obtained according to the methods described above. A dispersion stability analyzer (LUMiSizer 612, manufactured by Nihon Rufuto Co., Ltd.) is used to evaluate the dispersion stability.

The liquid application is subject to centrifugal by this measuring instrument to obtain a graph by integrating the area of the transmission amount of light over time. The variation ratio (%/hour) of the values of integral of the transmission amount of light per hour is obtained by the slope. The dispersion is stable when the variation ratio is small. The rotation speed of the centrifugal is 2,000 rpm and the temperature is set at 25° C. The measurement results are shown in Table 3.

TABLE 3

| | Dispersion solvent | Addition amount of polycarboxylic acid compound (parts) | Dispersoin method | Variation ratio (%/hour) of values of integration for transmission amount of light |
|---|---|---|---|---|
| Example 1 | cyclopentanone | 0.2 | Ball mill | 1,069 |
| Comparative Example 1 | tetrahydrofuran | 0.2 | Ball mill | 2,696 |
| Comparative Example 2 | cyclohexanone | 0.2 | Ball mill | 1,217 |
| Comparative Example 3 | toluene | 0.2 | Ball mill | 3,682 |
| Comparative Example 4 | xylene | 0.2 | Ball mill | 3,929 |
| Comparative Example 5 | 1,3-dioxolan | 0.2 | Ball mill | 2,597 |
| Comparative Example 6 | 2-propanol | 0.2 | Ball mill | 3,202 |
| Example 2 | cyclopentanone | 0.2 | Paint shaker | 1,095 |
| Comparative Example 7 | tetrahydrofuran | 0.2 | Paint shaker | 3,474 |
| Example 3 | cyclopentanone/ tetrahydrofuran (7/3) | 0.2 | Paint shaker | 1,193 |
| Comparative Example 8 | cyclopentanone | 0.0 | Ball mill | 4,076 |
| Example 4 | cyclopentanone | 0.2 | Ball mill | 1,527 |
| Example 9 | tetrahydrofuran | 0.2 | Ball mill | 3,513 |
| Example 5 | cyclopentanone | 0.2 | Ball mill | 625 |
| Comparative Example 18 | cyclopentanone | 0.2 | Ball mill | 1,124 |
| Example 15 | cyclopentanone | 0.28 | Ball mill | 1,012 |
| Example 16 | cyclopentanone | 0.32 | Ball mill | 966 |
| Example 17 | cyclopentanone | 0.8 | Ball mill | 964 |
| Example 18 | cyclopentanone | 1.6 | Ball mill | 1,146 |
| Example 19 | cyclopentanone | 2.0 | Ball mill | 1,591 |
| Comparative Example 19 | cyclopentanone | 0.32 | Ball mill | 1,007 |
| Comparative Example 20 | cyclopentanone | 0.8 | Ball mill | 991 |
| Example 20 | cyclopentanone | 0.2 | Ball mill | 1,007 |
| Example 21 | cyclopentanone | 0.32 | Ball mill | 982 |
| Example 22 | cyclopentanone | 0.32 | Ball mill | 916 |

As seen in the results, when cyclopentanone is contained as a dispersion solvent, the filler tends to settle down slowly and thus the dispersion stability thereof is high while the speed of the settling down of the filler tends to significantly increase in the dispersion conducted using other solvents such as simple tetrahydrofuran, toluene, and xylene and toluene. The tendency is true when the dispersion method is changed from a ball mill to a paint shaker. The solvent mixture (7/3) of cyclopentanone and tetrahydrofuran shows a good result but increases the variation ratio slightly more than simple cyclopentanone. In addition, other than cyclopentanone, cyclohexanone shows a relatively good result. However, when cyclopentanone is used as a dispersion solvent without a combinational use with the polycarboxylic acid compound, the settling speed significantly increases. That is, it is found that the polycarboxylic acid compound is required. Furthermore, when a filler that has a relatively large average primary particle diameter is used, the settling speed increases but when cyclopentanone is used as the dispersion solvent, the settling speed is significantly reduced in comparison with when tetrahydrofuran is used.

In addition, as the addition amount of the polycarboxylic acid compound increases, the settling speed of the filler slows down but when the addition amount surpasses the limit shown in the relationship I, the settling speed increases to the contrary.

Evaluation on Acceleration of Settling Speed of Filler in Circulation of Liquid Application Among the liquid applications for the protection layer obtained according to the methods described above, liquid circulation tests are conducted for Examples 1, 2, and 15 to 23 and Comparative Examples 18 to 20 and thereafter the dispersion stability is evaluated. The liquid circulation test is conducted by circulating about 200 cc of the liquid application for 10 hours using a diaphragm pump for evaluation on accelerated deterioration. The dispersion stability is evaluated immediately after the circulation test using the dispersion stability analyzer (LUMiSizer 612, manufactured by Nihon Rufuto Co., Ltd.) Furthermore, the liquid application after the circulation test is preserved in a stationary manner for one month and thereafter, sufficiently stirred at room temperature. Then, the dispersion stability is evaluated again with the same instrument. The rotation speed of the centrifugal is 2,000 rpsm and the measuring temperature is set at 25° C. The measurement results are shown in Table 4.

TABLE 4

| | Addition amount of polycarboxylic acid compound (parts) | Value obtained from Relationship I | Variation ratio (%/hour) of values of integration for transmission amount of light: Immediately after circulation test | Variation ratio (%/hour) of values of integration for transmission amount of light: After one month staationary preservation |
|---|---|---|---|---|
| Example 1 | 0.2 | 4.5 | 1,522 | 2,435 |
| Example 2 | 0.2 | 4.5 | 1,953 | 2,892 |
| Comparative Example 18 | 0.2 | 4.5 | 1,636 | 4,017 |
| Example 15 | 0.28 | 6.3 | 1,088 | 1,261 |
| Example 16 | 0.32 | 7.2 | 985 | 992 |
| Example 17 | 0.8 | 18 | 980 | 989 |
| Example 18 | 1.6 | 36 | 1,157 | 1,179 |
| Example 19 | 2.0 | 45 | 1,625 | 1,730 |
| Comparative Example 19 | 0.32 | 7.2 | 1,080 | 3,155 |
| Comparative Example 20 | 0.8 | 18 | 1,002 | 2,723 |
| Example 20 | 0.2 | 9.1 | 1,066 | 1,130 |
| Example 21 | 0.32 | 7.2 | 998 | 1,018 |
| Example 22 | 0.32 | 7.2 | 920 | 931 |

When the dispersion stability is evaluated after load is applied to the liquid application by circulation, the dispersion stability of the liquid dispersion tends to deteriorate on the whole. Furthermore, when the liquid dispersion is preserved in a stationary manner at 10° C. for one month, the liquid dispersion stability furthermore deteriorates. Thus, the status of the liquid dispersion is not recovered to the level prior to the circulation even after the liquid dispersion is sufficiently stirred. However, when the addition amount of the polycarboxylic acid compound increases and satisfies the relationship I, the liquid dispersion stability does not significantly deteriorate after the one month stationary preservation. Thus, the working life of the liquid dispersion is elongated. In addition, when alumina balls having a purity of 99% or higher are used as dispersion media with an increased dispersion time, it is found that the dispersion stability is significantly improved.

In the case of the protection layer in Comparative Example in which polycarbonate is used as the binder resin, the dispersion stability tends to significantly deteriorate after one month stationary preservation. Thus, although this deterioration is reduced by increasing the addition amount of the polycarboxylic acid compound, the working life of the liquid application is not elongated.

Voltage Measurement on Image Bearing Member

Evaluation is conducted using a digital photocopier (manufactured by Ricoh Co., Ltd.) employing a tandem system remodeled as follows: the image bearing member obtained according to the methods described above is incorporated into a process cartridge including the charging device employing a vicinity type roller charging system illustrated in FIG. 4, a cleaning device including a cleaning blade, and a lubricant application device that is situated on the downstream side of the cleaning device and applies zinc stearate to the surface of the image bearing member via a brush; Furthermore, the process cartridge includes a probe connected to a surface electrometer instead of the development device which is removed from the development unit and an LED of 660 nm as a discharging device; a transfer device is removed; and an irradiation device using a semiconductor laser of 655 nm is used; The calculation results based on the relationship I in each Example and Comparative Example are shown in Table 5.

A solid black image written on all over the sheet is output on 50 sheets and the voltage at the 50th sheet is measured as the irradiation voltage (VL) for evaluation. Thereafter, the development unit is replaced with a development unit in which development material using spherical polymerization toner is filled and a transfer device is attached. Then, images are repeatedly output and the obtained images are evaluated.

The Images are evaluated according to the following criteria:

Images with no image deficiency: E (Excellent)

Images having a slightly degradation with no practical problem: G (Good)

Images with degradation which can be easily recognized: B (bad)

Images with image deficiencies and problems with regard to the image quality: P (Poor) The results are shown in Table 6.

Evaluation on Internal Curability of Protection Layer

Figure 9:
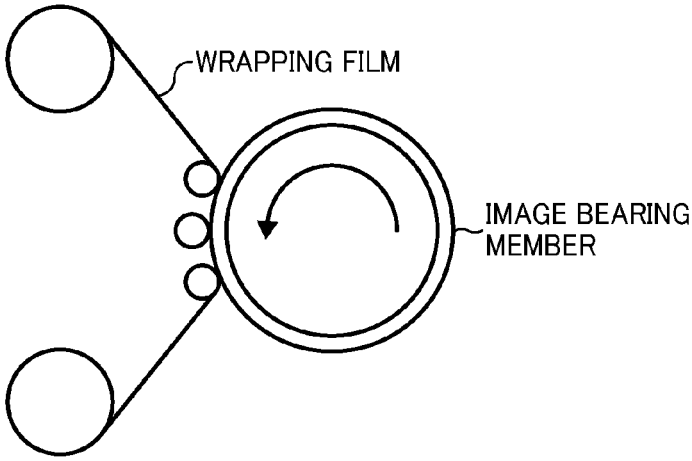
FIG. 9 is a schematic diagram illustrating an accelerated abrasion testing device for use in Examples described below.

The image bearing member obtained according to the methods described above is set in an accelerated abrasion tester illustrated in FIG. 9 and the amount of abrasion over time is measured while forcibly abrading the image bearing member constantly. The internal curability of the protection layer is evaluated based on the relationship between the accelerated abrasion time and the abrasion amount. A wrapping film (manufactured by Sumitomo 3M Limited) having a width of 10 cm with a granularity of 3.0 μm is used as the grinding sheet. In addition, the abrasion amount is obtained by measuring the layer thickness of the image bearing member and the layer thickness is measured by an eddy-current thickness measuring device (manufactured by Fisher Instrument Company) The internal curability of the protection layer is evaluated by plotting the abrasion amount to the accelerated abrasion time from the measurement data for at least 8 points between the surface of the protection layer and the interface between the protection layer and the charge transport layer to obtain the correlation coefficient of approximate curves. The internal curability is ranked as the following criteria:

When a straight line having a correlation coefficient of 0.996 or higher is obtained: E (Excellent)

When a straight line having a correlation coefficient of from 0.990 to less than 0.996 is obtained: G (Good)

When the correlation coefficient is less than 0.990 and: an obvious inflection point is observed at a point beyond the half of the surface of the protection layer: B (Bad)

When the correlation coefficient is less than 0.990 and: an obvious inflection point is observed on the near side of the surface of the protection layer: B (Bad) These results are shown in Table 6.

Evaluation on Attachability of Protection Layer

The image bearing member obtained according to the method described above is cut to a square having a one side of 10 mm and the attachability of the protection layer is evaluated by a surface interface physicality analyzer (SAICA DN-20, manufactured by Daipla Wintes Co., Ltd.). The measurement is performed under the following conditions:

Cutting blade width: 0.5 mm

Horizontal cutting speed: 0.1 μm/sec.

Vertical cutting speed: 0.01 μm/sec.

Figure 10:
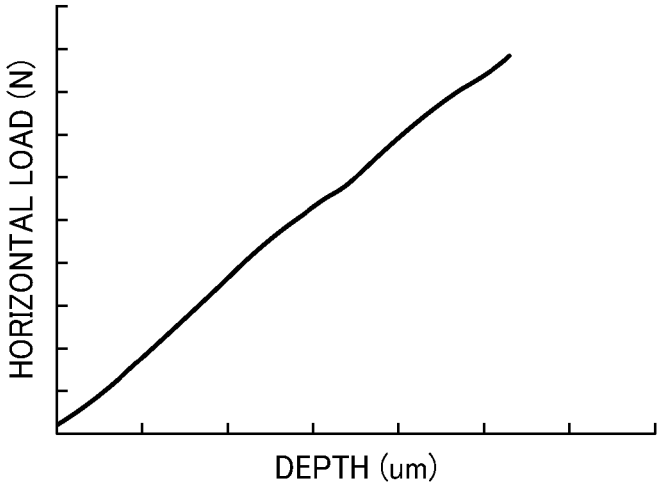
FIG. 10 is a graph illustrating an example of the measurement results by SAICAS.
Figure 11:
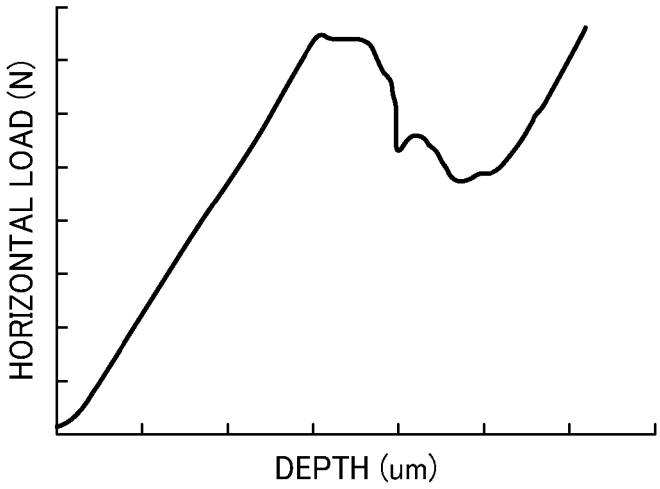
FIG. 11 is a graph illustrating another example of the measurement results by SAICAS.

Constant cutting speed mode Attachability is evaluated as follows. The horizontal load per cutting time (depth) measured has a linear relationship (significantly a straight line) as illustrated in FIG. 10 unless peeling-off of the protection layer occurs. However, when the protection layer is peeled off, a drop in the horizontal load is observed at the depth where the peeling-off occurs. Thus, a graph having an inflection point as illustrated in FIG. 11 is obtained. Thus, the attachability of the protection layer is evaluated as follows:

When a significant straight line is obtained to the depth of the protection layer: E (Excellent)

When a significant straight line is not obtained to the depth of the protection layer but no horizontal load drop is observed: G (Good)

When a horizontal load drop is observed and its inflection point is observed after the half of the protection layer thickness: B (Bad)

When a horizontal load drop is observed and its inflection point is observed before the half of the protection layer thickness: P (Poor). These results are shown in Table 6.

TABLE 5

| | Ball mill dispersoin using alumina balls having a purity of 99% or higher | Acid value of polycarboxylic acid compound (mg/KOH/g) | Value within the range of Relationship I: $6 \leqq (A \times B)/C$ |
|---|---|---|---|
| Example 15 | No | 180 | Yes (6.3) |
| Example 16 | No | 180 | Yes (7.2) |
| Example 17 | No | 180 | Yes (18) |
| Example 18 | No | 180 | Yes (36) |
| Example 19 | No | 180 | No (45) |
| Comparative Example 18 | No | 180 | Yes (7.2) |
| Comparative Example 19 | No | 180 | Yes (18) |
| Example 20 | No | 365 | Yes (9.1) |
| Example 21 | Yes | 180 | Yes (7.2) |
| Example 22 | Yes | 180 | Yes (7.2) |

TABLE 6

| | Initial VL (-V) | | Initial image evaluation | Internal Curability of Protection Layer | Attachability of protection layer | Ionization potential |
|---|---|---|---|---|---|---|
| Example 1 | 90 | E | Excellent | E | E | −0.17 |
| Comparative Example 1 | 88 | E | Excellent | G | P | −0.17 |
| Comparative Example 2 | 138 | B | Low image density | B | E | −0.17 |
| Comparative Example 3 | 122 | G | Low image density | P | G | −0.17 |
| Comparative Example 4 | 126 | G | Low image density | P | G | −0.17 |
| Comparative Example 5 | 112 | P | Bad cleaning performance | B | P | −0.17 |
| Comparative Example 6 | 107 | B | Image deficiency of black spots | B | P | −0.17 |
| Example 2 | 83 | E | Excellent | E | E | −0.17 |
| Comparative Example 7 | 80 | E | Excellent | G | B | −0.17 |
| Example 3 | 82 | E | Excellent | G | G | −0.17 |
| Comparative Example 8 | 240 | P | Low image density | P | G | −0.17 |
| Example 4 | 86 | E | Excellent | E | E | −0.17 |
| Comparative Example 9 | 82 | E | Excellent | G | P | −0.17 |
| Example 5 | 71 | E | Excellent | E | E | −0.17 |
| Example 6 | 98 | E | Excellent | E | E | −0.14 |
| Example 7 | 104 | E | Excellent | E | E | −0.11 |
| Example 8 | 119 | G | Low image density | E | E | −0.03 |
| Example 9 | 122 | G | Low image density | E | E | −0.02 |
| Example 10 | 107 | E | Excellent | E | E | −0.05 |
| Comparative Example 10 | 136 | B | Low image density | B | G | −0.03 |
| Comparative Example 11 | 95 | E | Excellent | P | G | −0.18 |
| Comparative Example 12 | 164 | B | Low image density | P | G | +0.08 |
| Comparative Example 13 | 140 | B | Low image density | B | G | −0.04 |
| Comparative Example 14 | 125 | G | Low image density | P | G | −0.10 |
| Comparative Example 15 | 144 | B | Low image density | G | P | −0.01 |
| Comparative Example 16 | 101 | P | Bad cleaning performance | E | E | −0.17 |
| Example 11 | 124 | G | Low image density | G | E | −0.17 |
| Example 12 | 116 | G | Low image density | E | E | −0.19 |
| Example 13 | 110 | G | Low image density | E | G | −0.15 |
| Comparative Example 17 | 124 | G | Low image density | Large amount of abrasion | E | −0.14 |
| Example 14 | 67 | G | Residual image | E | E | −0.03 |
| Comparative Example 18 | 69 | E | Excellent | Large amount of abrasion | E | 0.00 |
| Example 15 | 88 | E | Excellent | E | E | −0.17 |
| Example 16 | 85 | E | Excellent | E | E | −0.17 |
| Example 17 | 80 | E | Excellent | E | E | −0.17 |
| Example 18 | 74 | E | Excellent | E | E | −0.17 |
| Example 19 | 76 | E | Excellent | G | E | −0.17 |
| Comparative Example 19 | 65 | E | Excellent | Large amount of abrasion | E | 0.00 |

TABLE 6-continued

| | Initial VL (-V) | Initial image evaluation | Internal Curability of Protection Layer | Attachability of protection layer | Ionization potential |
|---|---|---|---|---|---|
| Comparative Example 20 | 60 | E Excellent | Large amount of abrasion | E | 0.00 |
| Example 20 | 83 | E Excellent | E | E | −0.17 |
| Example 21 | 78 | E Excellent | E | E | −0.17 |
| Example 22 | 79 | E Excellent | E | E | −0.17 |

As seen in the results, when cyclopentanone is used as a dispersion solvent, the voltage at an irradiation portion is low and the quality of the output images is high. Therefore, it is found that the protection layer is abraded in a significant straight line in the inside of the protection layer, meaning that the inside is uniformly cured. Furthermore, it is also found that the horizontal load does not drop when the cutting edge intrudes into the protection layer by SAICAS, meaning that the protection layer is not peeled off. However, another solvent that is used as the dispersion solvent raises the voltage at an irradiated portion and degrades the internal curability and/or the attachability of the protection layer, which is not satisfactory with regard to improvement on the durability of an image bearing member. Among these, the layer quality deteriorates by some solvents, thereby causing bad cleaning performance and image deficiencies due to, for example, black spots.

In addition, the molecular weight of the charge transport material contained in the charge transport layer affects the evaluation results. A charge transport material having a molecular weight of from 600 to 900 causes the voltage at an irradiation portion to be low and sustains the internal curability and attachability of the protection layer good while a charge transport material having a molecular weight less than 600 tends to particularly degrade the internal curability of the protection layer. A structure in which the ionization potential of the charge transport layer is at least 0.1 eV lower than that of the protection layer is found to reduce the voltage at an irradiation portion and be excellent with regard to the electrostatic characteristics. In addition, it is found that the voltage (VL) at an irradiation portion is reduced by increasing the polycarboxylic acid compound and thus the image quality is extremely excellent. Furthermore, the voltage at an irradiation portion is further reduced by using aluminum balls having a purity of 99% or higher during dispersion. The amount of abrasion powder of the dispersion media that are mingled into the liquid application is found to be reduced to 1/10 in the case of alumina balls having a purity of 99% or higher in comparison with alumina balls having a purity less than 99% On the other hand, spherical toner slips through the cleaning blade, causing bad cleaning performance, when the protection layer does not contain a filler. In addition, when a polycarbonate is used as the binder resin in combination with a filler, the image bearing member is significantly abraded by an accelerated abrasion test. Thus, the abrasion resistance of the image bearing member is inferior in such a combination to a case in which a curable resin is used.

Exposure Test of Image Bearing Member to $NO_x$ Gas

Among the image bearing members obtained according to the methods described above, an $NO_x$ gas exposure test is conducted for Examples 1, 2 and 15 to 22 and Comparative Examples 18 to 20. $NO_x$ gas exposure conditions are: density of $NO/NO_2$ is 40/10 ppm for 96 hours. Thereafter, the image bearing member is attached to a process cartridge including the charging device employing a vicinity type roller charging system illustrated in FIG. 4, a cleaning device including a cleaning blade, and a lubricant application device that is situated on the downstream side of the cleaning device and applies zinc stearate to the surface of the image bearing member via a brush and the process cartridge is attached to a remodeled digital photocopier employing a tandem system (manufactured by Ricoh Co., Ltd.) including an irradiation device using a semiconductor laser of 655 nm. Then, images are output using this photocopier. Comparison among the output images is made with regard to image blur and image definition. With regard to the image evaluation, images are evaluated according to the following criteria:

Quality images without image blur: E (Excellent)

Images with slightly degraded definition but no practical problem: G (Good)

Image blur observed: B (bad)

Image undistinguishable due to image blur: P (Poor) These results are shown in Table 7.

TABLE 7

| | Evaluation result on image after $NO_x$ exposure | |
|---|---|---|
| | Evaluation | Memo |
| Example 1 | E | Excellent with no definition decrease |
| Example 2 | E | Excellent with no definition decrease |
| Comparative Example 18 | B | Image blur observed with naked eyes |
| Example 15 | E | Excellent with no definition decrease |
| Example 16 | E | Excellent with no definition decrease |
| Example 17 | E | Excellent with no definition decrease |
| Example 18 | E | Excellent with no definition decrease |
| Example 19 | G | Slight definition decrease with no practical problem |
| Comparative Example 19 | B or P | Image blur observed with naked eyes |
| Comparative Example 20 | P | Image unditinguishable |
| Example 20 | E | Excellent with no definition decrease |
| Example 21 | E | Excellent with no definition decrease |
| Example 22 | E | |

Quality images are obtained without being influenced by increasing the addition amount of the polycarboxylic acid compound. However, the definition tends to slightly decrease without causing a practical problem in an enlarged image outside the range of relationship I. In Comparison Examples in which polycarbonate is used as the binder resin of the protection layer, image blur is observed in the accelerated deterioration test. Increasing the addition amount of the polycarboxylic acid compound leads to an increase of the impact on the image blur. Therefore, increasing the addition amount of the polycarboxylic acid compound is unsuitable in terms of the stability on the image quality.

According to these results, it is found that the image bearing member having a protection layer formed of a curable resin containing a filler improves the dispersion property and the settling down property of the filler and maintains the elution amount of the charge transport material to the protection layer, thereby making the curing status of the inside of the protection layer uniform and reducing the voltage at an irradiation portion. Furthermore, the protection layer containing a curable resin formed on the surface is not peeled off because the protection layer is firmly attached to the charge transport layer thereunder. In addition, the dispersion stability of the liquid application is drastically improved, thereby increasing the working life of the liquid application, which makes it possible to stably manufacture an image bearing member having excellent electrostatic characteristics and outputting quality images. Therefore, there are provided an image bearing member that has excellent electrostatic characteristics, produces quality images with little image blur, and has highly improved durability, a method of manufacturing the image bearing member, and an image forming apparatus using the image bearing member.

This document claims priority and contains subject matter related to Japanese Patent Applications Nos. 2009-028521 and 2008-315720, filed on Feb. 10, 2009, and Dec. 11, 2009, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of manufacturing an image bearing member comprising:

forming a charge generation layer overlying an electroconductive substrate;

forming a charge transport layer overlying the charge generation layer, the charge transport layer comprising a charge transport material having a molecular weight of from 600 to 900 and a binder resin; and forming a protection layer overlying the charge transport layer by applying a liquid application comprising a polymerizable compound having a charge transport structure, a polymerizable compound having no charge transport structure, a filler, a polycarboxylic acid compound, and cyclopentanone and curing the polymerizable compound having a charge transport structure, and the polymerizable compound having no charge transport structure, wherein the following relationship I is satisfied:

$$6 \leqq (A \times B/C) \leqq 40 \qquad \text{Relationship I}$$

where A represents a content in units of grams of the polycarboxylic acid compound, B represents an acid value in units of mgKOH/g of the polycarboxylic acid compound, and C represents a content in units grams of the filler.

2. The method of manufacturing an image bearing member according to claim 1, further comprising preparing the liquid application by dispersing the filler and dissolving the polycarboxylic acid in an organic solvent comprising the cyclopentanone.

3. The method of manufacturing an image bearing member according to claim 1, wherein the polycarboxylic acid compound has an acid value of from 150 to 400 mgKOH/g.

4. The method of manufacturing an image bearing member according to claim 1, wherein the charge transport material is a distyryl compound represented by the following chemical formula 1:

Chemical formula 1

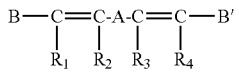

(1)

where $R_1$ to $R_4$ independently represent hydrogen atom, an alkyl group having 1 to 4 carbon atoms, an alkoxy group having 1 to 4 carbon atoms, or a substituted or non-substituted phenyl group, which may have an alkyl group having 1 to 4 carbon atoms, an alkoxy group having 1 to 4 carbon atoms as a substitution group, A represents a substituted or non-substituted arylene group, or a group represented by the following Chemical formula 1a:

Chemical formula 1a

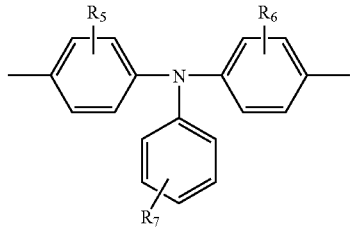

(1a)

where $R_5$, $R_6$, and $R_7$ independently represent hydrogen atom, an alkyl group having 1 to 4 carbon atoms, an alkoxy group having 1 to 4 carbon atoms, or substituted or non-substituted phenyl group, which may have an alkyl group having 1 to 4 carbon atoms, and an alkoxy group having 1 to 4 carbon atoms as a substitution group, B and B' independently represent a substituted or non-substituted aryl group, or a group represented by the following chemical formula 1b, Chemical formula 1b

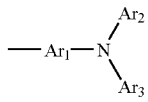

(1b)

where $Ar_1$ represents arylene group, which may have an alkyl group having 1 to 4 carbon atoms, and an alkoxy group having 1 to 4 carbon atoms as a substitution group, and $Ar_2$ and $Ar_3$ independently represent aryl group, which may have alkyl group having 1 to 4 carbon atoms, an alkoxy group having 1 to 4 carbon atoms as a substitution group.

5. The method of manufacturing an image bearing member according to claim 4, wherein the charge transport material is a distyryl compound represented by Chemical formula 2:

Chemical formula 2

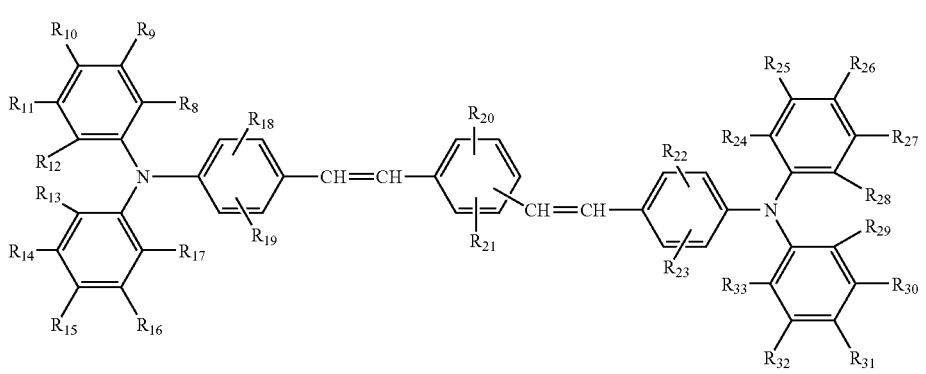

(2)

where $R_8$ to $R_{33}$ independently represent, hydrogen atom, an alkyl group having 1 to 4 carbon atoms, an alkoxy group having 1 to 4 carbon atoms, or a substituted or non-substituted phenyl group.

6. The method of manufacturing an image bearing member according to claim 4, wherein the charge transport material is a distyryl compound represented by Chemical formula 3:

Chemical formula 3

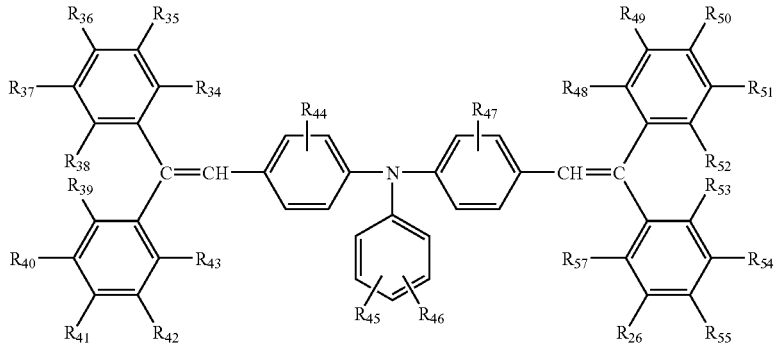

(3)

where $R_{34}$ to $R_{57}$ independently represent hydrogen atom, an alkyl group having 1 to 4 carbon atoms, an alkoxy group having 1 to 4 carbon 5 atoms, or a substituted or non-substituted phenyl group.

7. The method of manufacturing an image bearing member according to claim 1, wherein an ionization potential of the charge transport layer is at least 0.1 eV less than that of the protection layer.

8. The method of manufacturing an image bearing member according to claim 1, wherein the charge transport structure of the polymerizable compound having a charge transport structure is a triaryl amine structure.

9. The method of manufacturing an image bearing member according to claim 1, wherein a functional group of at least one of the polymerizable compound having a charge transport structure and the polymerizable compound having no charge transport structure is at least one of an acryloyloxy group and a methacryloyoxy group.

10. The method of manufacturing an image bearing member according to claim 1, wherein a ratio of a molecular weight to a number of a functional group of the polymerizable compound having no charge transport structure is 250 or less.

11. The method of manufacturing an image bearing member according to claim 1, wherein a number of functional groups in the polymerizable compound having no charge transport structure is at least 3 and a number of functional groups in the polymerizable compound having a charge transport structure is 1.

12. The method of manufacturing an image bearing member according to claim 1, wherein the filler is a metal oxide.

13. The method of manufacturing an image bearing member according to claim 12, wherein the metal oxide is alumina.

14. The method of manufacturing an image bearing member according to claim 1, wherein the filler has an average primary particle diameter of from 0.05 to 0.9 μM.

15. An image bearing member comprising:

an electroconductive substrate;

a charge generation layer overlying the electroconductive substrate;

a charge transport layer overlying the charge generation layer; and a protection layer overlying the charge transport layer, wherein the image bearing member is manufactured by a method of claim 1.

16. An image forming apparatus comprising:

the image bearing member of claim 15;

a charging device that charges the image bearing member;

an irradiation device that irradiates the image bearing member to form a latent electrostatic image thereon;

a development device that develops the latent electrostatic image with toner to form a toner image;

a transfer device that transfers the toner image to a recording medium to from a transferred image;

a fixing device that fixes the transferred image on the recording medium; and a cleaning device that cleans a surface of the image bearing member.

17. The image forming apparatus according to claim 16, further comprising a lubricant material application mechanism that applies a lubricant material to a surface of the image bearing member.

18. A process cartridge comprising:

the image bearing member of claim 15; and at least one device selected from the group consisting of a charging device that charges the image bearing member, an irradiation device that irradiates the image bearing member to form a latent electrostatic image thereon, a development device that develops the latent electrostatic image with toner to form a toner image, a transfer device that transfers the toner image to a recording medium to form a transferred image, a cleaning device that cleans a surface of the image bearing member, and a discharging device, wherein the process cartridge is detachably attachable to an image forming apparatus.

* * * * *